US006192642B1

(12) United States Patent
Colson et al.

(10) Patent No.: US 6,192,642 B1
(45) Date of Patent: Feb. 27, 2001

(54) CLADDING SYSTEM AND PANEL FOR USE IN SUCH SYSTEM

(75) Inventors: Wendell B. Colson, Boulder; Lee A. Cole, Evergreen; Jason T. Throne, Steamboat Spgs, all of CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 09/546,479

(22) Filed: Apr. 10, 2000

Related U.S. Application Data

(63) Continuation of application No. 08/752,957, filed on Nov. 20, 1996.
(60) Provisional application No. 60/007,501, filed on Nov. 22, 1995.

(51) Int. Cl.[7] ..... E04B 9/00
(52) U.S. Cl. ..... 52/506.06; 52/506.01; 52/508
(58) Field of Search ..... 52/506.06, 506.01, 52/508, 22, 63

(56) References Cited

U.S. PATENT DOCUMENTS

| | | |
|---|---|---|
| 912,849 | 2/1909 | Hultgren . |
| 1,998,423 | 4/1935 | Stubbs . |
| 2,073,036 | 3/1937 | Voigt . |
| 2,271,929 | 2/1942 | Venzie . |
| 2,497,912 | 2/1950 | Rees . |

(List continued on next page.)

FOREIGN PATENT DOCUMENTS

| | | |
|---|---|---|
| 1287207 | 8/1991 | (CA) . |
| 557938 | 1/1975 | (CH) . |
| 657409 | 8/1986 | (CH) . |
| 3245214 | 6/1984 | (DE) . |
| 3631919 | 4/1988 | (DE) . |
| 171116 | 2/1986 | (EP) . |
| 305092 | 3/1989 | (EP) . |
| 340815 | 11/1989 | (EP) . |
| 451912 | 10/1991 | (EP) . |
| 1286348 | 7/1962 | (FR) . |
| 714595 | 9/1954 | (GB) . |
| 1554159 | 10/1979 | (GB) . |
| 2258257 | 1/1995 | (GB) . |
| 7602204 | 9/1977 | (NL) . |
| 9201396 | 3/1993 | (NL) . |
| 9400663 | 1/1994 | (WO) . |

*Primary Examiner*—Robert Canfield
(74) *Attorney, Agent, or Firm*—Dorsey & Whitney LLP

(57) ABSTRACT

A cladding system for walls or ceilings of a building structure consisting of a panel or panels that are sectioned so as to provide a variety of aesthetics. The sections in the panel may be joined along articulated lines of joinder so that an entire panel comprised of a plurality of sections can be expanded or retracted to either cover or selectively expose the wall or ceiling across which the system is mounted. The sections in a panel may be cellular and may thereby form a honeycomb-type panel, and the materials from which the panels are made may vary between being rigid, flexible, hard, soft, flat, reflective, and the like. Panels can be supported with side rails extending along each side of the panel while not requiring cross rails so that, for example, when a panel is used in a ceiling system and retracted from its expanded condition beneath a ceiling structure, generous access is provided to the ceiling structure for repair or other work on utilities such as plumbing, electrical, and the like that are found embedded in the ceiling. Intermediate rails, parallel to the side rails, can also be provided, if necessary, to support a panel along intermediate portions thereof or between adjacent panels. The supporting rails for the panels can take on numerous configurations so as to support the panels in varied ways depending to some degree upon the particular panel construction being utilized.

20 Claims, 50 Drawing Sheets

U.S. PATENT DOCUMENTS

| | | | | |
|---|---|---|---|---|
| 3,037,594 | | 6/1962 | Kaufman . | |
| 3,139,958 | | 7/1964 | DeWitt . | |
| 3,254,462 | | 6/1966 | Toler . | |
| 3,300,926 | | 1/1967 | Heirich . | |
| 3,315,727 | | 4/1967 | Clark . | |
| 3,390,495 | | 7/1968 | Dalby . | |
| 3,418,766 | | 12/1968 | Jackson . | |
| 3,466,830 | | 9/1969 | Smith . | |
| 3,534,512 | | 10/1970 | Ballas . | |
| 3,741,843 | | 6/1973 | Louis . | |
| 3,762,108 | | 10/1973 | Pierson . | |
| 3,763,606 | | 10/1973 | Rindebong . | |
| 3,791,089 | * | 2/1974 | Alderman | 52/484 |
| 3,875,717 | | 4/1975 | Moeller . | |
| 3,934,387 | | 1/1976 | Moeller . | |
| 4,193,239 | | 3/1980 | Barto . | |
| 4,230,171 | | 10/1980 | Baker, Sr. . | |
| 4,374,536 | | 2/1983 | Becker . | |
| 4,450,027 | | 5/1984 | Colson . | |
| 4,461,232 | | 7/1984 | Berg . | |
| 4,463,537 | | 8/1984 | Rodriguez et al. . | |
| 4,550,545 | | 11/1985 | Schulz . | |
| 4,590,727 | | 5/1986 | Ghahremani et al. . | |
| 4,640,064 | | 2/1987 | Goodworth, II . | |
| 4,641,475 | | 2/1987 | Berridge . | |
| 4,647,488 | | 3/1987 | Schnebly et al. . | |
| 4,665,964 | | 5/1987 | Zommers . | |
| 4,677,012 | | 6/1987 | Anderson . | |
| 4,677,013 | | 6/1987 | Anderson . | |
| 4,696,142 | | 9/1987 | Mieyai et al. . | |
| 4,706,433 | | 11/1987 | Rijnders . | |
| 4,878,322 | | 11/1989 | Ikeda et al. . | |
| 4,880,044 | | 11/1989 | Judkins . | |
| 5,024,034 | | 6/1991 | Gailey . | |
| 5,182,893 | | 2/1993 | Goodworth . | |
| 5,184,659 | | 2/1993 | Alcocer . | |
| 5,251,415 | | 10/1993 | Van Auken et al. . | |
| 5,253,463 | | 10/1993 | Witmyer . | |
| 5,273,096 | | 12/1993 | Thomsen et al. . | |
| 5,273,097 | | 12/1993 | Siegler . | |
| 5,417,025 | | 5/1995 | Nute et al. . | |
| 5,425,408 | | 6/1995 | Colson . | |
| 5,483,774 | | 1/1996 | Siemerink et al. . | |
| 5,503,210 | | 4/1996 | Colson et al. . | |
| 5,513,470 | | 5/1996 | Vollebregt . | |
| 5,600,971 | * | 2/1997 | Suk | 52/713 |
| 5,649,583 | | 7/1997 | Hsu . | |
| 5,724,780 | | 3/1998 | Bolich . | |
| 6,006,476 | * | 1/1999 | Zarnick | 52/6 |

* cited by examiner

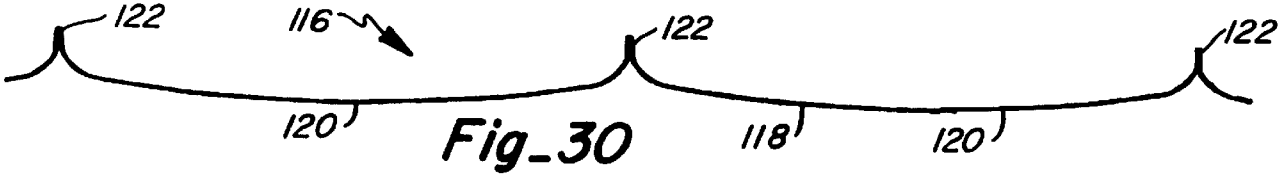
Fig_30
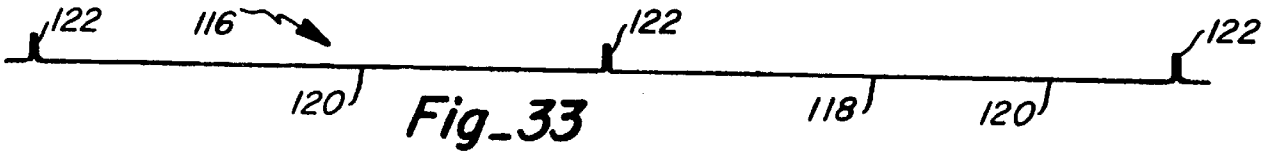
Fig_33
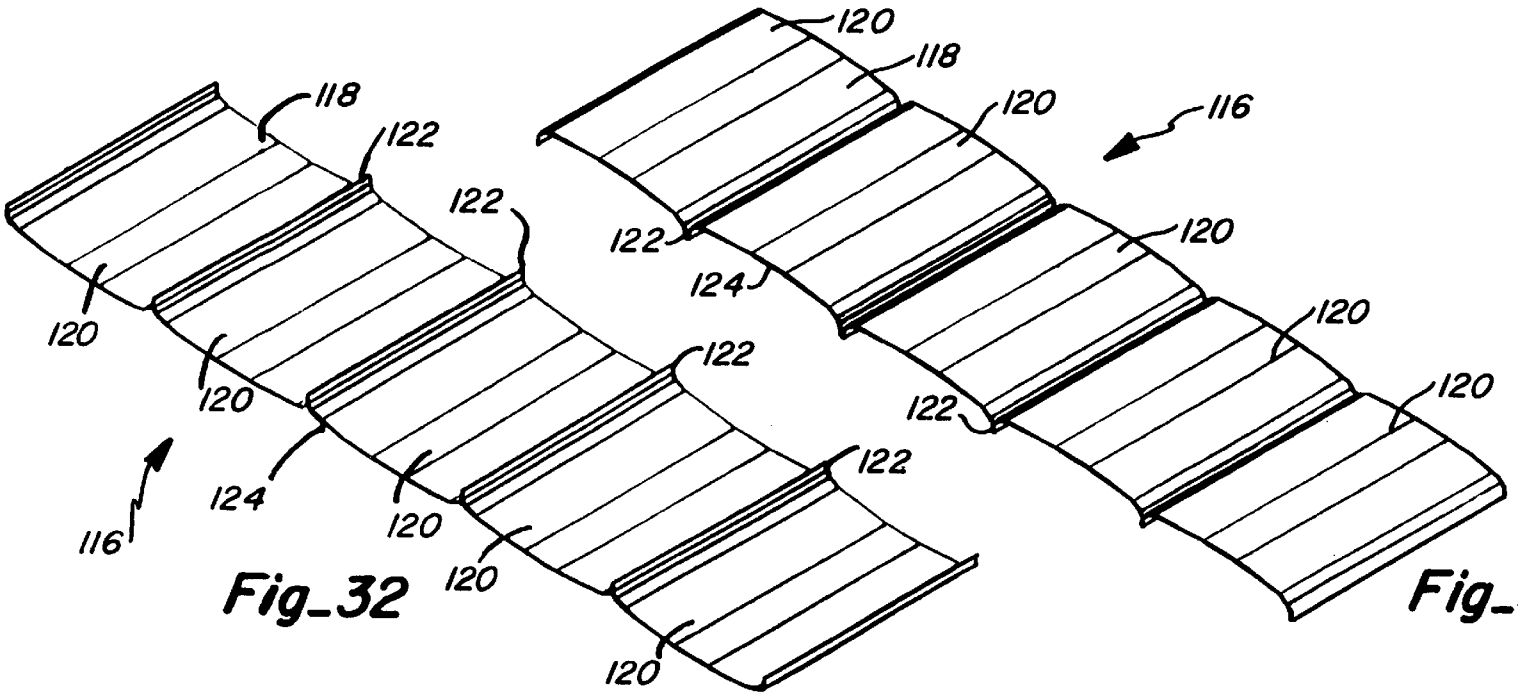
Fig_31
Fig_32

274
270
272
270
272
272

276
270
272
64
64
272
278

278
272
280
270

270
272
272

Fig_121A
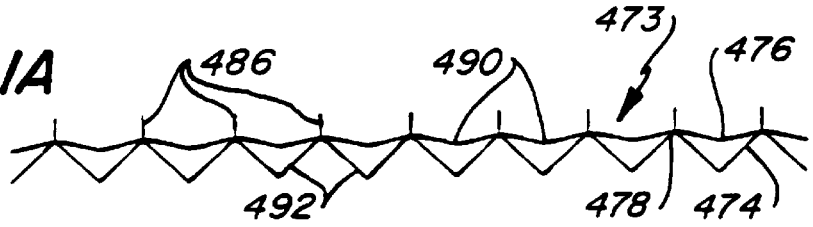
Fig_121B
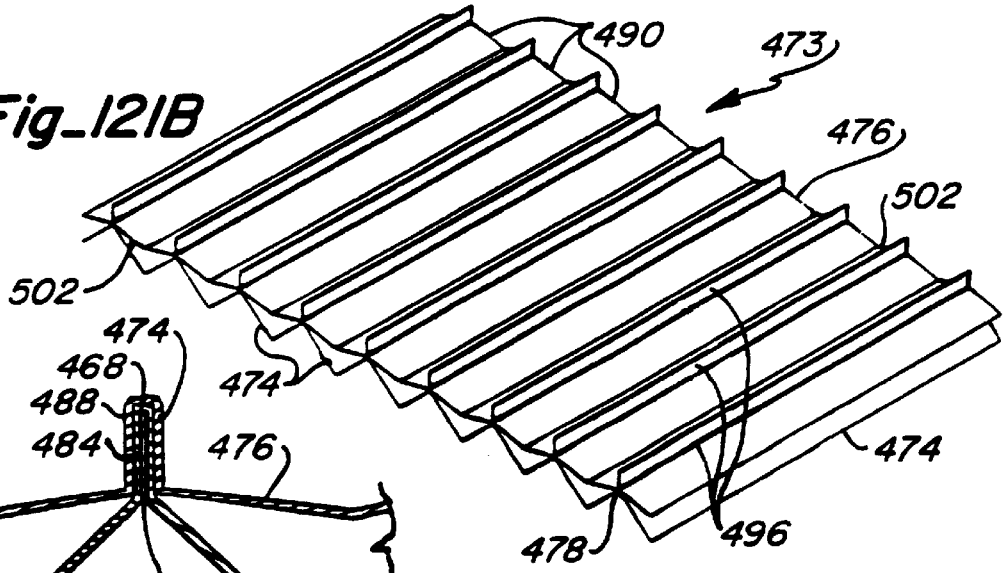
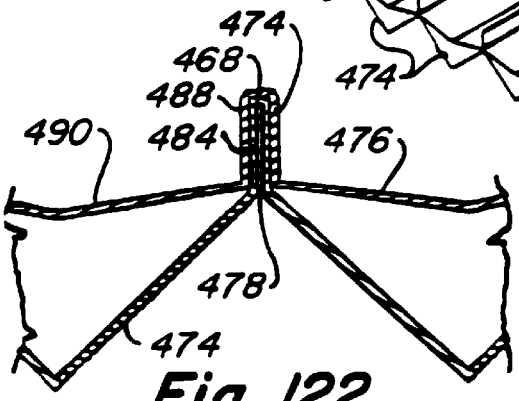
Fig_122
Fig_123
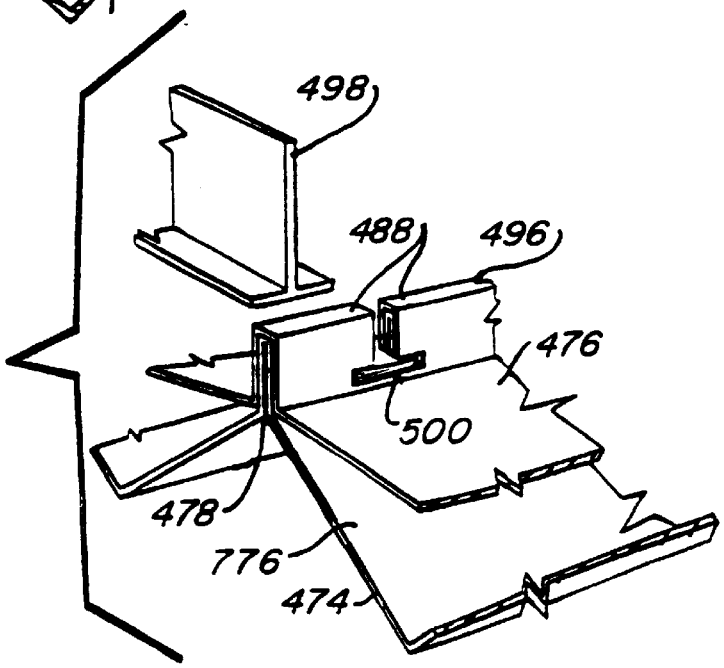

CLADDING SYSTEM AND PANEL FOR USE IN SUCH SYSTEM

CROSS-REFERENCE TO RELATED APPLICATIONS

This application is a continuation of U.S. application Ser. No. 08/752,957 filed Nov. 20, 1996, and claims the benefit of provisional application Ser. No. 60/007,501 filed Nov. 22, 1995. These applications are hereby incorporated by reference as though fully set forth herein.

BACKGROUND OF THE INVENTION a. Field of the Invention

The present invention relates generally to cladding systems and more particularly to ceiling systems and wall coverings for building structures. The system may be a sectional or in some instances cellular system and can in some embodiments be expanded and retracted across a wall or an overlying ceiling structure.

b. Description of the Known Art

Ceilings or walls for building structures take many different forms which can be as basic as wood panels or drywall to, in the case of ceilings, more elaborate designer-type ceilings. Designer-type ceilings may consist of metal or plastic tubes, strips, panels, sheets of fabric or the like which are interconnected in various forms and configurations to obtain a desired aesthetic effect. Such designer systems are typically reserved for commercial establishments. Between the two above-noted extremes are ceiling systems commonly referred to as drop ceilings which incorporate a grid work of interconnected metal support strips defining shelves on which insulating panels are removably seated. Such systems are commonly found in which include aesthetics, sound absorption, heat insulation and the fact that the panels are removable to access the ceiling structure above the ceiling system and any utilities such as plumbing, ventilation or electrical that may be found above the ceiling system.

Drywall ceilings, while being one of the most common ceilings found in building structures, have the drawback of being very inflexible and also very plain from an aesthetic standpoint. In order to access the space above a drywall ceiling, holes must be cut in the drywall or the drywall itself removed which can be an expensive process considering replacement. The designer-type systems are also more permanent in nature even though providing a greater variety of aesthetics but have the drawback of being difficult and accordingly expensive to remove and replace in order to repair plumbing, electrical or other such utilities that might be found in the ceiling structure.

Drop ceilings have the advantage of providing accessibility to the space thereabove but are very limited from an aesthetic standpoint and further, access to the space above the drop ceiling is only available through relatively small openings provided in the supporting grid work of the system.

It is to overcome the shortcomings in prior art ceiling systems that the present invention has been developed.

SUMMARY OF THE INVENTION

The cladding system of the present invention consists of a panel or panels that are sectional so as to provide a variety of aesthetics. The sections in the panels may be joined along articulated lines of joinder so that an entire panel comprised of a plurality of sections can be expanded or retracted to either cover or selectively expose a wall or an overlying ceiling structure. The sections in a panel may be cellular and may thereby form a honeycomb-type panel and the materials from which the panels are made may vary between being rigid, flexible, hard, soft, flat, reflective and the like. It will, therefore, be appreciated that various aesthetics can be obtained by varying the structure of the sections or through the materials from which the panels are made.

The panels can be supported with side rails extending along each side of the panel while not requiring crossrails so that when a panel is used in a ceiling system and retracted from its expanded condition beneath a ceiling structure, generous access is provided to the ceiling structure for repair or other work on utilities such as plumbing, electrical and the like that are found embedded in ceiling structures. Intermediate rails, parallel to the side rails, can also be provided, if necessary, to support a panel along intermediate portions thereof or between adjacent panels. The supporting rails for the panels can take on numerous configurations so as to support the panels in varied ways depending to some degree upon the particular panel construction being utilized.

Other aspects, features and details of the present invention can be more completely understood by reference to the following detailed description of preferred embodiments, taken in conjunction with the drawings.

BRIEF DESCRIPTION OF THE DRAWINGS

FIG. 30 is a fragmentary transverse section taken through the ceiling panel shown in FIG. 29.

FIG. 31 is an isometric showing the ceiling panel of FIG. 29 from the convex side thereof.

FIG. 32 is an isometric similar to FIG. 31 showing the ceiling panel of FIG. 29 from the concave side thereof.

FIG. 33 is a fragmentary transverse section similar to FIG. 30 wherein the panel has been drawn taut.

FIG. 113 is an enlarged fragmentary section showing a side edge of the pleated panel shown in FIG. 112 being supported on a side support rail.

FIG. 114 is a fragmentary isometric showing the panel illustrated in FIG. 113 supported on the side rail with the panel in a folded or collapsed position.

FIG. 115 is a fragmentary isometric similar to FIG. 114 with the panel in an expanded position.

FIG. 116 is a fragmentary section similar to FIG. 113 showing a different arrangement of a supporting side rail with a pleated ceiling panel.

FIG. 117 is a fragmentary isometric showing the panel of FIG. 116 in a folded or collapsed position.

FIG. 118 is a fragmentary isometric similar to FIG. 117 with the panel in an expanded position.

FIG. 119A is an isometric of an alternative arrangement of the pleated panel embodiment wherein the panel is supported by flexible longitudinal cords.

FIG. 119B is an enlarged section showing the interconnection of an elongated cord to a sheet of a pleated panel.

FIG. 120 is an isometric of another alternative arrangement of the pleated panel embodiment of the present invention.

FIG. 121A is a side elevation of still a further arrangement of the pleated panel embodiment of the present invention.

FIG. 121B is an isometric of the panel shown in FIG. 121A.

FIG. 122 is an enlarged fragmentary section showing the interconnection between upper and lower sheets of the panel of FIG. 121A.

FIG. 123 is an exploded fragmentary isometric showing the panel of FIG. 121A with an inverted T-shaped support therefor.

Figure 124:
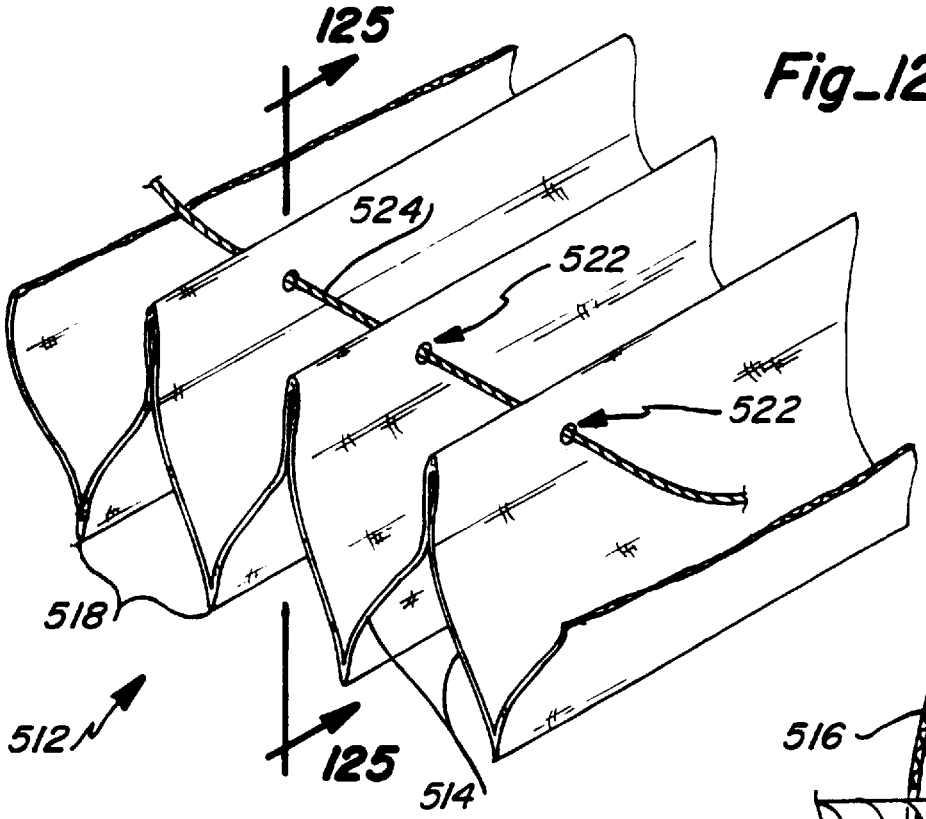

FIG. 124 is a fragmentary isometric illustrating a sharp edged and curved wall pleated panel.

Figure 125:
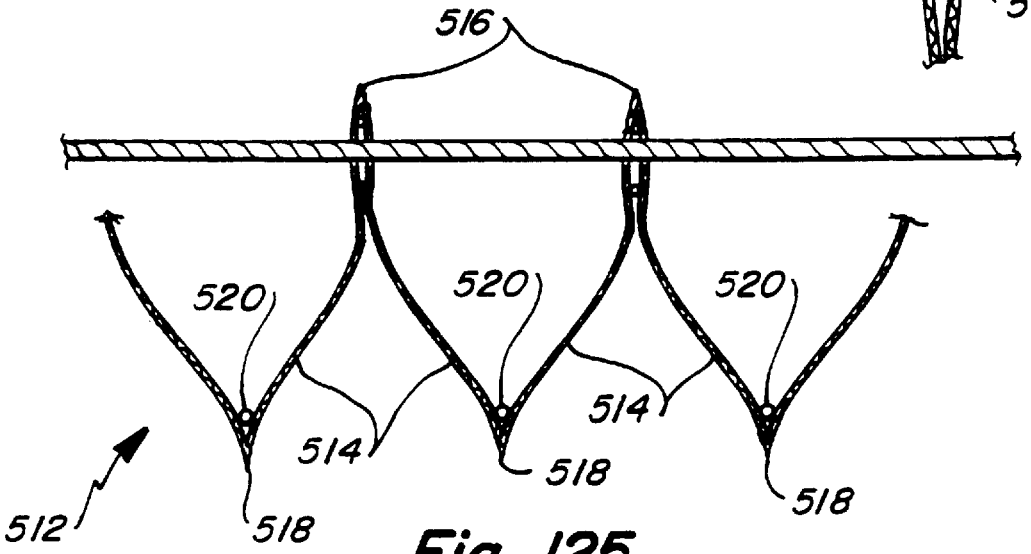

FIG. 125 is a fragmentary vertical section taken along line 125—125 of FIG. 124.

Figure 126:
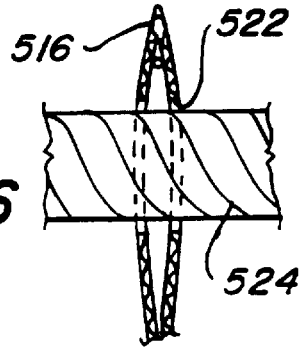

FIG. 126 is an enlarged fragmentary section taken through a single upwardly directed pleat of the panel shown in FIG. 124 showing a support cord extending therethrough.

Figure 127:
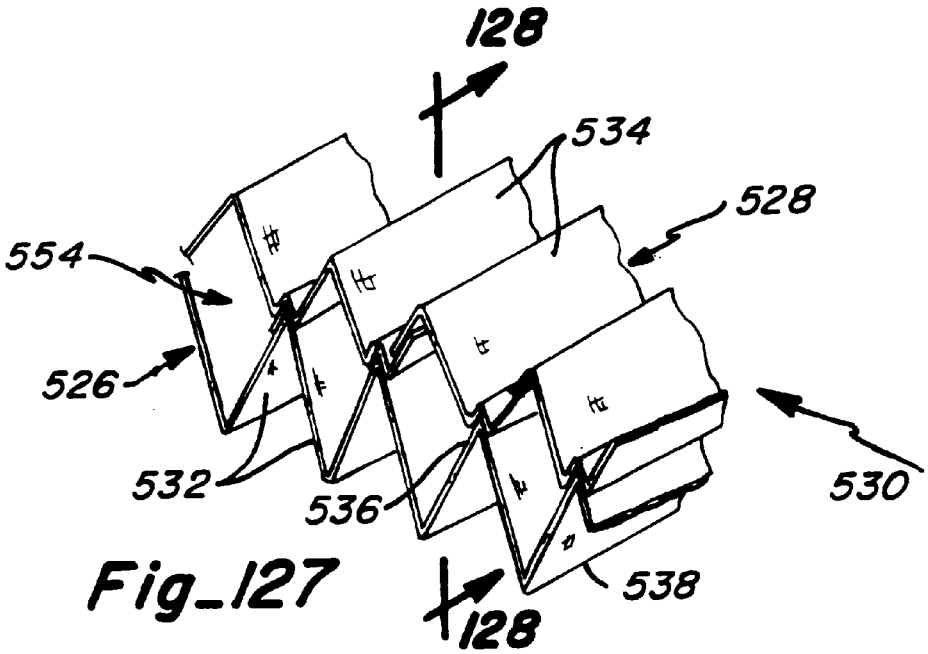

FIG. 127 is a fragmentary isometric of a flat cell-lap jointed cellular panel.

Figure 128:
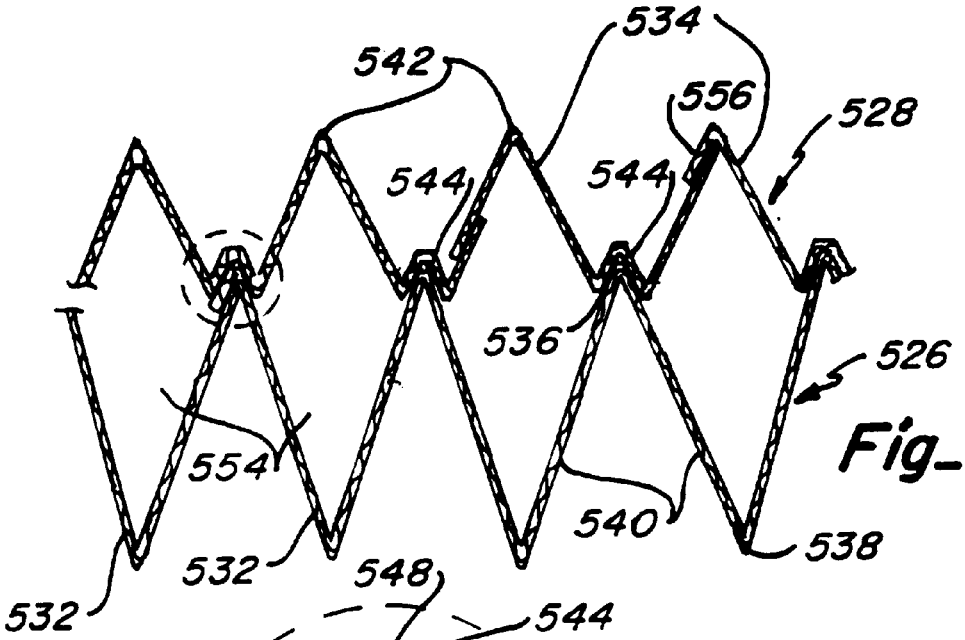

FIG. 128 is an enlarged vertical section taken along line 128—128 of FIG. 127.

Figure 129:
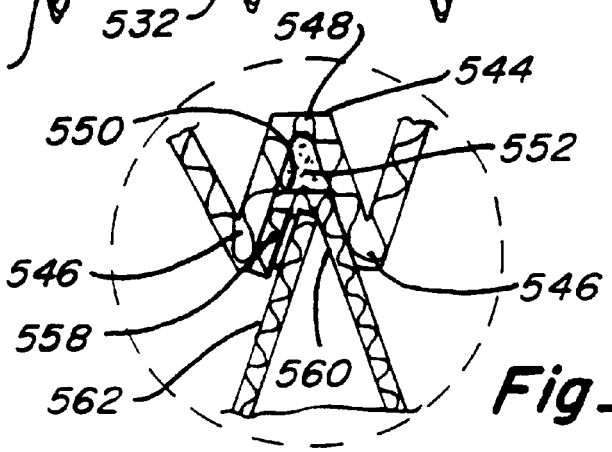

FIG. 129 is an enlargement of the area shown in dashed lines in FIG. 128.

Figure 130:
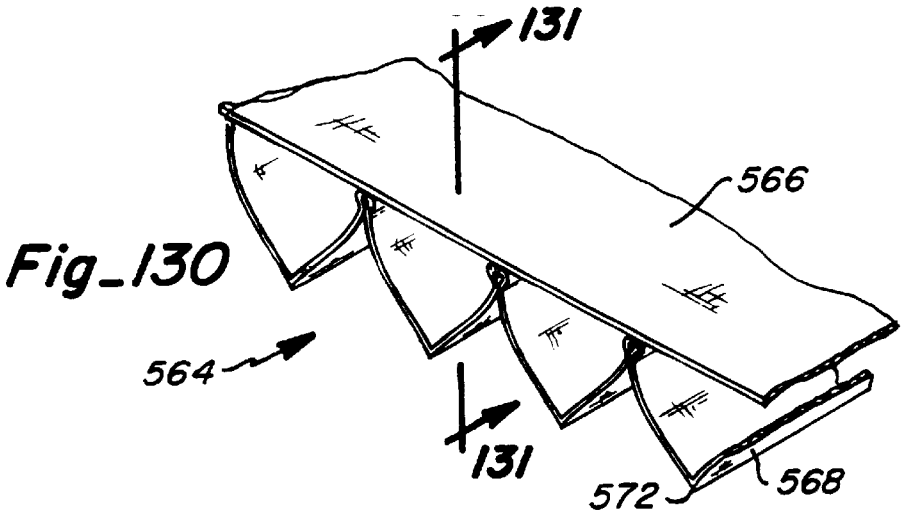

FIG. 130 is a fragmentary isometric of a first embodiment of a flat back cellular panel.

Figure 131:
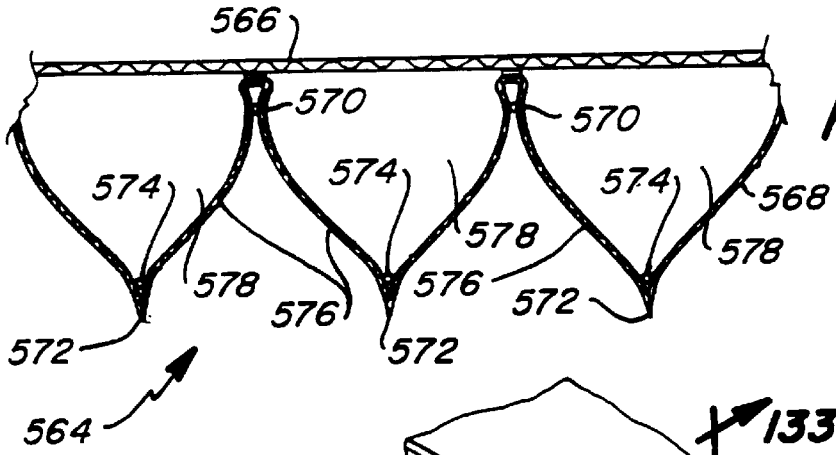

FIG. 131 is a enlarged section taken along line 131—131 of FIG. 130.

Figure 132:
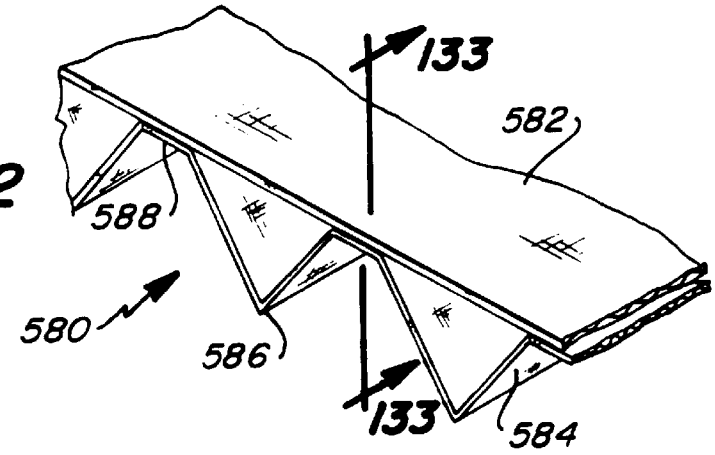

FIG. 132 is a fragmentary isometric of a second embodiment of a flat back panel.

Figure 133:
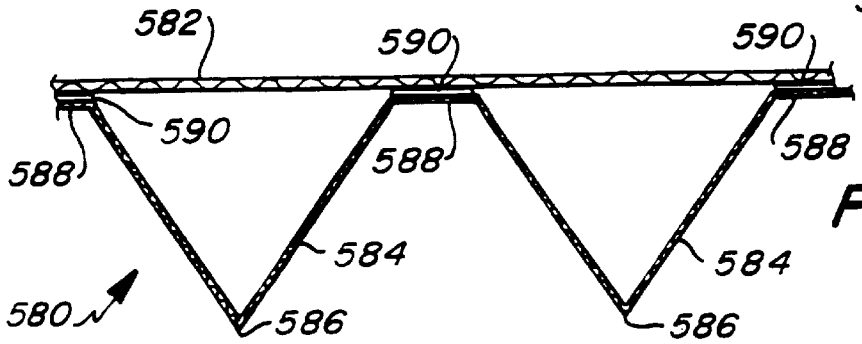

FIG. 133 is an enlarged vertical section taken along line 133—133 of FIG. 132.

Figure 134:
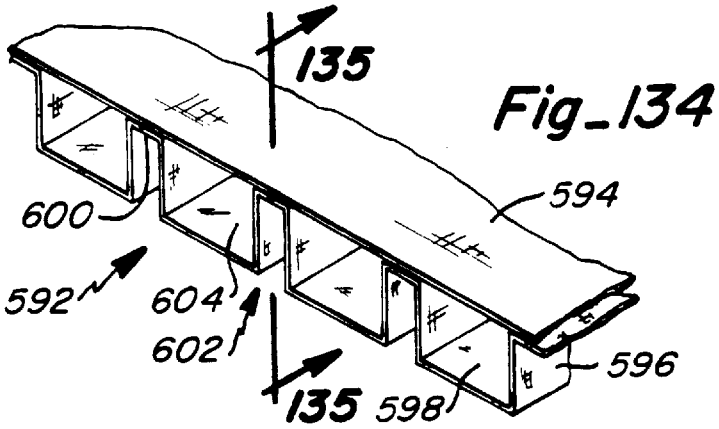

FIG. 134 is a fragmentary isometric of a third embodiment of a flat back cellular panel.

Figure 135:
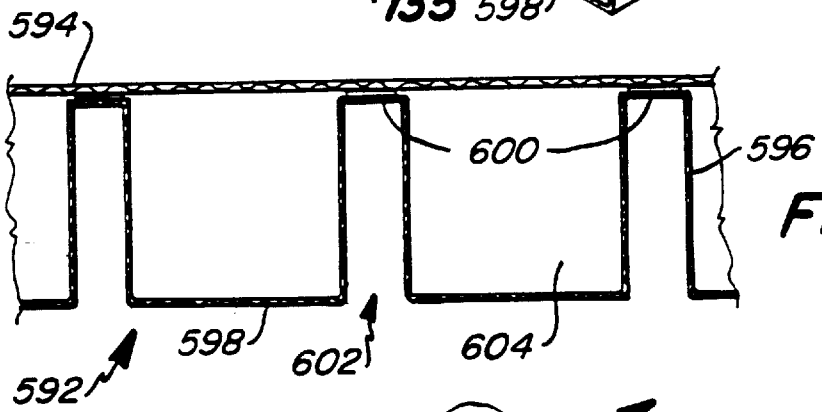

FIG. 135 is a vertical section taken along line 135—135 of FIG. 134.

Figure 136:
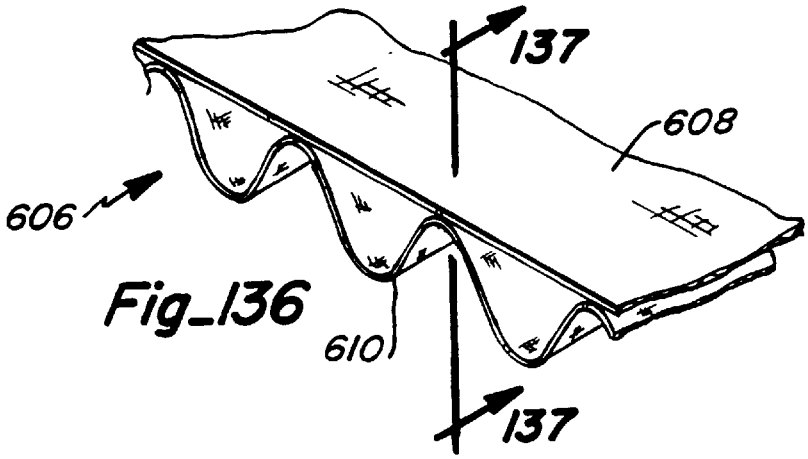

FIG. 136 is a fragmentary isometric of a fourth embodiment of a flat back cellular panel.

Figure 137:
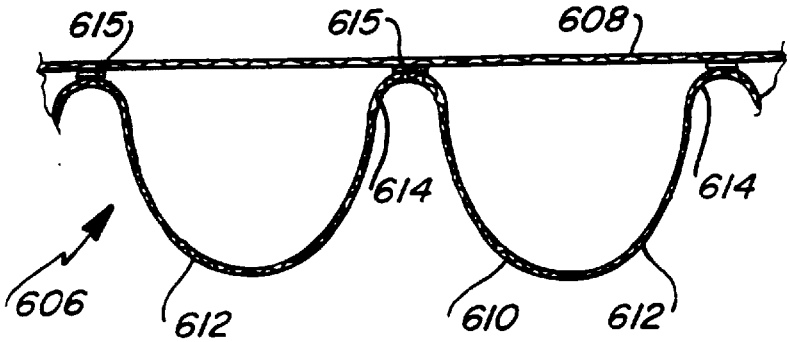

FIG. 137 is an enlarged vertical section taken along line 137—137 of FIG. 136.

Figure 138:
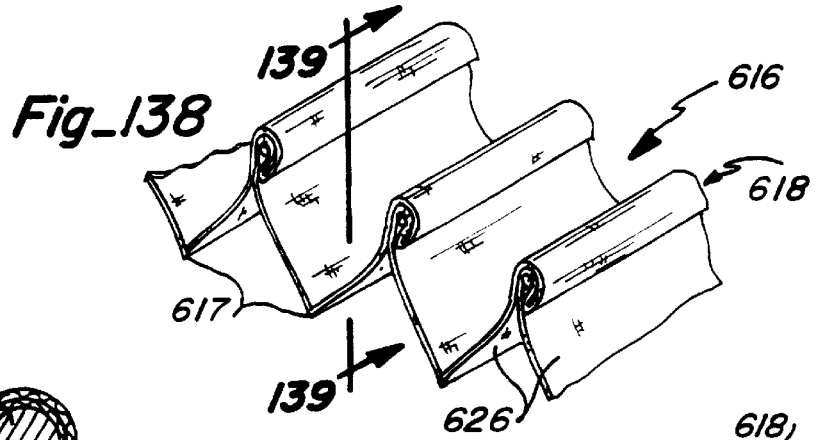

FIG. 138 is a fragmentary isometric of a first embodiment of a supported single sheet panel.

Figure 139:
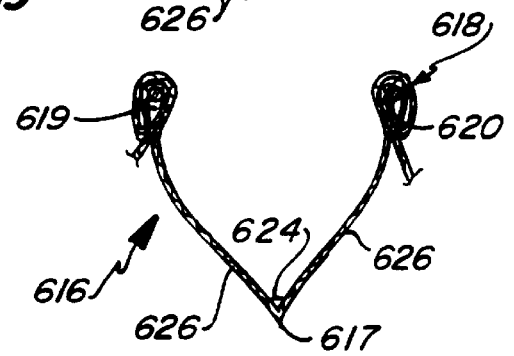

FIG. 139 is a fragmentary section taken along line 139—139 of FIG. 138.

Figure 140:
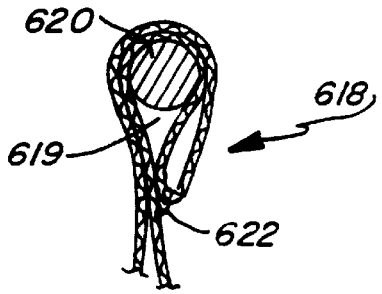

FIG. 140 is a further enlarged fragmentary section illustrating the area shown in dashed lines in FIG. 139.

Figure 141:
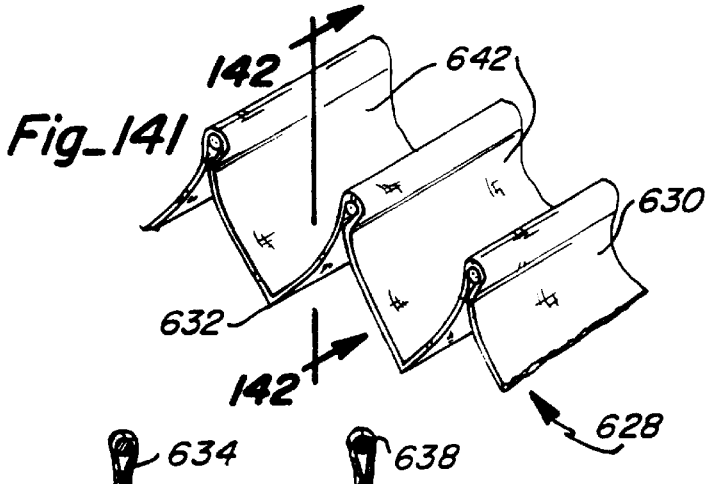

FIG. 141 is a fragmentary isometric of a second embodiment of a supported single sheet panel.

Figure 142:
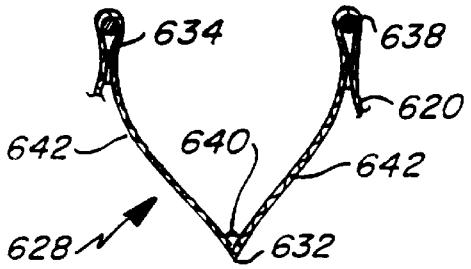

FIG. 142 is an enlarged section taken along line 142—142 of FIG. 141.

Figure 143:
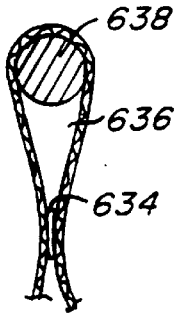

FIG. 143 is an enlarged section illustrating the area shown in dashed lines in FIG. 142.

Figure 144:
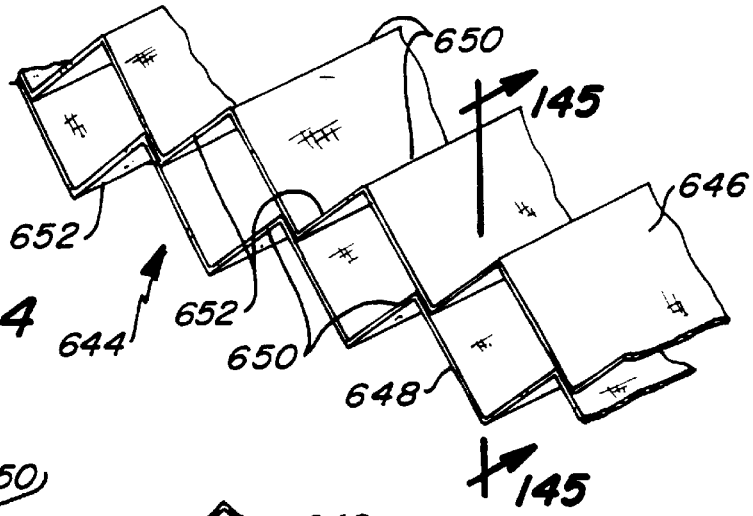

FIG. 144 is a fragmentary isometric of a double sheet-double pleat cellular panel.

Figure 145:
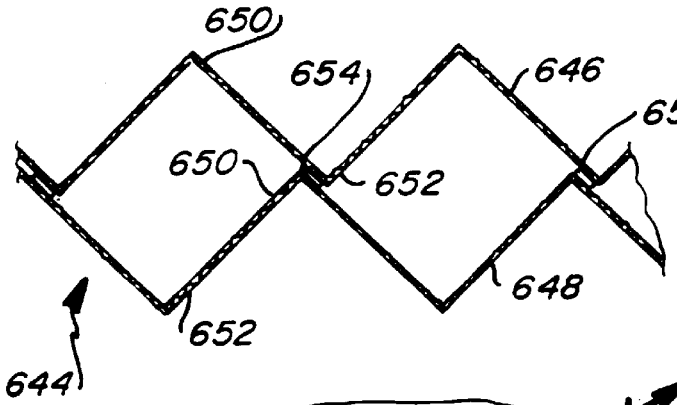

FIG. 145 is an enlarged section taken along line 145—145 of FIG. 144.

Figure 146:
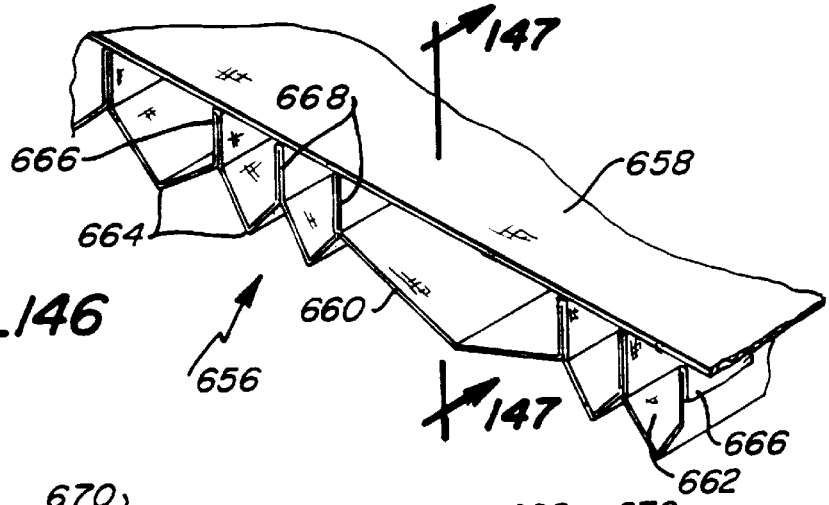

FIG. 146 is a fragmentary isometric of a variable cell size panel.

Figure 147:
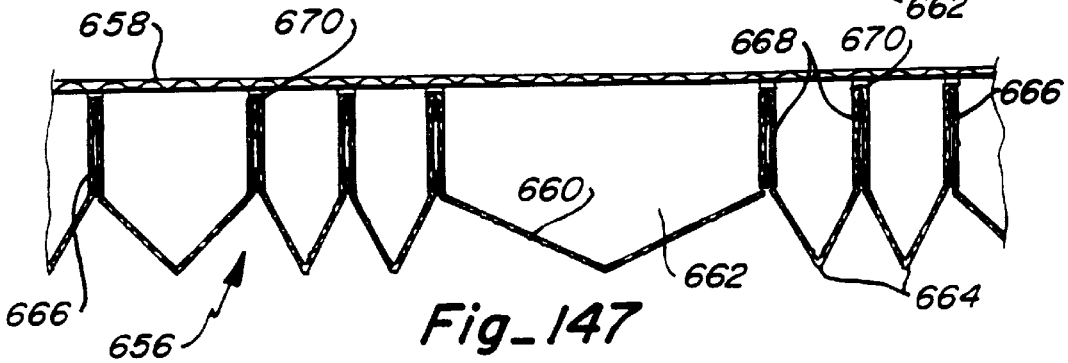

FIG. 147 is an enlarged vertical section taken along line 147—147 of FIG. 146.

Figure 148:
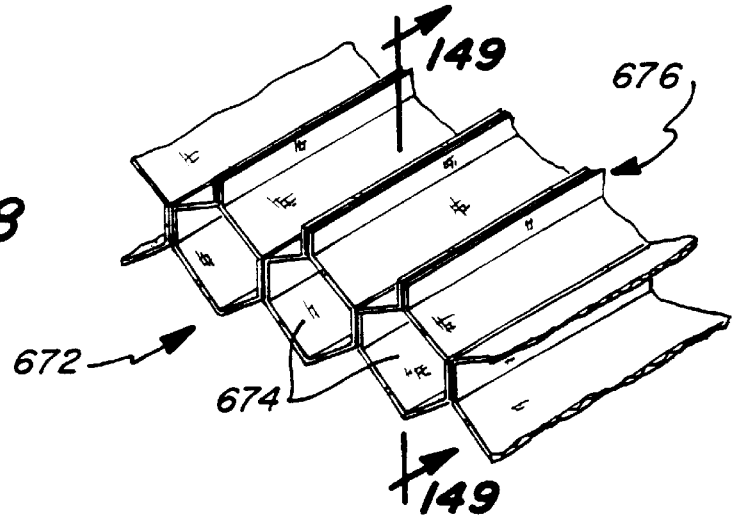

FIG. 148 is a fragmentary isometric of a tabbed cellular panel.

Figure 149:
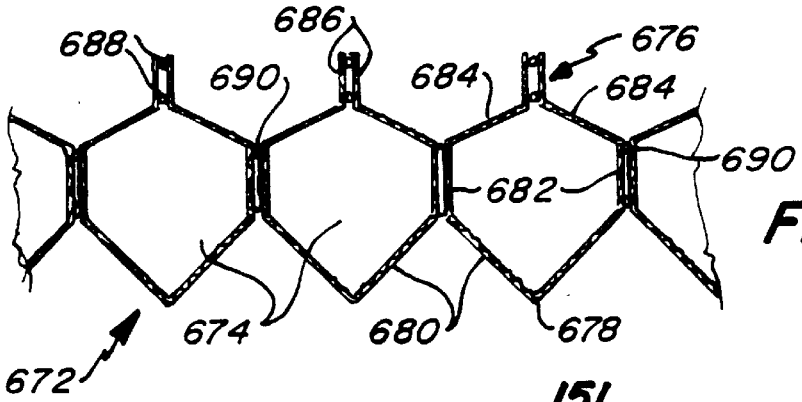

FIG. 149 is an enlarged vertical section taken along line 149—149 of FIG. 148.

Figure 150:
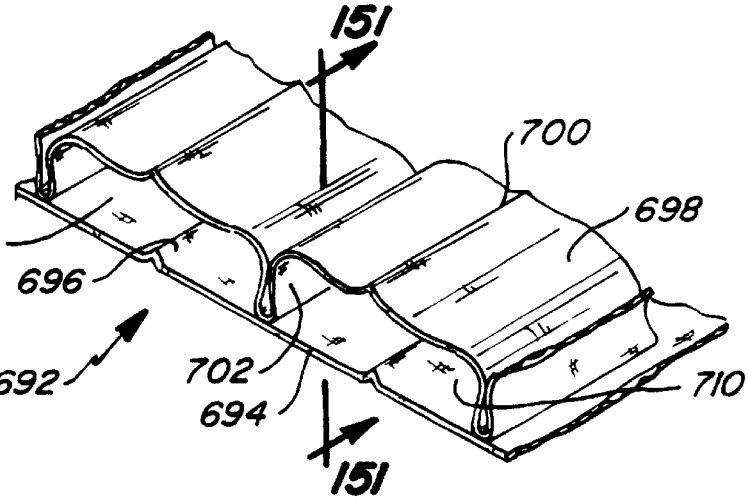

FIG. 150 is a fragmentary isometric of a double sheeted-double pleated cellular panel.

Figure 151:
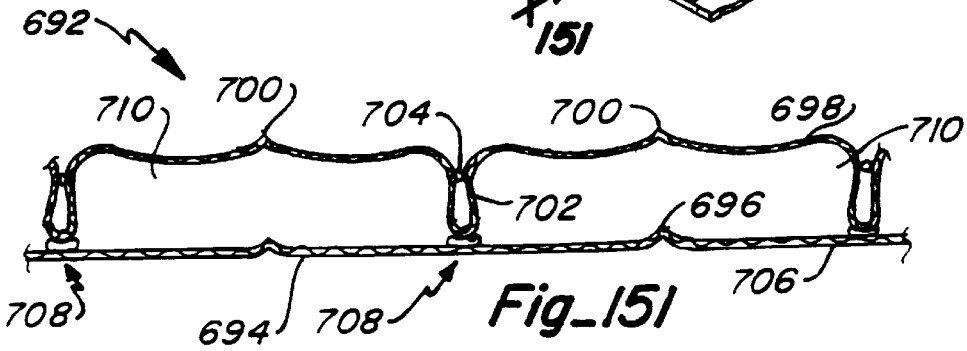

FIG. 151 is an enlarged vertical section taken along line 151—151 of FIG. 150.

Figure 152:
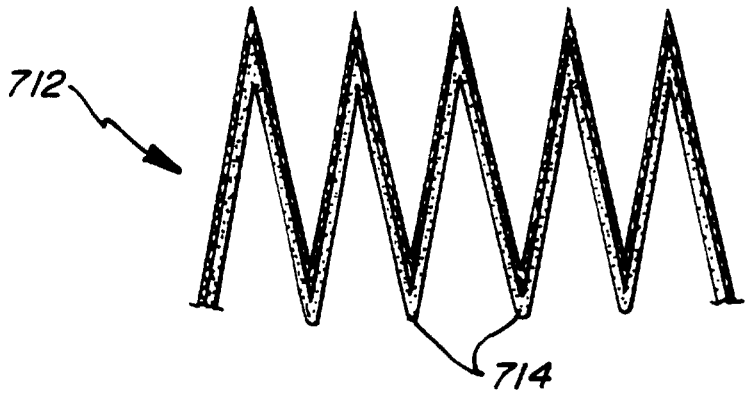

FIG. 152 is a vertical section taken through a folded pleated panel made of a laminated material having a curable surface.

Figure 153:
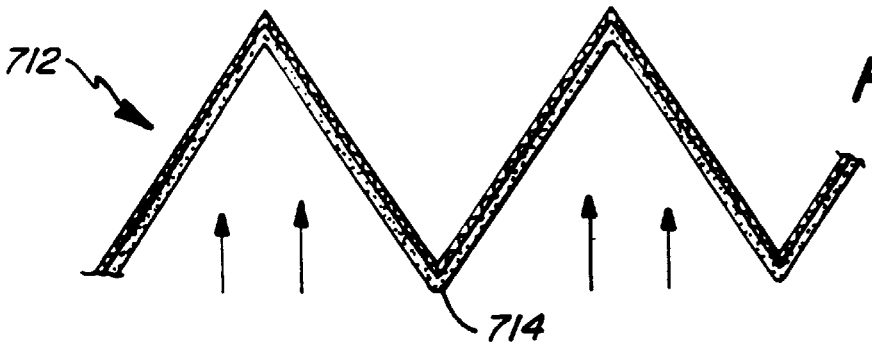

FIG. 153 is a section similar to FIG. 152 with the panel having been expanded and being shown exposed to a curing agent.

Figure 154:
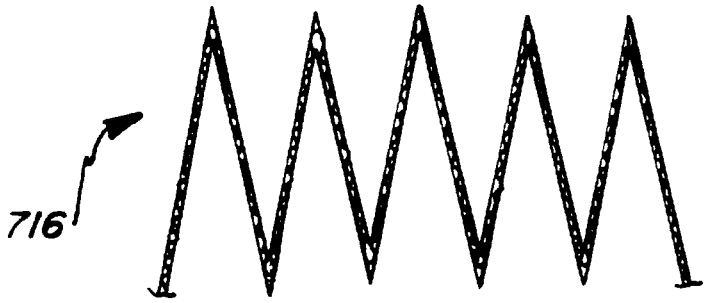

FIG. 154 is a vertical section taken through a folded pleated panel formed from a material that cures upon expansion.

Figure 155:
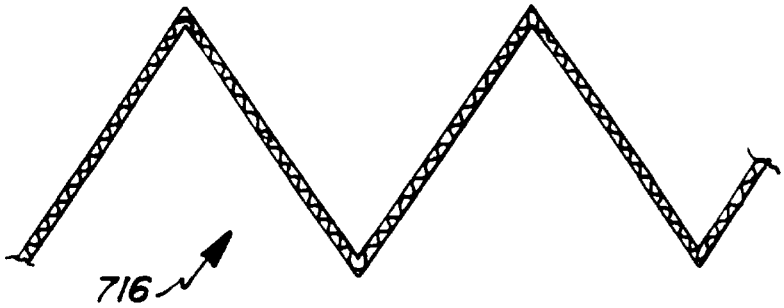

FIG. 155 is a vertical section similar to FIG. 154 with the panel shown in an expanded condition and having been cured.

DESCRIPTION OF THE PREFERRED EMBODIMENT

A ceiling system embodiment of the cladding system of the present invention includes an elongated panel of articulated and/or otherwise interconnected sections which may be cells that can be expanded to cover an overlying ceiling structure and in certain embodiments can be retracted with the sections horizontally stacked adjacent a side or sides of the room in which the panel is mounted. When retracted or collapsed adjacent a side or sides of the room, the overlying ceiling structure is exposed so that electrical, plumbing or other such utilities can be accessed without interference from the ceiling panel. As will be appreciated with the detailed description that follows, the ceiling panel may be slidably supported on support rails in the system for easy movement of the panel between the expanded position wherein it covers the ceiling structure and the retracted position adjacent a side or sides of the room in which the system is mounted.

Honeycomb Panel

In a first embodiment 20 of the expandable and collapsible ceiling panel 22 as shown in FIGS. 1 through 28, the panel 22 is made from at least one sheet of material that is semirigid at least in a cross direction and comprised of a plurality of interconnected tubular cells 24 which in combination form a collapsible honeycomb type panel 22. The cells 24 in the disclosed form are of hexagonal cross-sectional configuration and may, by way of example, be eight feet in length so as to define a panel of that width. Wider or narrower panels are also possible depending partially upon the equipment available for fabricating the panels, applicable building codes and desired aesthetics.

The panels 22 can be fabricated in accordance with the process described in U.S. Pat. No. 4,450,027 issued to Colson on May 22, 1984, which is of common ownership with the subject application. The panels can be made of various suitable materials such as paper, polyvinylchloride (PVC), aluminum foil, textiles or various laminated combinations of those materials. The selected material or combinations of material is to some degree dependent upon fire codes which dictate burn and smoke rate acceptability for construction materials. While PVC satisfies most building codes, it does in fact form a molten mass when burning which could drop from a ceiling in globules causing injury or other harm to those in the building structure in which the panel is installed. As will be mentioned later, the PVC can be laminated to a supporting material such as aluminum foil, to which it will cling when in a hot molten state thereby preventing its deposit into the area beneath the ceiling panel during a fire.

Figure 1:
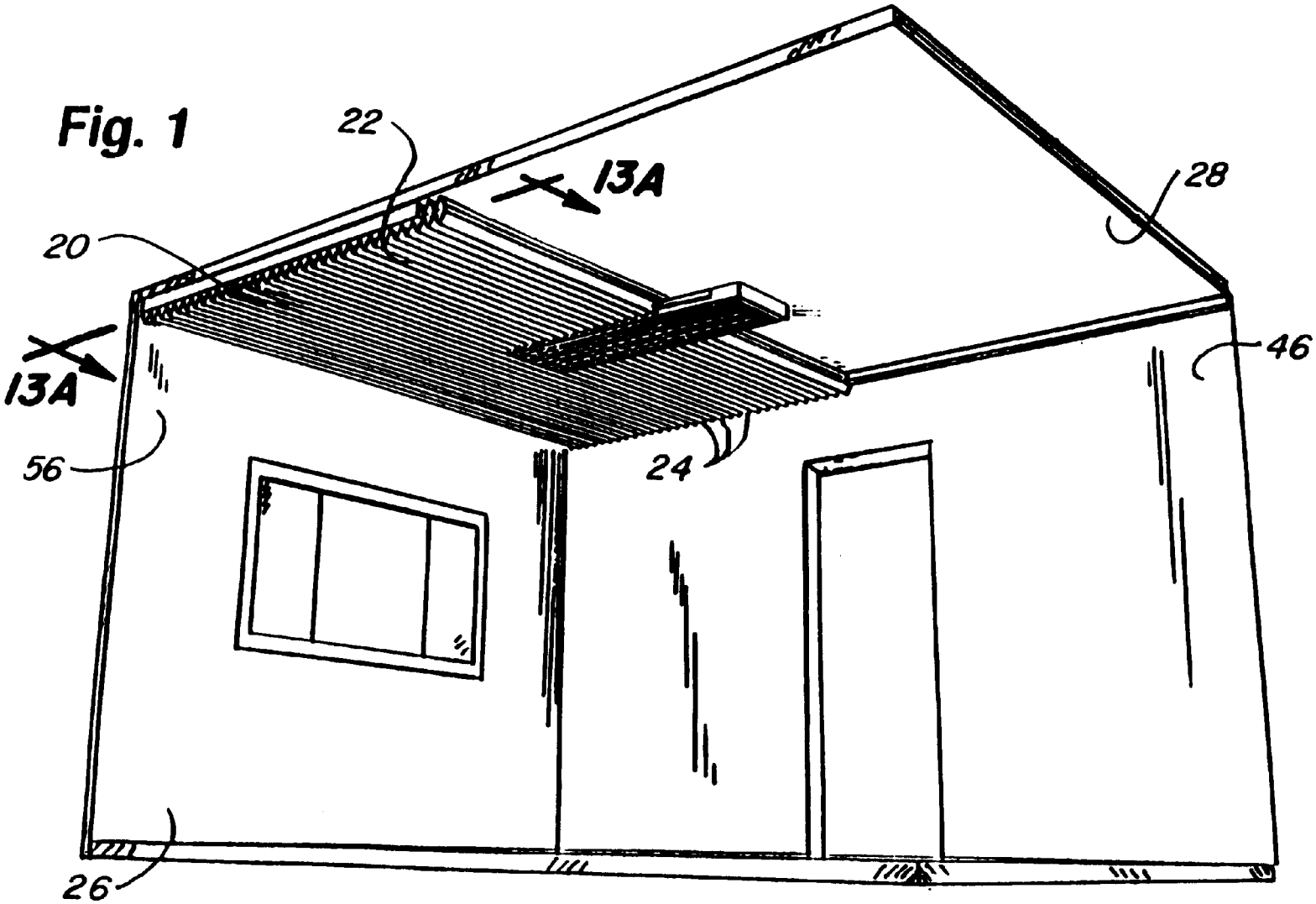
FIG. 1 is a perspective view of a building structure having a first embodiment of the present invention installed as a ceiling panel therein.
Figure 3:
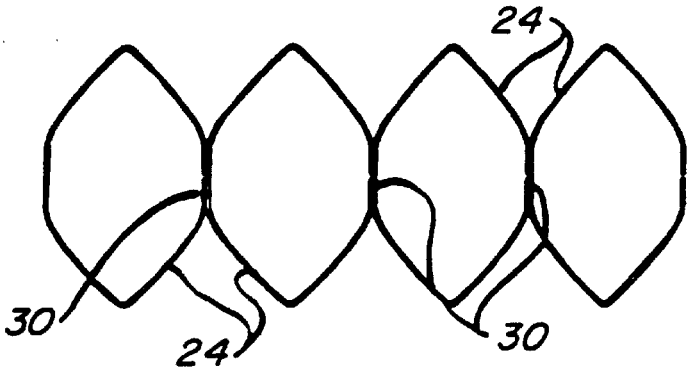
FIG. 3 is a transverse section taken through a plurality of interconnected cells of the type shown in FIG. 2.
Figure 2:
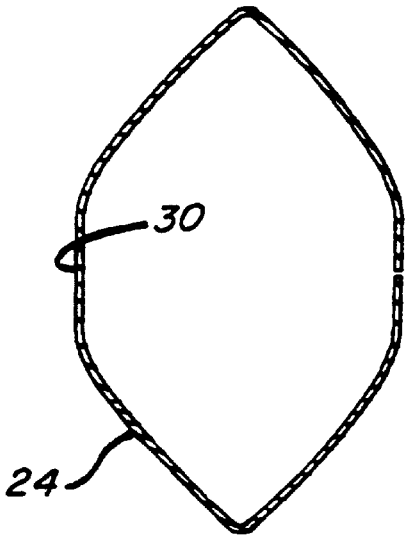
FIG. 2 is an enlarged transverse section through one cell used in the ceiling panel of FIG. 1.
Figure 4:
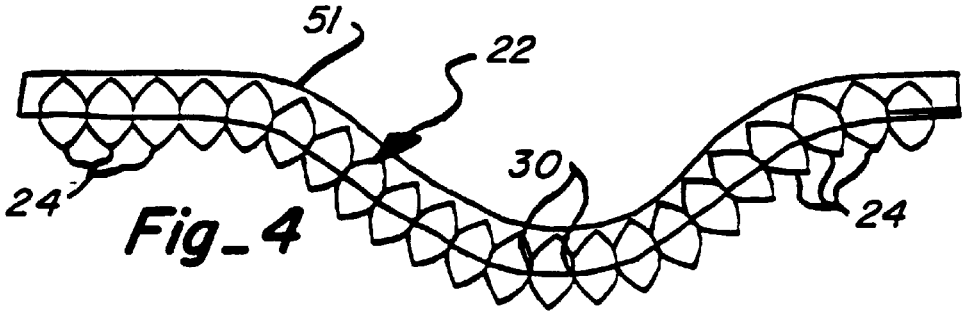
FIG. 4 is a section taken adjacent to one side edge of a ceiling panel made out of interconnected cells as shown in FIG. 3 with the panel being supported by an undulating side rail.
Figure 5:
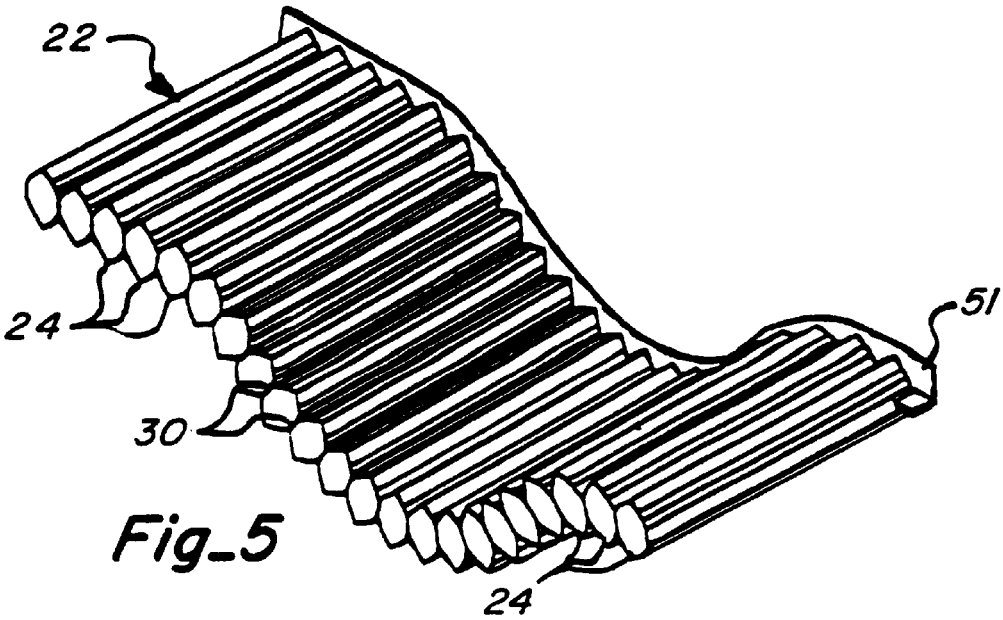
FIG. 5 is an isometric view of the ceiling panel of FIG. 4.
Figure 6:
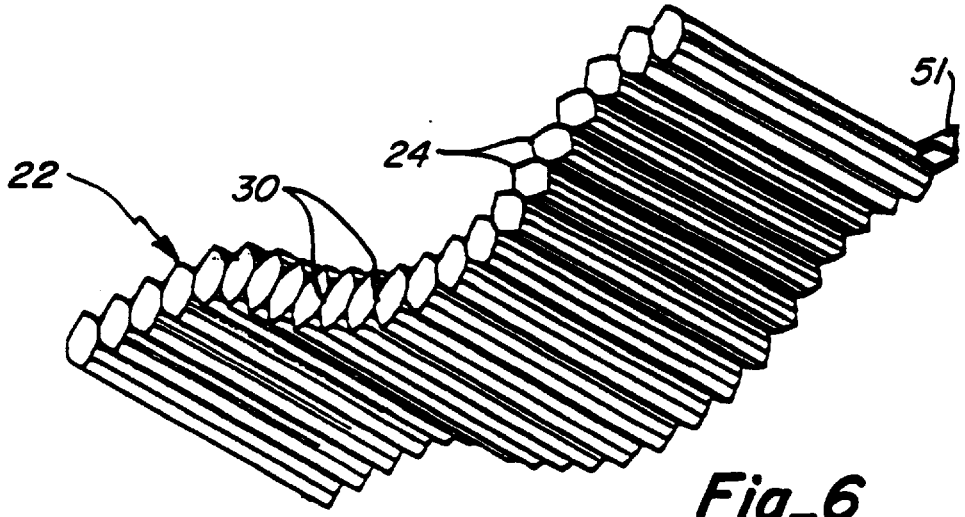
FIG. 6 is an isometric view from the underside of the panel shown in FIG. 5.

FIG. 1 illustrates a room 26 in a building structure, looking upwardly at the ceiling 28 from within the room 26 which has a corrugated honeycomb panel 22 in accordance with the teachings of the present invention. FIGS. 2 and 3 illustrate an individual cell 24 and a plurality of interconnected cells respectively, in accordance with the invention wherein the cells are made of a single ply or layer of material. In the assembled panel, the cells 24 are bonded or otherwise interconnected along a side wall 30 to adjacent cells thereby forming an articulated joint between each cell 24 so that the entire panel 22 can be flexed as illustrated in FIGS. 4–6.

The cells may be offset as illustrated in U.S. Pat. No. 4,677,013, which is of common ownership with the present application, to provide uniform spacing of the cells when the panel is expanded.

Figure 8:
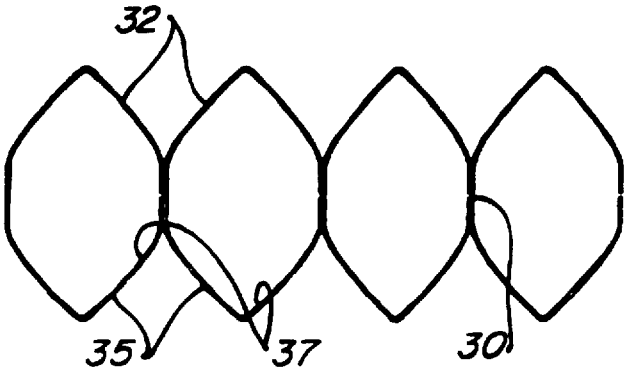
FIG. 8 is a transverse section taken through a plurality of interconnected panels of type shown in FIG. 7.
Figure 7:
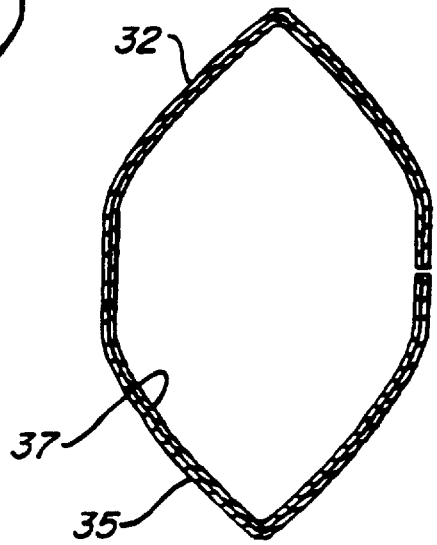
FIG. 7 is a transverse section taken through a cell used in a second arrangement of a cellular ceiling panel in accordance with the present invention.

FIGS. 7 and 8 illustrate an individual cell 32 and a plurality of interconnected articulated cells 32 respectively wherein the cells 32 are made of a laminated material. The lamination might be done for purposes of fire safety or possibly even aesthetics when, for example, it is desired to obtain a certain look with a material that would not be structurally suitable in and of itself for forming a cell. By way of example, when considering aesthetics, a soft cotton fabric material 35 might give the desired appearance for the ceiling but might not have the desired structural rigidity for the honeycomb panel and accordingly, the soft cotton fabric 35 might be laminated to the outer face of a paper or PVC sheet 37. For safety reasons, however, as mentioned previously, when using PVC, it is preferably bonded, either on the interior or exterior, to a support material, such as aluminum foil, due to the fact that the aluminum foil will retain its integrity in fires and the melting and molten PVC will cling or bond to the support material so that it does not drop into the space beneath the ceiling.

Figure 9:
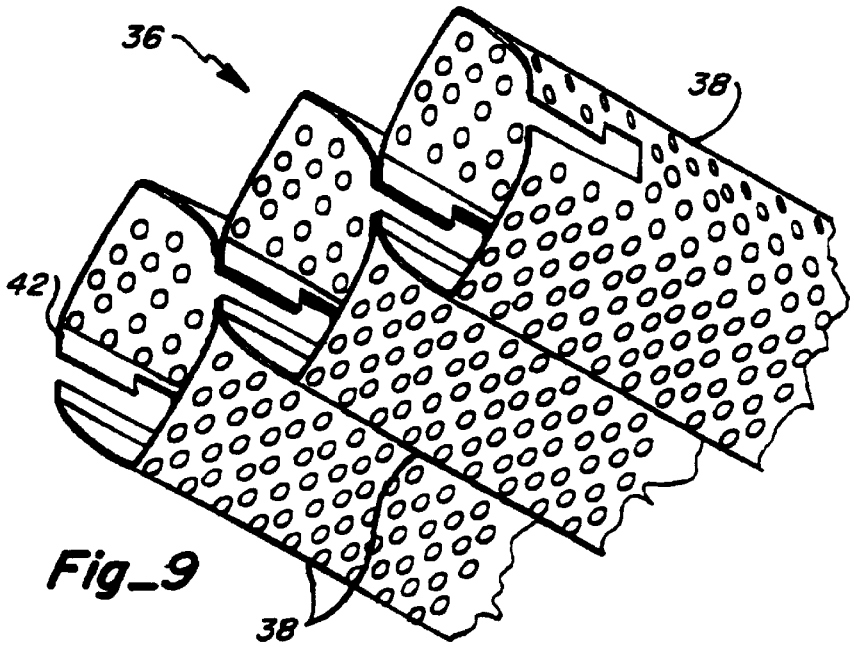
FIG. 9 is a fragmentary isometric of the end of a cellular ceiling panel wherein the cells have been perforated and slotted at the end to receive a support rail.
Figure 10:
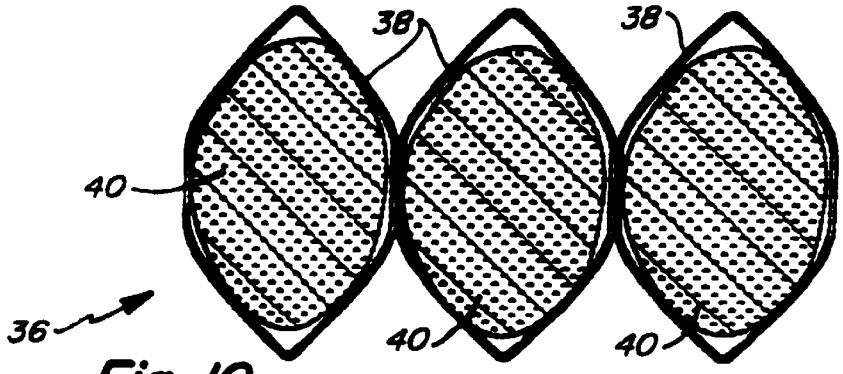
FIG. 10 is a transverse section taken through a plurality of interconnected cells of a cellular ceiling panel in accordance with the present invention wherein the cells have an insulating or sound absorptive material therein.
Figure 11:
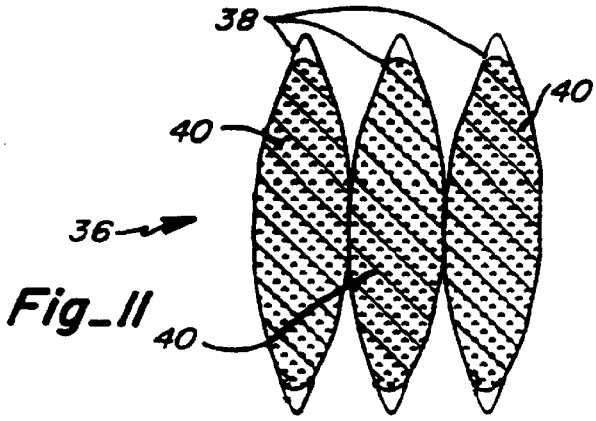
FIG. 11 is a transverse section similar to FIG. 10 wherein the cells have been collapsed, thereby compressing the insulative or sound absorptive material therein.

In an alternative arrangement of the ceiling panel 36 as shown in FIG. 9, the cells 38 could be perforated which would increase the sound absorptive qualities of the panel. In addition, as shown in FIGS. 10 and 11, the cells 38 could include with or without the perforated walls, a core of insulating material 40 such as textiles, foam, cotton or the like to improve sound deadening and/or insulating qualities of the panel 36. As can be appreciated in FIGS. 10 and 11, the cells, whether or not perforated or including a core of insulating material, are shorter in the expanded position than in the retracted position.

Since the panel 36 is flexible due to the articulated connection of the individual cells 38, it must be supported along its length along the lateral sides 42 of the panel and possibly at locations along its width depending upon the overall width of the panel and the structural rigidity of the material used to make it. Numerous systems have been devised for supporting the panel, some of which will be described hereafter. The importance of the support system resides in providing support that will retain the panel during installation, operation and inadvertent contact. In some instances it is also desirable that the support system be hidden from view for aesthetic reasons.

Figure 12:
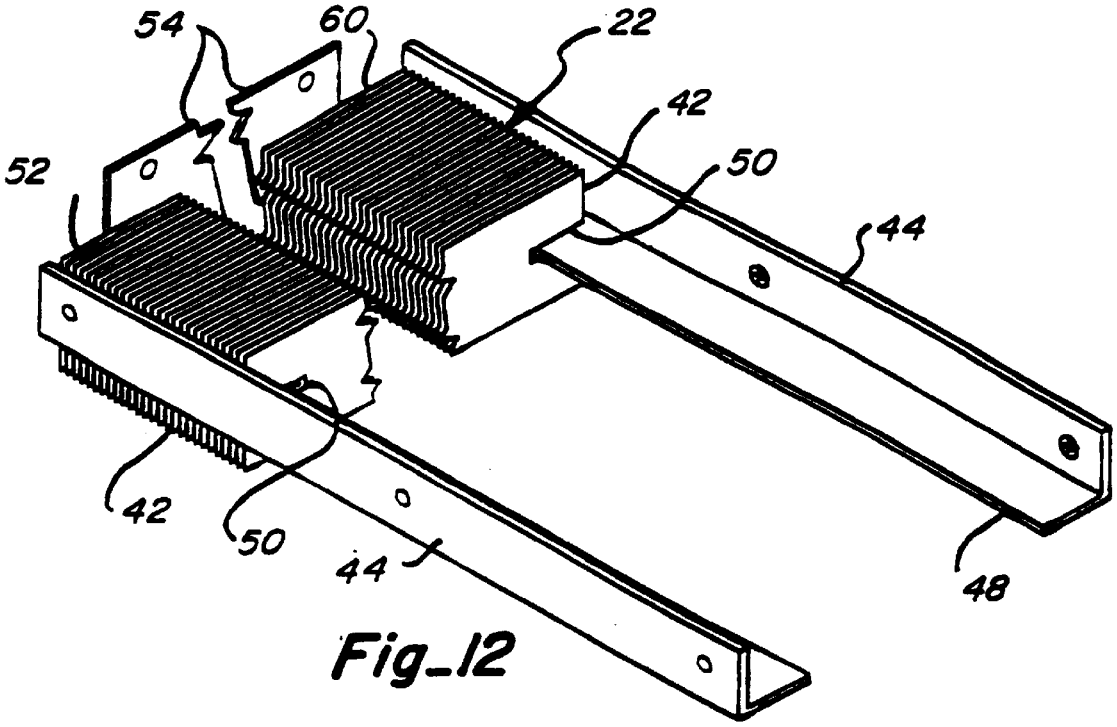
FIG. 12 is an isometric of a ceiling panel of the type shown in FIG. 1, showing the sides of the panel supported on side rails.

One system for supporting the panel 22 along its lateral sides 42 is illustrated in FIG. 12 wherein elongated side support bars 44 or rails of L-shaped cross-section are secured along their length to the side walls of the room in which the ceiling panel 22 is to be installed. The side support bars 44 define a horizontal shoulder 48 which protrudes horizontally and towards the opposite side wall at a spaced location beneath the ceiling structure 28 of the room 26. Slots 50 substantially corresponding in size to the shoulder 48 are provided in each side edge 42 of the ceiling panel 22 (FIG. 29) with the slots 42 slidably receiving the shoulder 48 of each side support rail 44. As can be appreciated by reference to FIGS. 4–6, a support rail 51 can be made to undulate along its length to support the panel 22 in a conforming wavy pattern.

Figure 13A:
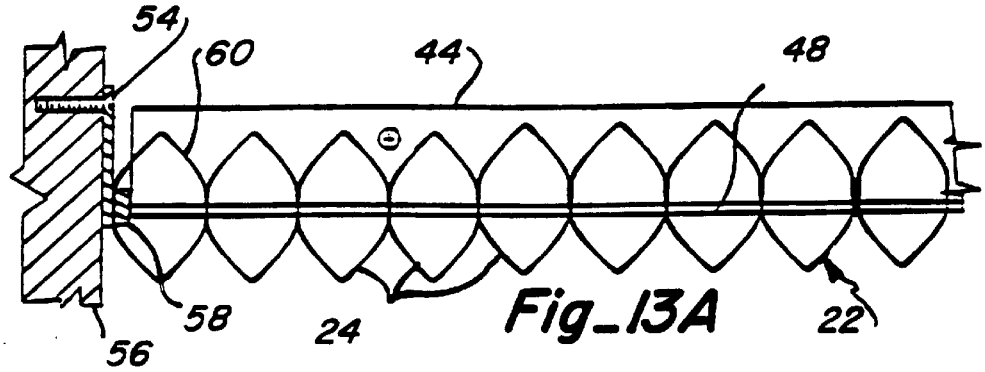
FIG. 13A is a longitudinal section taken adjacent to a side rail showing a magnetic system for securing the ceiling panel to an end rail.
Figure 13B:
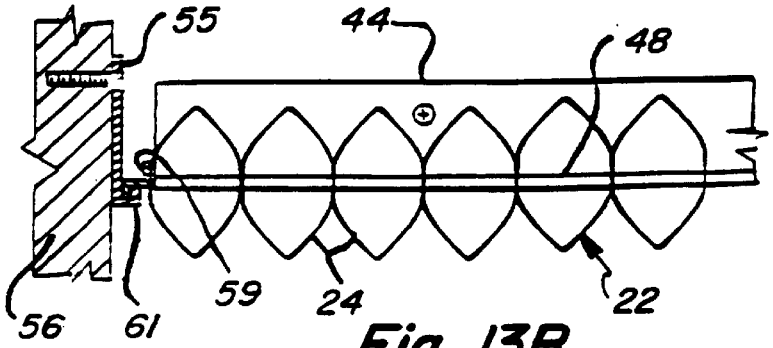
FIG. 13B is a longitudinal section similar to FIG. 13A showing a mechanical system for interconnecting the ceiling panel to an end rail.

The ends 52 of the ceiling panel can be releasably attached to end rails 54 which are secured to an end wall 56 of the room 26 as illustrated in FIGS. 13A and 13B. It is preferable that the ends 52 of the panel 22 be connected to the end rails 54 with a releasable connector. By way of example, a magnet 58, as seen in FIG. 13A, can be carried inside the endmost cell 60 of the panel 22 which is attracted to an end bar 54, which would in this instance be metal, in a releasable way so that the end of the panel could be magnetically released from the end bar 54 and then slid along the side rails 44 when retracting the ceiling panel from its extended position.

Alternately, the last cell could be provided with one or more Z-hooks 59 so as to be releasably attachable to an end rail 55 with complementary J-hooks 61 on the end rail as shown in FIG. 13B.

Figure 14:
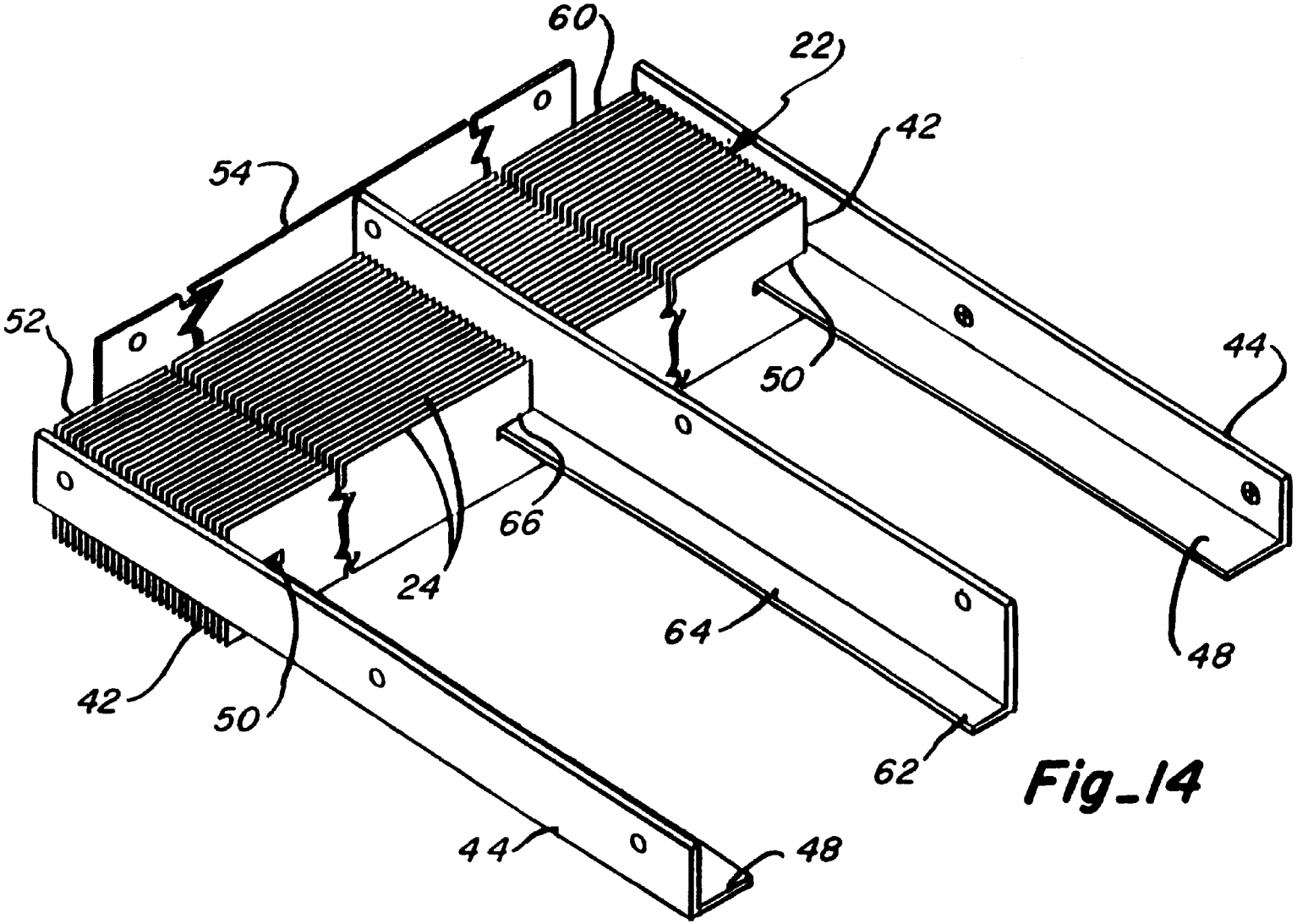
FIG. 14 is an isometric showing a ceiling panel of the type illustrated in FIG. 1, with side rails supporting side edges of the panel and a center support bar wherein the panel is in a collapsed position.
Figure 28:
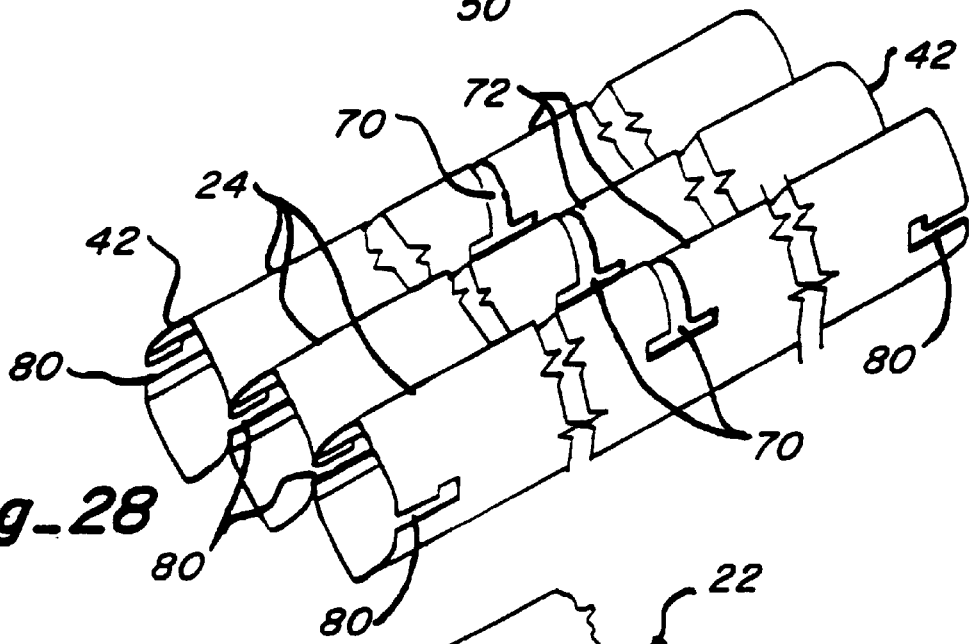
FIG. 28 is a fragmentary isometric of a panel of the type shown in FIG. 1, wherein the sides of the panel have been slotted to receive a side rail of the type shown in FIG. 17 and a center rail of inverted T-shaped configuration.

If the ceiling panel 22 is so wide that it sags along its width, a center support bar 62 or rail such as illustrated in FIG. 14 can be utilized. In the illustrated embodiment of the center support bar 62, the bar is L-shaped in cross-section having a horizontal shoulder 64 and when using such a center support 62, an L-shaped slot 66 is cut in an aligned upper edge of the ceiling panel 22, for example, along its longitudinal center 68. The center support bar 62 can be suspended from the ceiling in any suitable manner such as with well known hanger-type fasteners. While not being illustrated, the center support could have an inverted T-shaped cross-section so as to have horizontal shoulders extending in opposite directions and in the use of such a support, an inverted T-shaped slot 70 as shown in FIG. 28 would be cut in an upper edge 72 of the ceiling panel, for example, along its longitudinal center 68.

Figure 15:
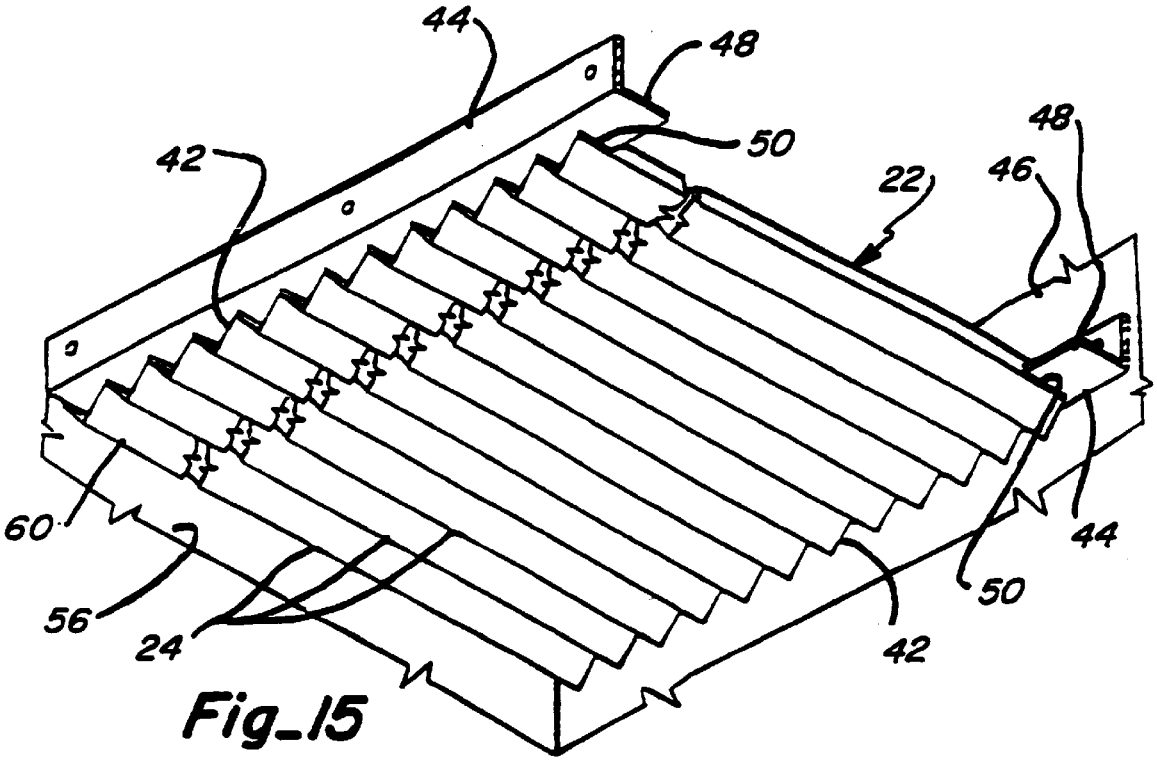
FIG. 15 is an isometric of the ceiling panel of FIG. 1, as viewed from beneath the panel.
Figure 16:
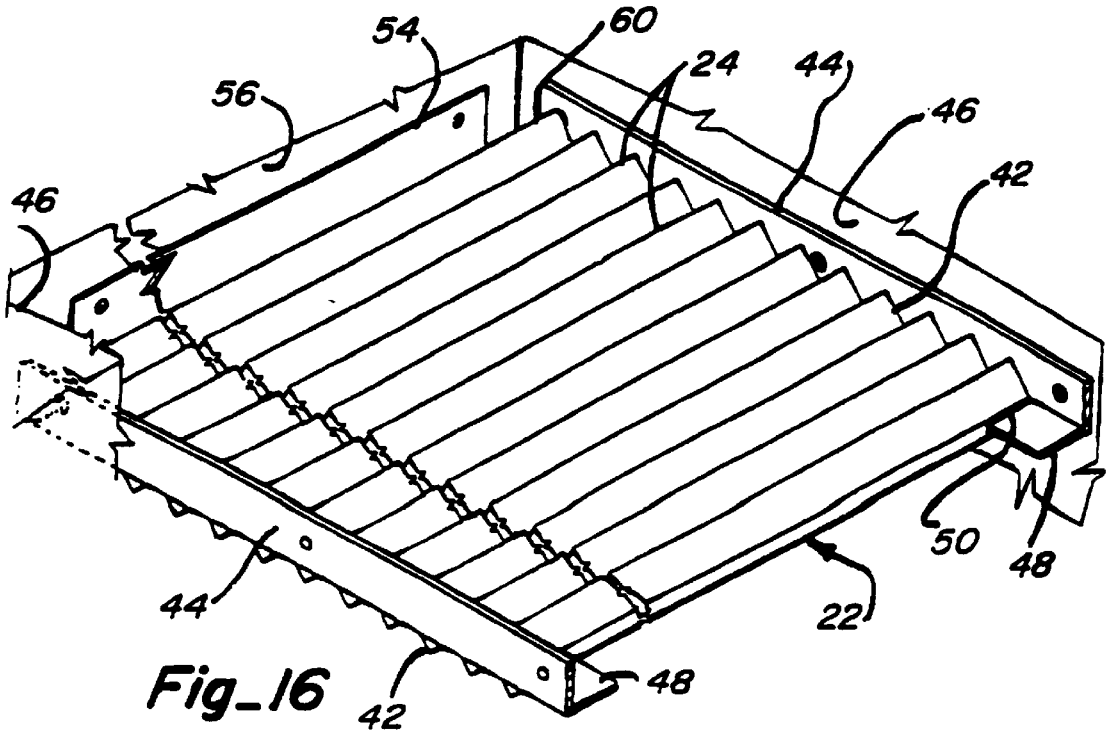
FIG. 16 is an isometric similar to FIG. 15 viewed from above the panel.

FIG. 15 illustrates a ceiling panel in accordance with the first embodiment in an expanded condition when supported by L-shaped side rails while viewing the panel from the underside. The appearance would be identical if the panel were also supported with a center rail as illustrated in FIG. 14 as the center rail or support would not be visible from the interior of the room. The same ceiling panel is shown in FIG. 16 from above the panel wherein the attachment of the side rails to the side walls of the room in which the panel is mounted as well as the attachment of the end rail to an end wall can be seen.

Figure 18:
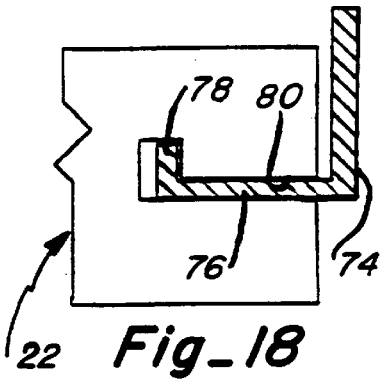
FIG. 18 is a section taken along line 18—18 of FIG. 17.
Figure 17:
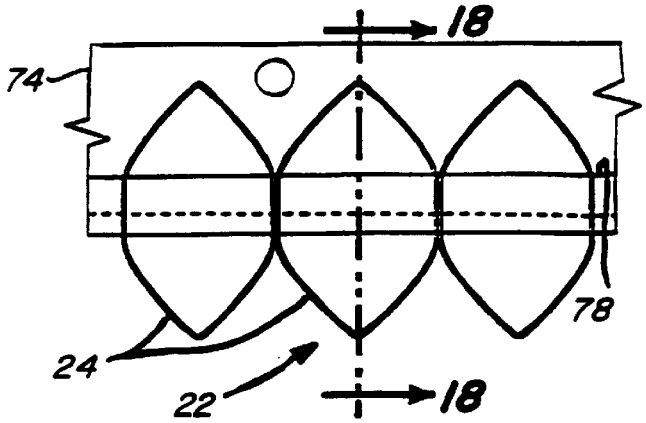
FIG. 17 is a longitudinal section taken through a ceiling panel utilizing an alternative arrangement for a side support rail.
Figure 27:
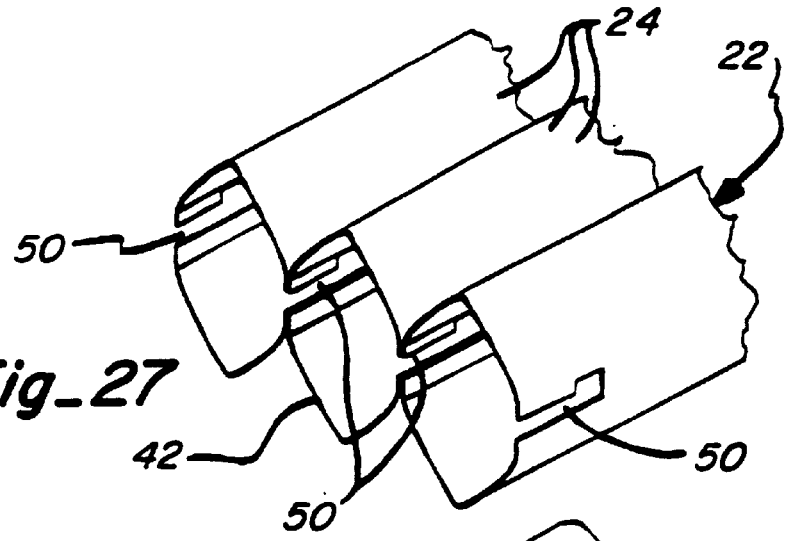
FIG. 27 is an isometric view of one end of a cellular panel of the type shown in FIG. 1, wherein the sides of the panel have been notched to receive a side rail of the type shown in FIG. 17.

FIGS. 17 through 22 illustrate other configurations of side rails for supporting the side edges 42 of a ceiling panel 22 and with reference first to FIGS. 17 and 18, the side support rail 74 therein illustrated can be seen to be substantially J-shaped in, cross-section so as to not only define a horizontal shoulder 76 but an upturned edge 78 on the shoulder 76 which better secures the ceiling panel 22 to the side support rail 74. As will be appreciated, depending to some degree upon the length of the panel, should it become skewed, it would be possible for it to be released from an L-shaped support 48 as shown, for example, in FIG. 12 but the provision of the upturned edge 78 as shown in FIGS. 17 and 18 prevents such skewing and inadvertent release of the ceiling panel 22 from the side support rails 74. Of course, to accommodate the J-shaped support rail, the notch 80 formed in the lateral sides 42 of the ceiling panel 22 resembles an L laid on its side as shown in FIG. 27.

Figure 20:
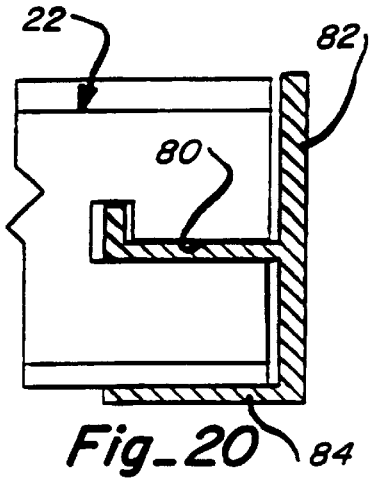
FIG. 20 is a section taken along line 20—20 of FIG. 19.
Figure 19:
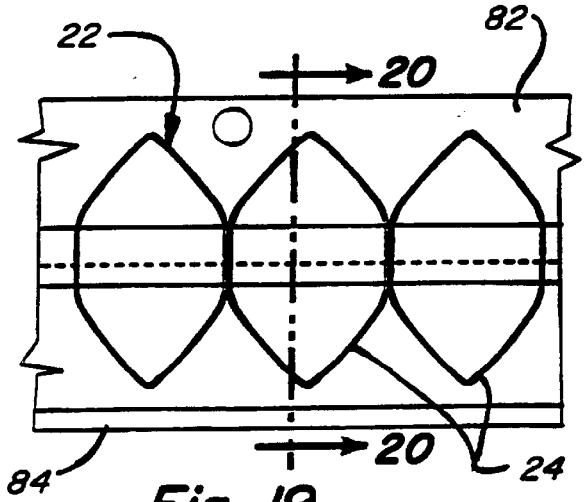
FIG. 19 is a longitudinal section through a panel of the type shown in FIG. 1, showing another alternative arrangement of a side support rail.

FIGS. 19 and 20 illustrate a side support rail 82 similar to FIG. 17 except wherein the J-shaped rail has been extended so as to include an L-shaped underlying segment 84 adapted to support the lower surface of a ceiling panel 22. This of course would give the ceiling a different aesthetic appearance from within the building structure and would give added support along the side edges 42 of the ceiling panel 22.

Figure 22:
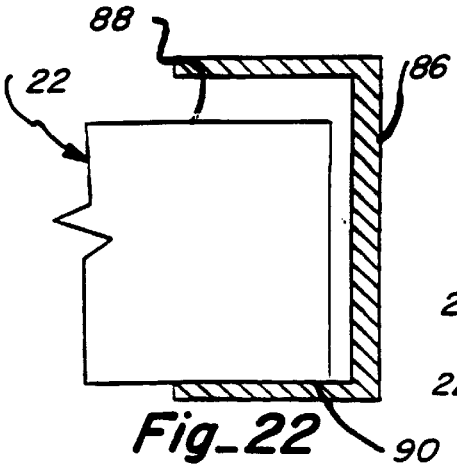
FIG. 22 is a section taken along line 22—22 of FIG. 21.
Figure 21:
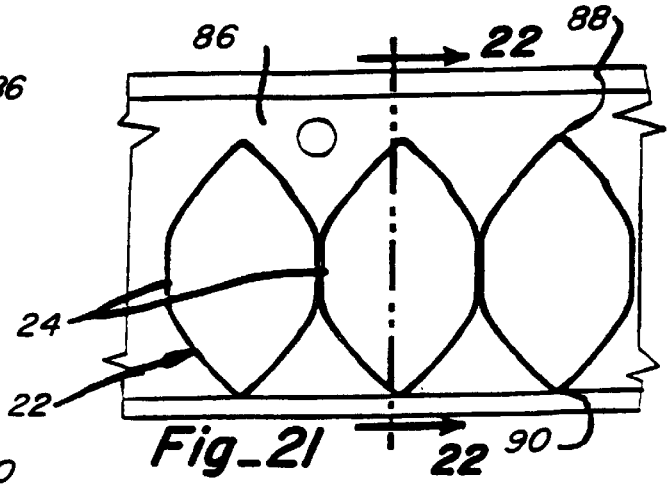
FIG. 21 is a longitudinal section through a panel of the type shown in FIG. 1 showing still another alternative arrangement of a side support rail.

FIGS. 21 and 22 show a channel-shaped support 86 in the form of a U turned on its side so that the ceiling panel 22 is confined along both its top 88 and bottom 90 surfaces. This arrangement would have the same aesthetic appearance from beneath the panel as that shown in FIGS. 19 and 20 but no notches would need to be formed in the ceiling panel itself.

In the event of a room being wider than the ceiling panel, a plurality of panels 22 can be mounted in side-by-side relationship by using intermediate supports such as of the type illustrated in FIGS. 23 through 26. While the outermost side edge (not seen) of a panel 22 in such a system might be supported in accordance with one of the previously described side rail supports, the juncture between two side-by-side panels 22 could be supported by an intermediate support that might take any one of numerous configurations, four of which are illustrated in FIGS. 23 through 26.

Figure 23:
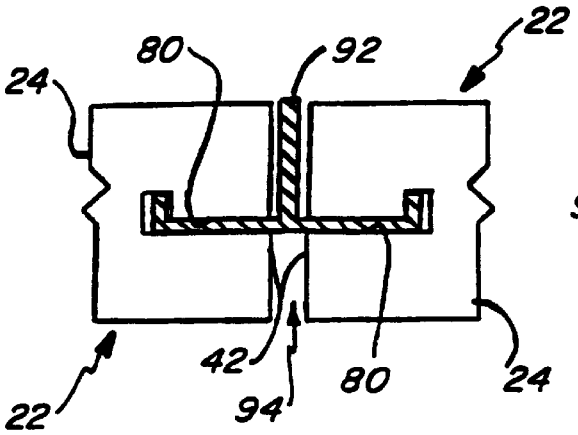
FIG. 23 is a transverse section taken through a first arrangement of an intermediate support rail for supporting adjacent sides of two adjacent ceiling panels of the present invention.

FIG. 23 illustrates an intermediate support 92 that would be suspended from a ceiling structure and has a cross-sectional configuration resembling back-to-back Js so that the intermediate support would support the adjacent side edges 42 of ceiling panels 22 in the same manner as the side rail support 74 illustrated in FIG. 17. Of course, the supported side edge 42 of the ceiling panel 22 would be provided with a generally L-shaped slot 80 as illustrated in FIG. 17 so that the two adjacent ceiling panels 22 are supported at the same elevation and in side-by-side relationship thereby defining a small gap 94 between panels 22 when viewed from interiorly of the room in which the ceiling panel is mounted. A better illustration of the L-shaped notch 80 formed in the sides 42 of the ceiling panel 22 is shown in FIG. 27.

Figure 24:
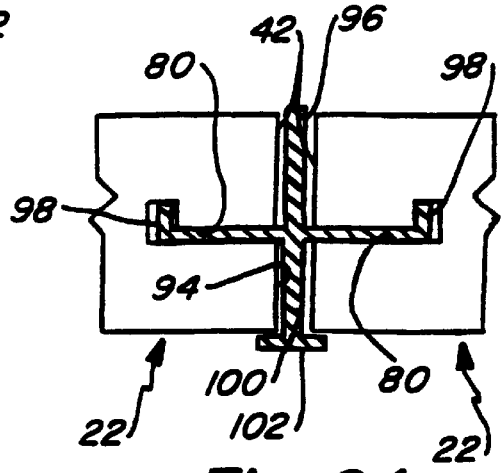
FIG. 24 is a transverse section similar to FIG. 23, showing another alternative arrangement of an intermediate support.

FIG. 24 illustrates a modified intermediate support 96 where again the support 96 includes a back-to-back J-shaped segment 98 but in addition a depending inverted T-shaped segment 100 having a lower horizontal leg 102 which bridges the gap between the adjacent ceiling panels 22 being supported. When this system is used, the gap 94 between ceiling panels 22 is not seen from interiorly of the room 26 but rather a preselected strip defined by the lower horizontal leg 102 of the intermediate support 96 is seen. Of course, the adjacent side edges 42 of the ceiling panels 22 would again be slotted as shown in FIG. 27 for this arrangement of the intermediate support 96.

Figure 25:
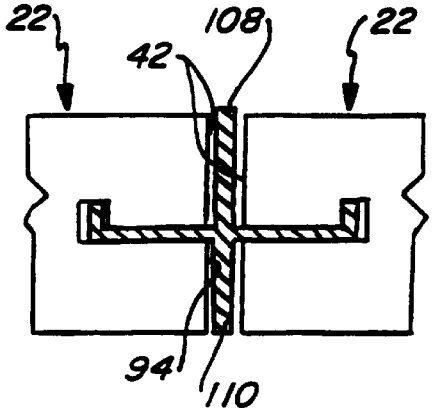
FIG. 25 is a transverse section similar to FIG. 23, showing still another intermediate support rail.

FIG. 25 illustrates an embodiment of an intermediate support 108 very similar to that shown in FIG. 24 but wherein the lower horizontal leg 102 of the inverted T segment 100 has been removed so that a vertical segment 10 of the support 108 fills the gap 94 between adjacent panels 22 and would of course give a slightly different visual or aesthetic appearance than that of FIGS. 23 or 24. The adjacent side edges 42 of the ceiling panels 22 would again be notched as illustrated in FIG. 27.

It should be appreciated that should the ceiling panels 22 be of a great enough width so that they needed additional support along their width, a center support 62 of the type described previously and illustrated in FIG. 14 could be used, or instead of being of L-shaped configuration as illustrated in FIG. 14, it could be of inverted T-shaped configuration in which case the ceiling panels 22 would be notched as shown in FIG. 28.

Figure 28A:
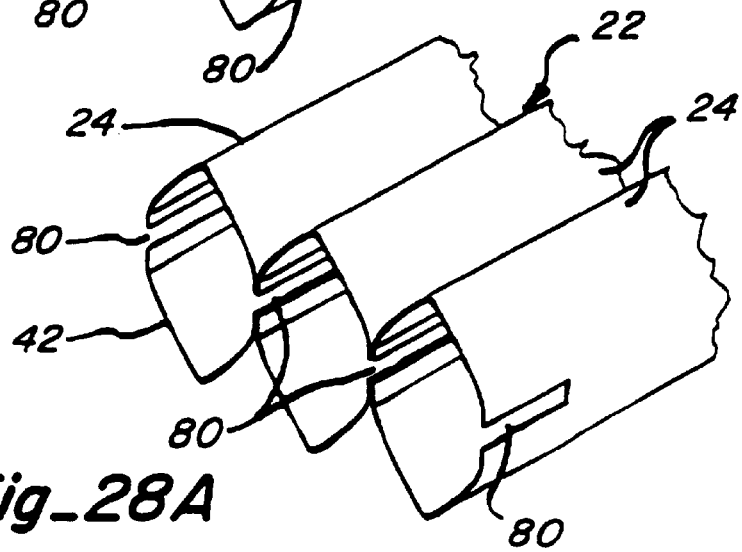
FIG. 28A is a fragmentary isometric showing one end of a cellular panel of the type shown FIG. 1, with the side of the panel having been slotted to receive a side rail of the type shown in FIG. 14.

It will be apparent that an intermediate support would not have to be of back-to-back J-shaped configuration but could be of back-to-back L-shaped configuration which is not illustrated but in which case the adjacent sides of the ceiling panel 22 would be notched with a straight notch 50 as illustrated in FIG. 28A.

Figure 26:
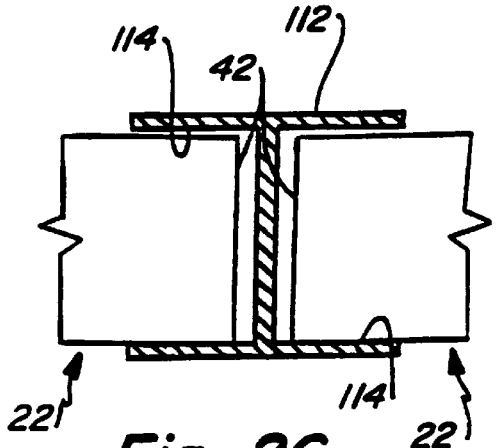
FIG. 26 is a transverse section similar to FIG. 23, showing still another intermediate support rail.

The intermediate support could also be of back-to-back channel configuration as shown in FIG. 26 and identified with reference numeral 112 wherein the intermediate support has back-to-back U-shaped channels 114 laid on their side which are adapted to receive the adjacent side edges 42 of ceiling panels 22 which have not been notched. This again would give a different aesthetic appearance from the interior of the room 26 in which the ceiling panel 22 is mounted.

As will be appreciated from the above description, as many ceiling panels 22 as are necessary to cover a given space can be mounted in side-by-side relationship. The panels 22 can be cut into various desired widths and supported with selected side, intermediate or center supports for utilitarian or aesthetic purposes. Further, openings can be cut in the panels for lights, fans or other such fixtures as necessary.

Soft Cell

Figure 29:
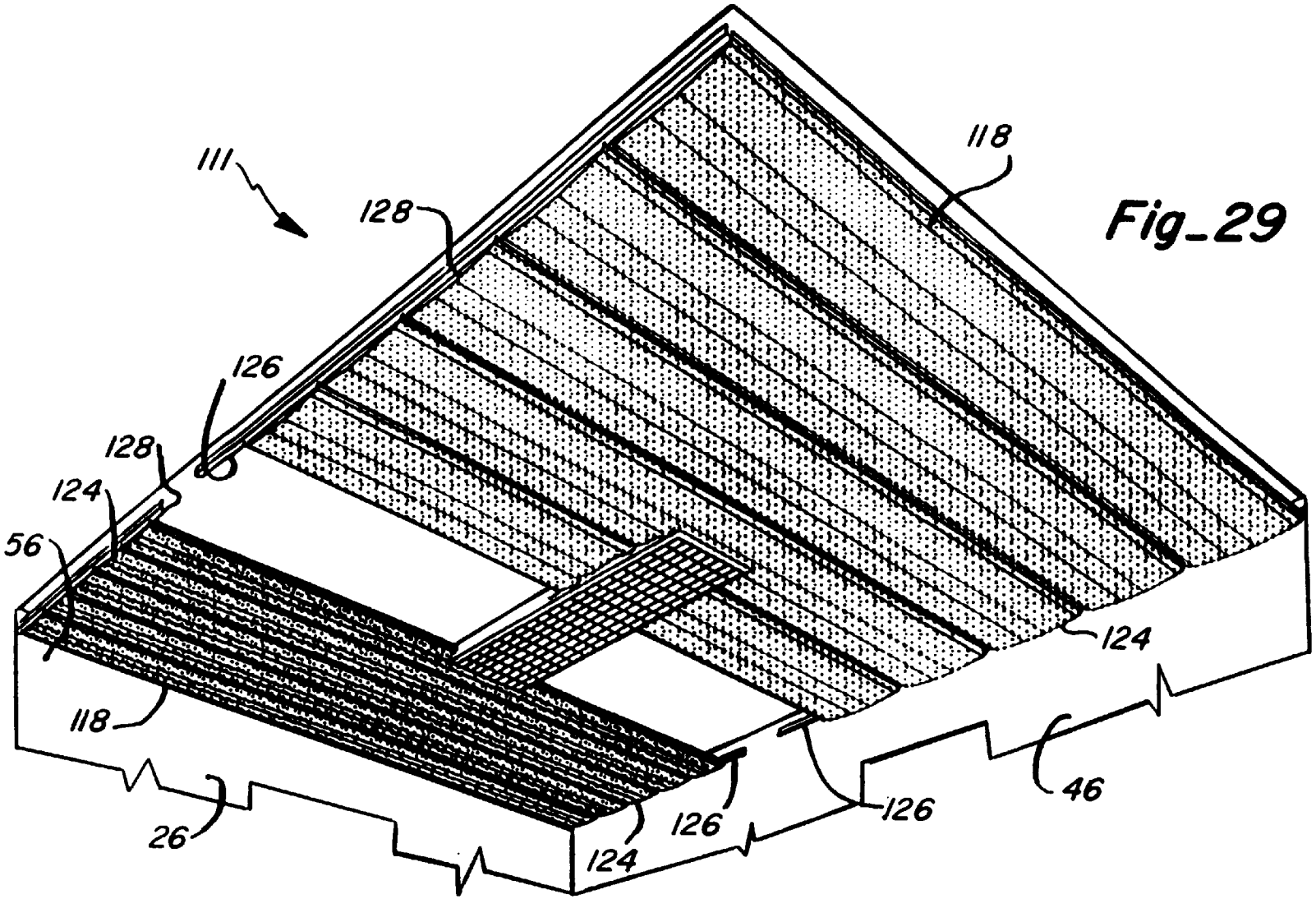
FIG. 29 is an isometric of a second embodiment of the present invention, referred to as a soft cell embodiment, as viewed from beneath the panel mounted on a ceiling structure.

While the first described embodiment 20 is made with at least one material which is semirigid, a second embodiment, which might be referred to as a soft cell embodiment 118 and shown mounted in a building structure in FIG. 29 and shown in more detail in FIGS. 30–64, is formed from a flexible material such as a soft fabric which may be cotton cloth, wool, felt or any other such material. It could also be metal foils or materials which are not naturally occurring but which will drape and otherwise form a somewhat soft appearance.

Figure 34:
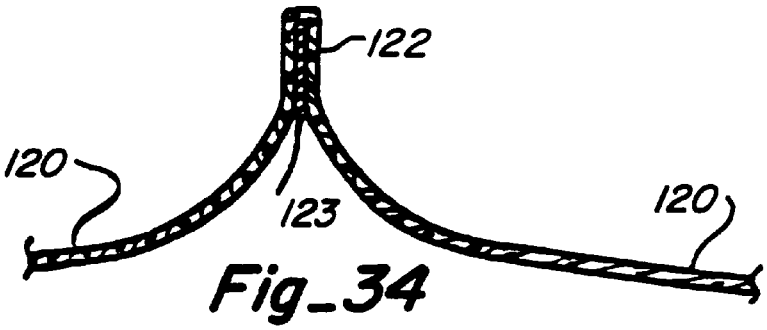
FIG. 34 is an enlarged fragmentary section, showing a pleat in the ceiling panel of FIG. 29.

The soft cell ceiling panel 118 is made in a first arrangement, as seen best in FIGS. 30–32 with a single layer of flexible material 120 which is gathered along laterally extending longitudinally spaced lines to form pleats 122. At the pleats 122, the gathered segments of material are secured together such as with an adhesive 123 as illustrated in FIG. 34 or with a suitable clamp as will be described later. The panel 120 could be allowed to drape as seen in FIG. 30 or could be tensioned so as to present a substantially flat appearance as seen in FIG. 33.

Figure 35:
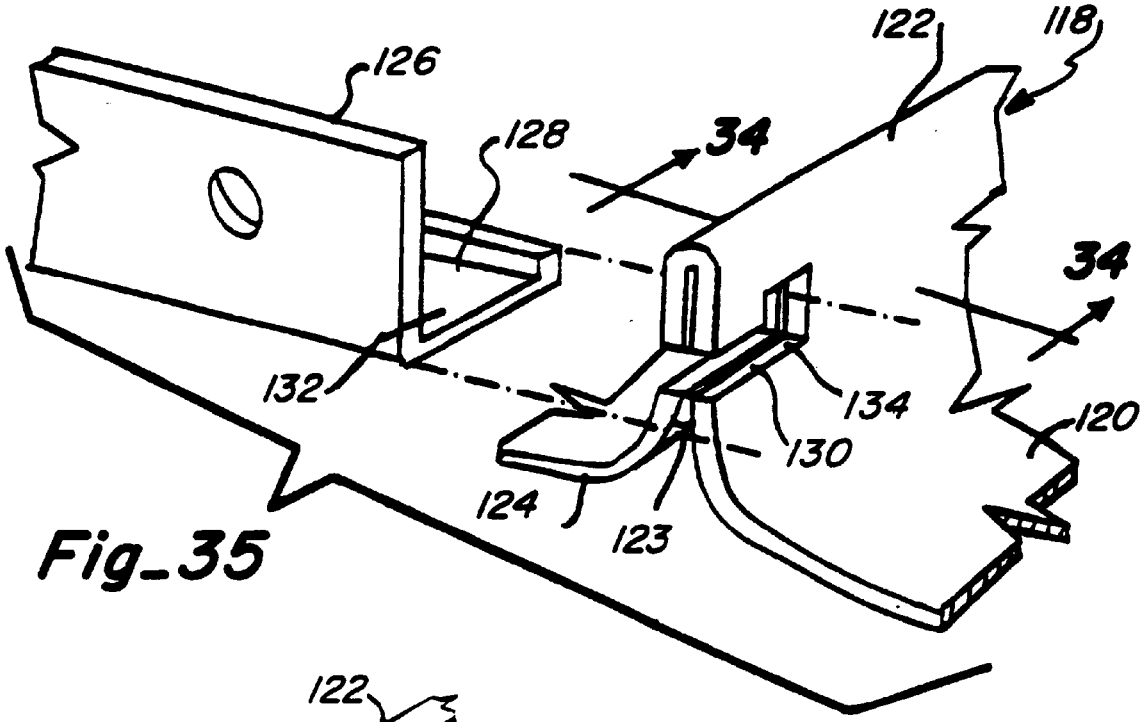
FIG. 35 is an enlarged fragmentary isometric showing the side of a pleat of the panel of FIG. 29, having been slotted to receive a side rail positioned adjacent thereto.

A completed ceiling system 116 made in accordance with the first arrangement of the soft cell embodiment is shown in FIG. 29. The lateral or side edges 124 of a panel 118 are supported on the side walls 46 of the building structure in the same manner as described in accordance with the first embodiment 20 of the invention and that is, with side rails 126 having appropriate horizontal inwardly directed shoulders 128 which either support the ceiling panel 118 along a lower edge or cooperate with a notch 130 (FIG. 35) cut in the side edge of the ceiling panel 118. FIG. 35 shows a side rail 132 of J-shaped configuration which cooperates with an L-shaped notch 134 formed in the side edge 124 of the soft cell panel and wherein the panel has pleats 122 maintained by adhesive 123.

Figure 36:
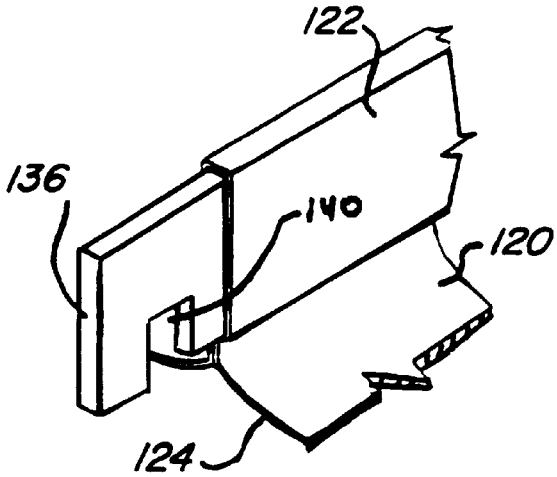
FIG. 36 is a fragmentary isometric of a pleat of the panel shown in FIG. 29 wherein a support bar is positioned within the pleat as an alternative arrangement.

An alternative system for supporting the panel 118 is shown in FIG. 36 wherein an elongated rigid bar 136 of PVC, cold rolled steel, extruded aluminum or the like is secured, as by bonding or otherwise, within a pleat 122 and adapted to extend laterally from each side of the panel 118. The rigid bar extension 136 could merely rest on a side rail 48 of the type shown for example in FIG. 12 or could be notched as at 140, as illustrated in FIG. 36, along a bottom edge so as to ride along a vertical leg of a side rail (not illustrated).

Figure 37:
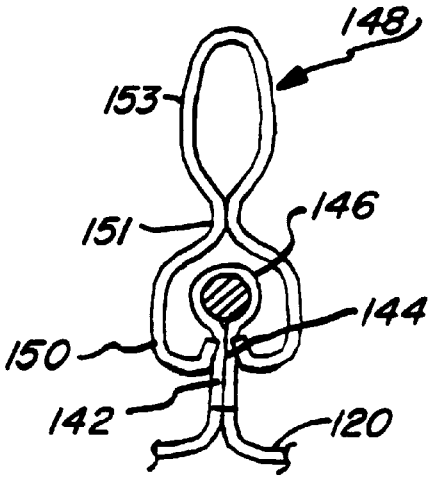
FIG. 37 is a fragmentary transverse section illustrating an alternative system for supporting a pleat in a ceiling panel of the type shown in FIG. 29.

FIG. 37 illustrates a different system for forming a pleat 142 while defining means for suspending the panel and it will there be seen that the material 144 from which the panel is to be made is gathered as previously described and a rod 146 which might be rigid or flexible is inserted into the gathered material before a clamp 148 having two legs with lock jaws 150 at the bottom thereof is positioned with the jaws 150 on either side of the gathered fabric 144 so as to confine the rod 146 therebetween. The clamp 148 can be spot welded or otherwise bonded at an intermediate location 151 so as to retain the jaws in clamping relationship with the material.

In order to suspend the panel from side rails with clamps of the type described, an upper closed loop portion 153 of the clamp can be extended beyond the side edges of the panel so as to ride in side support rails having U-shaped channels laid on their side of the type shown for example in FIG. 21.

Figure 38:
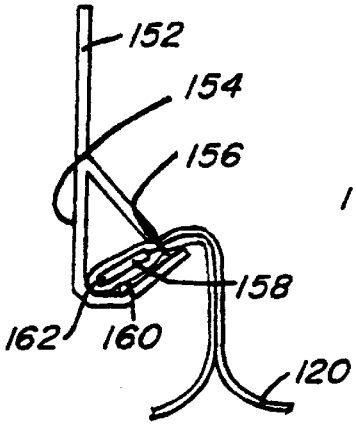
FIG. 38 is a view similar to FIG. 37 showing another arrangement for supporting a pleat of a panel of the type shown in FIG. 29.
Figure 39:
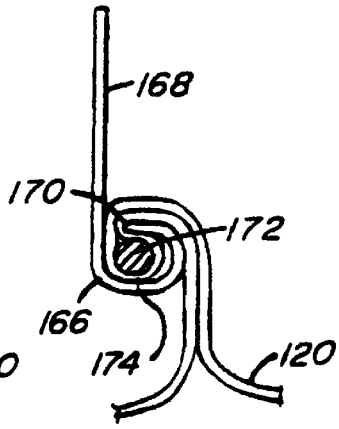
FIG. 39 is a view similar to FIG. 37 showing still another system for supporting a pleat in a panel.

Similar clamping systems are shown in FIGS. 38 and 39 where again a top portion of the clamp could be extended to ride on a suitable side rail while a lower clamping portion secures and retains a pleat of the flexible material. In FIG. 38, the lower clamping portion 154 of the clamp 152 is generally triangular in configuration having a slot 156 therein which receives a looped portion 158 of the fabric along a pleat 160 and wherein a bar 162 has been inserted in the loop portion 158 which enlarges the pleat 160 beyond the dimension of the slot 156 in the clamping portion to prevent release of the pleat 160 from the clamp. Similarly, in FIG. 39, the lower clamping portion 166 of the support 168 is substantially circular in cross-sectional configuration again defining a slot 170 through which the fabric material is inserted into the clamping portion with a rod or cord 172 inserted in the gathered fabric 174 to retain it within the clamping portion 166.

Figure 40:
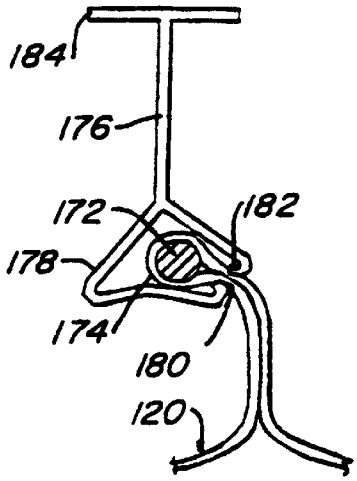
FIG. 40 is a view similar to FIG. 37 showing still another system for supporting a pleat in a panel.

FIG. 40 illustrates a clamp 176 which again has a substantially triangularly-shaped lower clamping portion 178 defining a gap 180 with clamping teeth 182 which prevent the looped end of the fabric 174 which has a rod or cord 172 inserted therein from being removed. The upper portion of the clamp has a horizontal leg 184 which again can be extended relative to the lower portion of the clamp to ride on and be supported by side rails having a horizontal shoulder such as the type shown in FIG. 12.

Figure 42A:
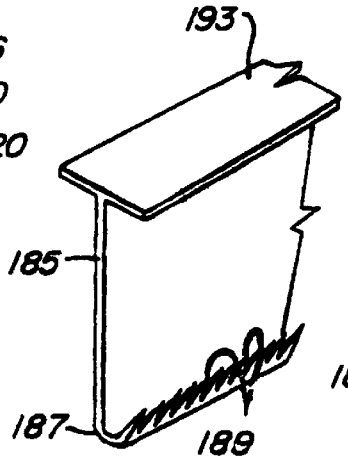
FIG. 42A is an isometric showing still another system for supporting a pleat in a panel.
Figure 42B:
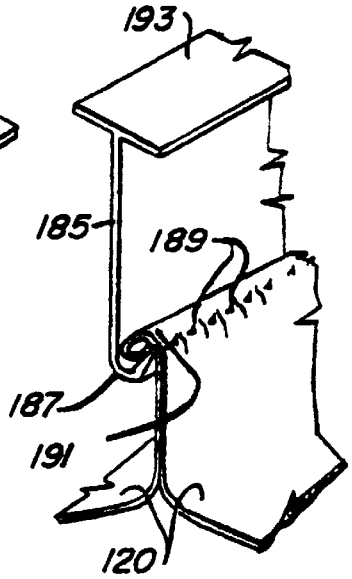
FIG. 42B is a view similar to FIG. 42A showing a pleated portion of material connected to the support shown in FIG. 42A.

A further arrangement of a clamp for supporting a gathered or pleated portion of the panel is illustrated in FIGS. 42A and 42B and can be seen to have a T-shaped upper portion 185 and a J-shaped lower portion 187 with the J-shaped portion having serrations or sharpened teeth 189 for gripping the material from which the panel is made. As illustrated in FIG. 42B, the teeth 189 are adapted to be inserted through the sheet material adjacent a gathered or looped segment 191 of the material so as to positively retain the material in the looped condition. The upper T-shaped portion of the clamp has a horizontal leg 193 which, as with the embodiment of FIG. 40, can be extended relative to the lower portion 187 of the clamp to ride on and be supported by side rails having a horizontal shoulder such as of the type shown in FIG. 12.

Figure 41A:
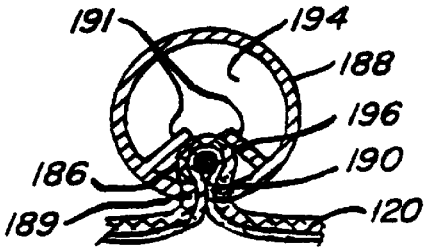
FIG. 41A is a fragmentary transverse section showing a support in still another system for supporting a pleat in a panel, with the pleat having only been partially inserted into the support.
Figure 41B:
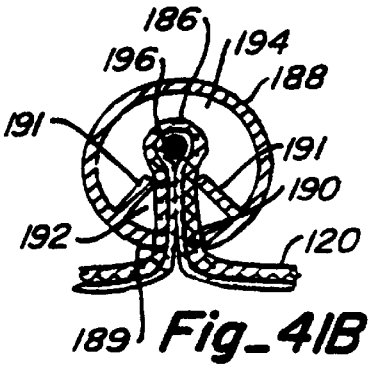
FIG. 41B is a section similar to FIG. 41A wherein the pleat is fully inserted into the support.

Further arrangements for supporting a pleated segment 186 of the flexible material are illustrated in FIGS. 41A and 41B wherein a hollow tubular cylinder 188 has a slot 190 formed along a lower portion 189 thereof with radially inwardly directed arms 191 that define a small 192 and large pocket 194. The cylinder 188 is preferably made of a somewhat flexible material and the gathered or pleated segment 186 of material, whether it is a single or double layer as illustrated, can be forcibly inserted through the slot 190 in the lower portion of the cylinder 188 with a rod or cord 196 therein to temporarily confine the gathered material 186 within the smaller pocket 192 of the cylinder while wrinkles are removed. The rod 196 and gathered material 186 can then be further inserted beyond the radially inwardly directed arms 191 so as to confine the rod 196 and gathered material within the larger pocket of the cylinder wherein the arms 191 form teeth which prevent a release of the rod 196 and the gathered material 186. An upper segment of the cylinder 188 can be extended at either side of the panel so as to be supported on appropriate side rails if desired or the rod 196 can be made of a rigid material and extended beyond the lateral sides of the flexible material 186 so as to be supported on appropriate side rails in either event allowing the pleated locations of the material to be moved along the supporting side rails.

Figures 43, 44:
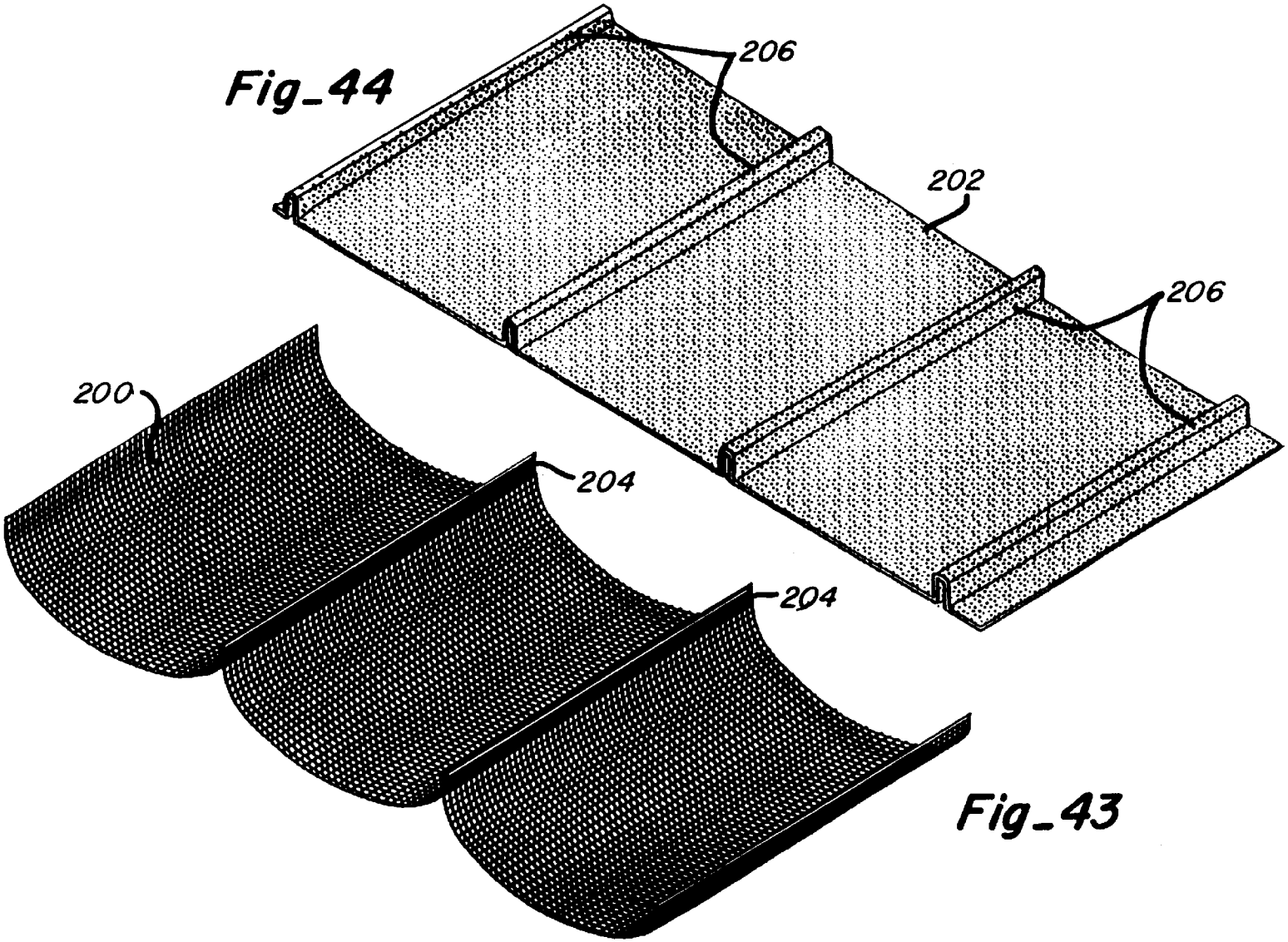
FIG. 43 is an isometric of a pleated facing sheet of material used in an alternative arrangement of the soft cell embodiment of the present invention.
FIG. 44 is a fragmentary isometric similar to FIG. 43 showing a pleated backing sheet of material used in combination with the facing sheet illustrated in FIG. 43 to form an alternative arrangement of the soft cell embodiment of the present invention.
Figure 45:
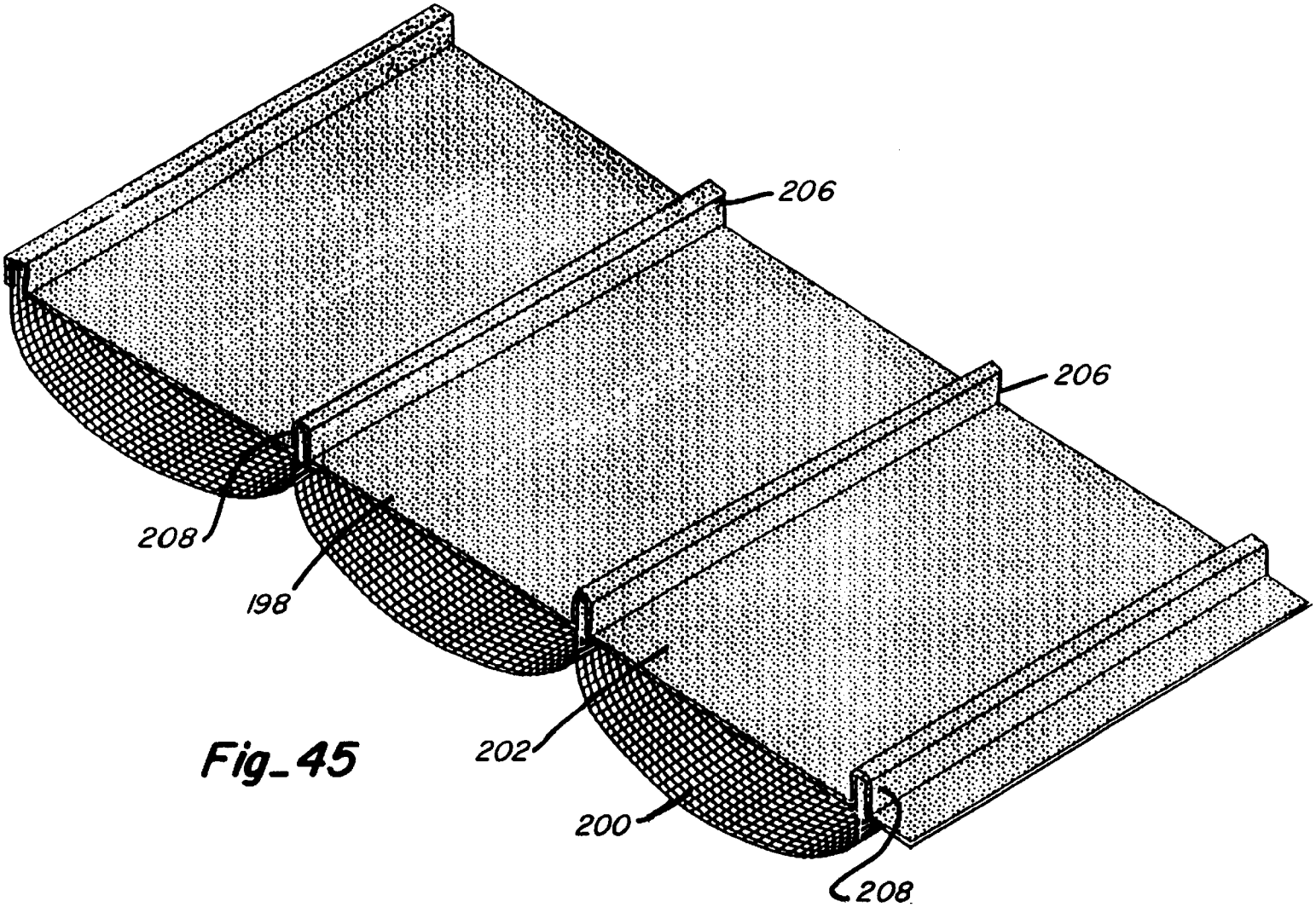
FIG. 45 is a fragmentary isometric showing the sheets of material illustrated in FIGS. 43 and 44 interconnected into the alternative arrangement of the soft cell embodiment.

FIGS. 43 through 45 illustrate a soft cell panel 198 made of two different materials with the facing sheet 200 being a course woven material having relatively large openings and adapted to be configured by gravity as it sags and droops between adjacent support members. A backing sheet 202 is made of a solid material. Pleats 204 can be formed in the facing sheet 200 with a bonding adhesive or the like and inserted into corresponding pleats 206 in the backing sheet 202 which can then be bonded to the pleats in the facing sheet 200. The pleats in the facing sheet can receive elongated support bars, rods or the like in accordance with prior described embodiments so that the bars or rods can support the panel on side rails. In the alternative, if the pleated facing material 200 is adhered to the backing sheet with no support bars or the like, the side edges 208 of the pleated panel can be appropriately notched for support as described for example in FIG. 35.

Figure 46:
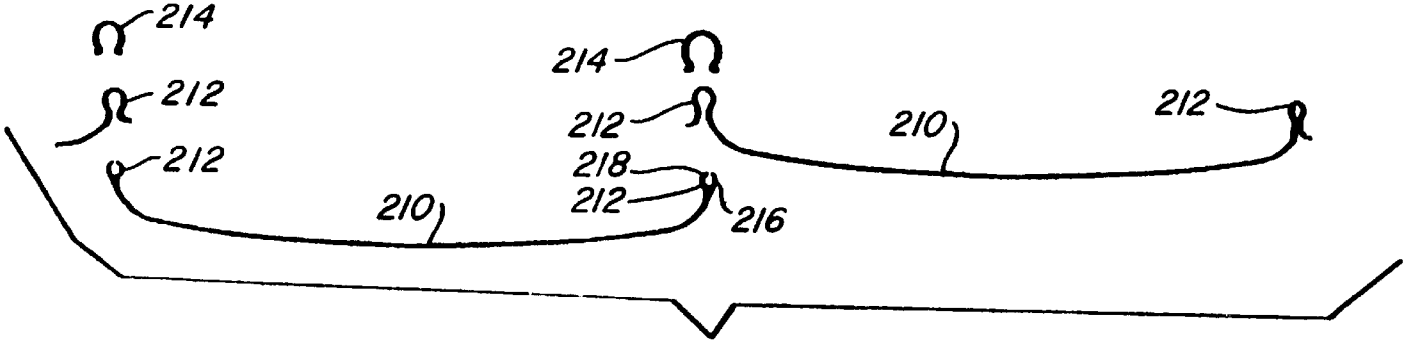
FIG. 46 is a fragmentary exploded section illustrating a system for joining two strips of material to form a soft cell arrangement of the present invention.
Figure 47:
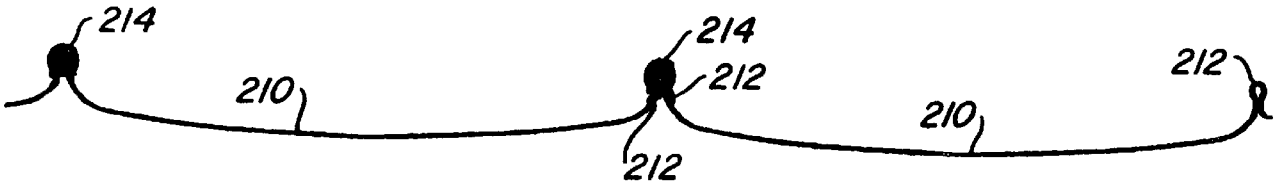
FIG. 47 is a view similar to FIG. 46 with the components interconnected to form the associated soft cell arrangement.

While typically the ceiling panel would be formed from a continuous sheet of flexible material, it could be formed from interconnected strips as shown in FIGS. 46–58. With initial reference to FIGS. 46 and 47, contiguous side edges 212 of strips 210 could be interconnected, for example, with a C-clamp 214. When interconnecting two adjacent strips 210 of flexible material with a clamp 214 as seen in FIGS. 46 and 47, the edge of a first strip 216 could be looped around a small rigid rod 218 preferably of circular cross-section and the adjacent side edge of the next adjacent strip of material could then be drooped over the looped edge 216 of the first strip of material. The C-shaped spring clamp 214 can then be placed over the entire assemblage of materials to securely connect the adjacent side edges 212 of the strips 210 of material together.

Figure 48:
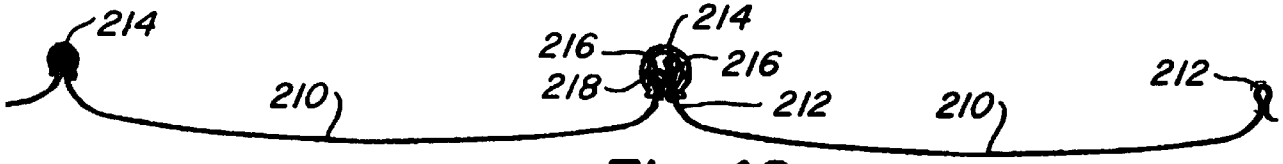
FIG. 48 is a section similar to FIG. 47 showing an alternative system for joining two adjacent strips of material into a soft cell arrangement of the invention.

Alternatively, as shown in FIG. 48, the side edge 216 of each strip 210 could be looped around its own rigid rod 218 and both rigid rods with the looped edges of adjacent strips encaptured within a C-clamp 214.

These procedures could be used to form the entire ceiling panel or could be used to replace a soiled, stained or otherwise undesirable portion of an enlarged strip of fabric material by removing the damaged area along a transverse strip and then replacing that strip with a new piece of material that is joined to the old material along opposite side edges in the manner described.

When utilizing the clip system shown in FIGS. 46 and 47, the rod 218 inserted in the innermost loop of fabric can extend beyond the lateral side edges of the flexible material so that the opposite ends of the rod can be supported in side rails, for example, of U-shaped configuration laid on their side of the type illustrated in FIG. 21 of the first described embodiment. In this manner, the rods 218 can be slid along the length of the side support rails to extend and retract the ceiling panel as desired. The opposite ends of the panel could again be releasably connected to end rails with magnets or other well known means for releasably connecting articles.

Figure 49:
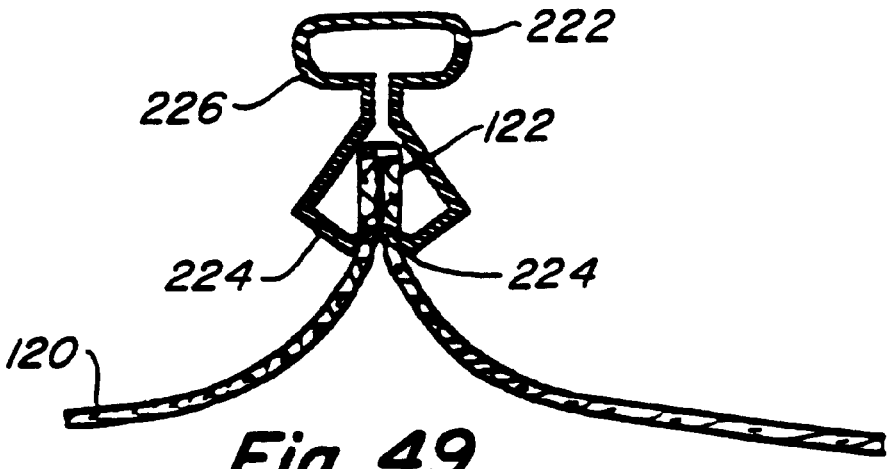
FIG. 49 is an enlarged fragmentary section showing still another system for supporting a pleat in a soft cell arrangement of the present invention.
Figure 50:
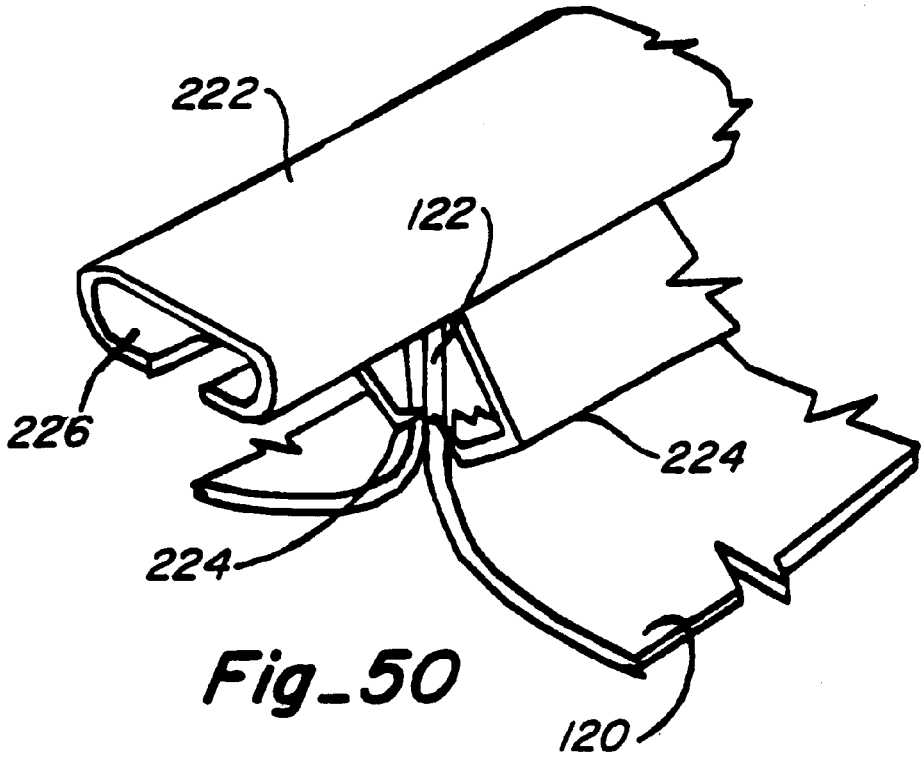
FIG. 50 is an enlarged fragmentary isometric of the system shown in FIG. 49.

An alternative clip 222 is illustrated in FIGS. 49 and 50 for supporting the pleat 122 in the panel of material 120. It will there be appreciated that the clip 222 has a pair of generally J-shaped clamping jaws 224 which are integrally connected with an upper open channel 226. The open channel 226 would extend laterally beyond the side edges of the fabric material and the clamping jaws 224 and in turn be supported in a channel-shaped side rail for sliding movement therealong. The side rail, for example, could be of U-shaped configuration laid on its side such as of the type illustrated in connection with the first embodiment in FIG. 21. In this manner, each clip 222 could be slid along the rail when retracting or expanding the ceiling panel within a building structure.

Figure 51:
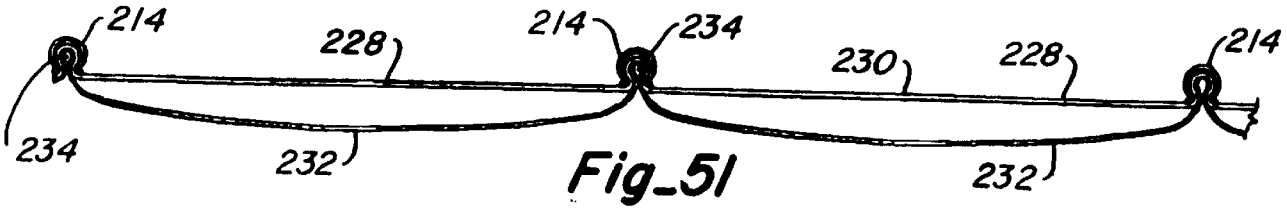
FIG. 51 is a fragmentary transverse section of another soft cell arrangement of the present invention.
Figure 52:
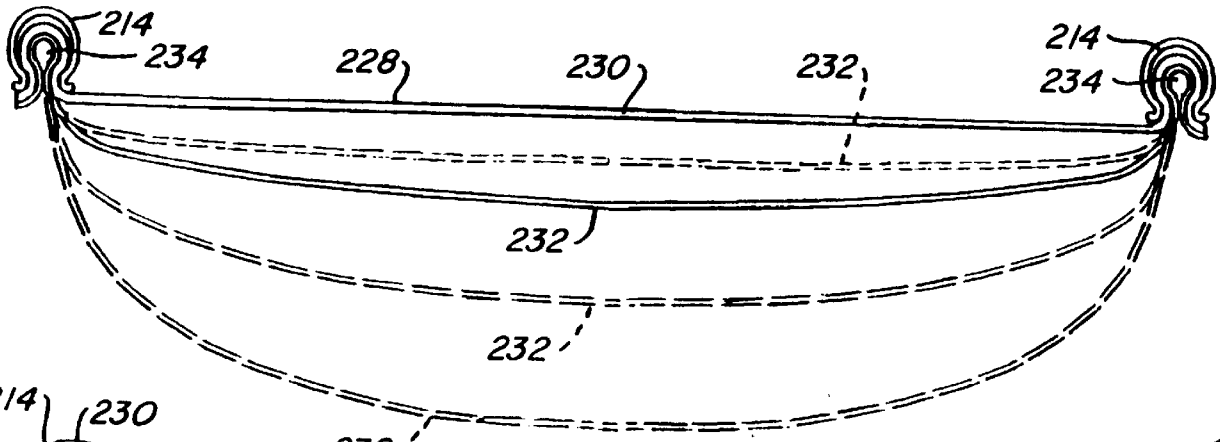
FIG. 52 is a fragmentary section similar to FIG. 51 showing the lower sheet of the panel in varied sagging conditions.
Figure 53:
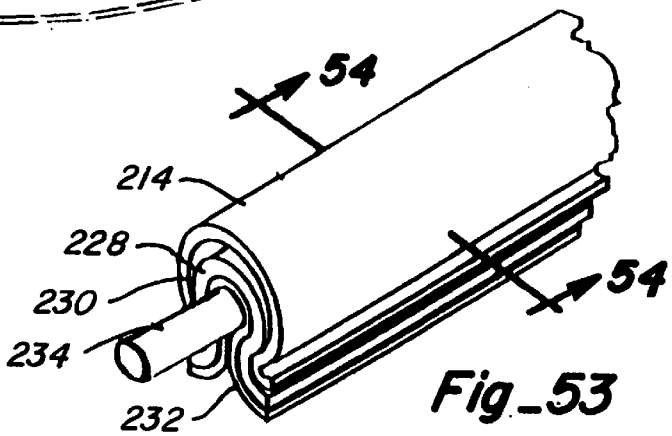
FIG. 53 is a enlarged fragmentary isometric showing a pleat of the arrangement shown in FIG. 51.
Figure 54:
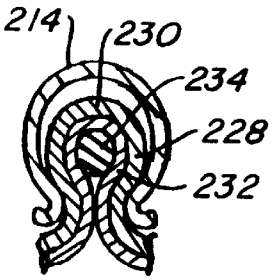
FIG. 54 is a section taken along line 54—54 of FIG. 53.

A soft celled ceiling panel 228 can be made with two strips of flexible fabric wherein one strip 230, FIGS. 51 and 52, functions as a backing sheet and the other as a face sheet 232. The backing sheet can be manipulated by tensioning or drawing it taut to provide control over the spacing of the cells and to provide control over the amount of droop or sag in the face sheet.

Preferably, the face sheet 232 would have a greater length between adjacent pleats than the backing sheet 230 so that it would droop into the room in which the ceiling panel 228 is mounted. Such an arrangement is illustrated in FIGS. 51 through 54. In this arrangement, the clip system shown in FIGS. 46 and 47 is utilized to connect the backing sheet 230 to the face sheet 232 and, as will be appreciated, the face sheet is looped over the insert rod 234 and the backing sheet 230 looped over the face sheet 232 prior to the C-shaped clip 214 being secured thereto.

FIG. 52 illustrates the various aesthetics that can be obtained by varying the length of the face sheet 232 relative to the backing sheet 230. As with the embodiment of FIGS. 46 and 47, the insert rod 234 could extend beyond the side edges of the flexible sheets 230 and 232 of material so as to be slidably supported in U-shaped side support channels laid on their side to facilitate movement of the ceiling panel 228 between extended and retracted positions.

Figure 55A:
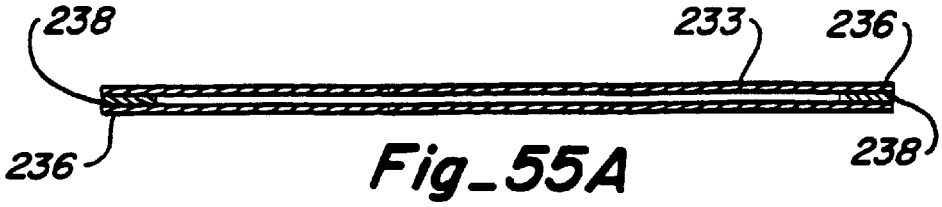
FIG. 55A is a transverse section taken through a pair of interconnected strips of material which can be used to form a cell of a soft celled ceiling panel.
Figure 55B:
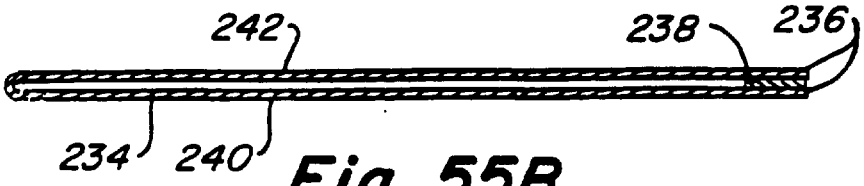
FIG. 55B is a transverse section of an alternative system for forming a cell for a soft celled ceiling panel wherein the cell is made from a single strip of material folded upon itself.

It will be appreciated that the double layer soft cell panel 228 shown in FIGS. 51 through 54 can be made from continuous sheets of backing material 230 and facing material 232 or can be made from interconnected strips of such material which have been interconnected in accordance with the method illustrated in FIGS. 46 and 47. When interconnecting a plurality of strips of material, the individual strips can be two-ply as designated with reference numeral 233 and illustrated in FIG. 55A or can be formed into a two-ply strip 234 by folding an extra wide strip upon itself as illustrated in FIG. 55B. The side edges 236 of the strip or strips as the case may be would preferably be bonded together with adhesive 238 in a well known manner. The resulting strip which is of a pre-selected and desired width is two-ply and, if desired, the facing sheet can be formed wider than the backing sheet.

Figure 56:
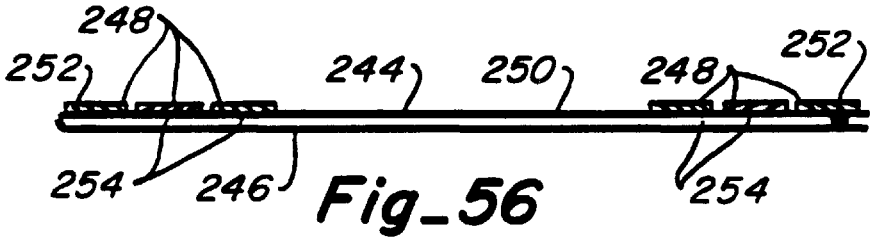
FIG. 56 is a transverse section of still another arrangement for forming a cell wherein a strip of material as illustrated in FIG. 55 has rigid auxiliary strips bonded to a surface thereof.
Figure 57:
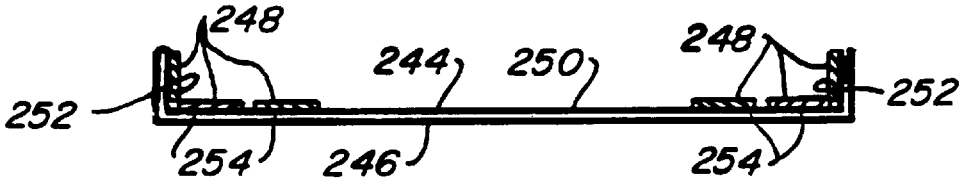
FIG. 57 is a transverse section similar to FIG. 56 wherein the ends of the strip have been preliminarily folded in a process to form a cell.
Figure 58:
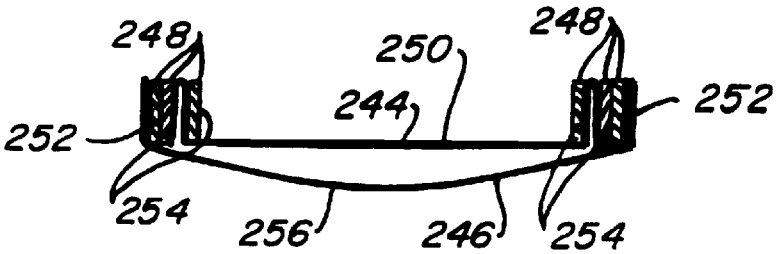
FIG. 58 is a transverse section similar to FIG. 57 wherein the strip has been additionally folded so as to define a double-walled cell with one sagging side.

As an alternative to forming the facing sheet wider than the backing sheet as illustrated in FIGS. 56–58, a backing sheet 244 can be narrowed by gathering the backing sheet 244 along longitudinal lines thereby making its effective width less than that of a facing sheet 246. This can be accomplished in a practical manner by bonding, for example, three rigid or semirigid strips 248 of material such as PVC or aluminum to the top surface 250 of the backing sheet 244 along opposite edges and then folding the outermost one 252 of the three strips upwardly as illustrated in FIG. 57 prior to lifting the backing sheet 244 between the remaining innermost two strips 254 of the rigid strips 248. The strips 248 can then be compressed together in a vertical orientation as shown in FIG. 58 thereby effectively narrowing the backing sheet 244 relative to the facing sheet 246 to form a desired droop 256 for the facing sheet of the ceiling panel. The rigid strips 248 and fabric therebetween can either be clamped or bonded together to retain the desired relationship.

Figure 59:
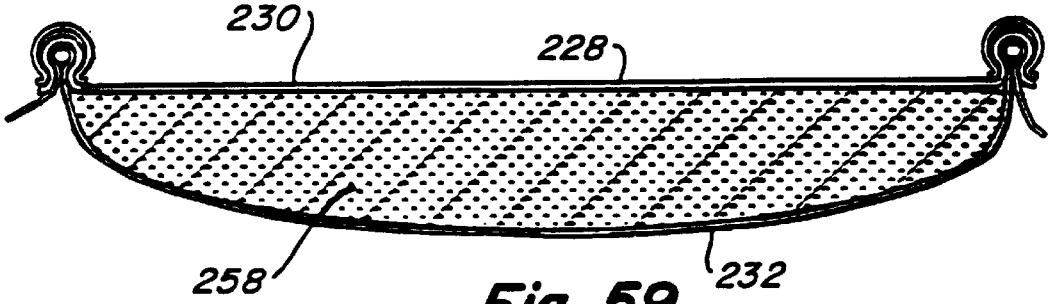
FIG. 59 is a fragmentary section of a soft celled ceiling panel of the type illustrated in FIG. 51 wherein the cell has been filled with an insulating or sound-absorbing material.
Figure 60:
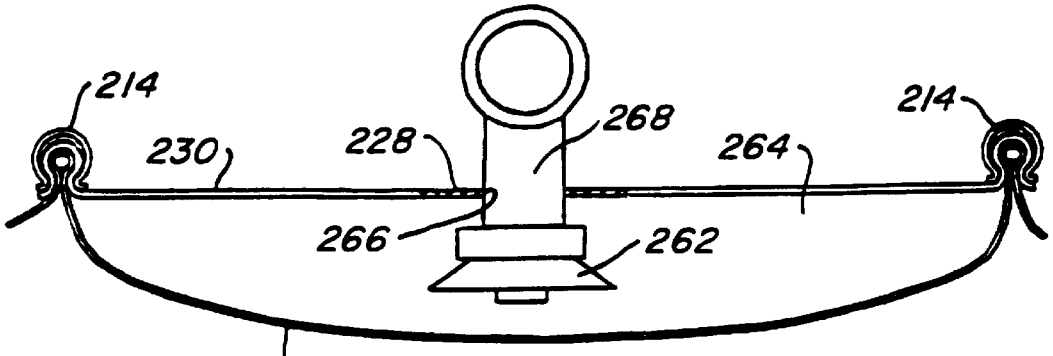
FIG. 60 is a view similar to FIG. 59 but wherein a sprinkler head for a fire extinguishing system has been positioned within the cell where the lower material has an open cell structure.

The two layer soft cell embodiment 228 illustrated in FIGS. 51 through 54 can be further modified by inserting into the space between the backing sheet 230 and facing sheet 232 a layer of sound absorbing or insulating material 258 such as foam rubber, soft cotton, or polyester quilt batting as shown in FIG. 59. Further, the facing sheet 232 can be perforated or constructed with or without the sound deadening or insulating material 258 to render the sound absorbing characteristics of the panel 260 more effective. A further advantage of the system shown in FIG. 60 resides in the fact that sprinkler heads 262 in a fire extinguishing system can be confined and concealed in cells 264 of the ceiling panel 228 by providing holes 266 through the backing sheet 230 to receive water lines 268. When the panel is used in this manner, the facing sheet 232 would need to be a course woven or densely perforated sheet to allow water to spray therethrough.

Figures 61, 62, 63, 64:
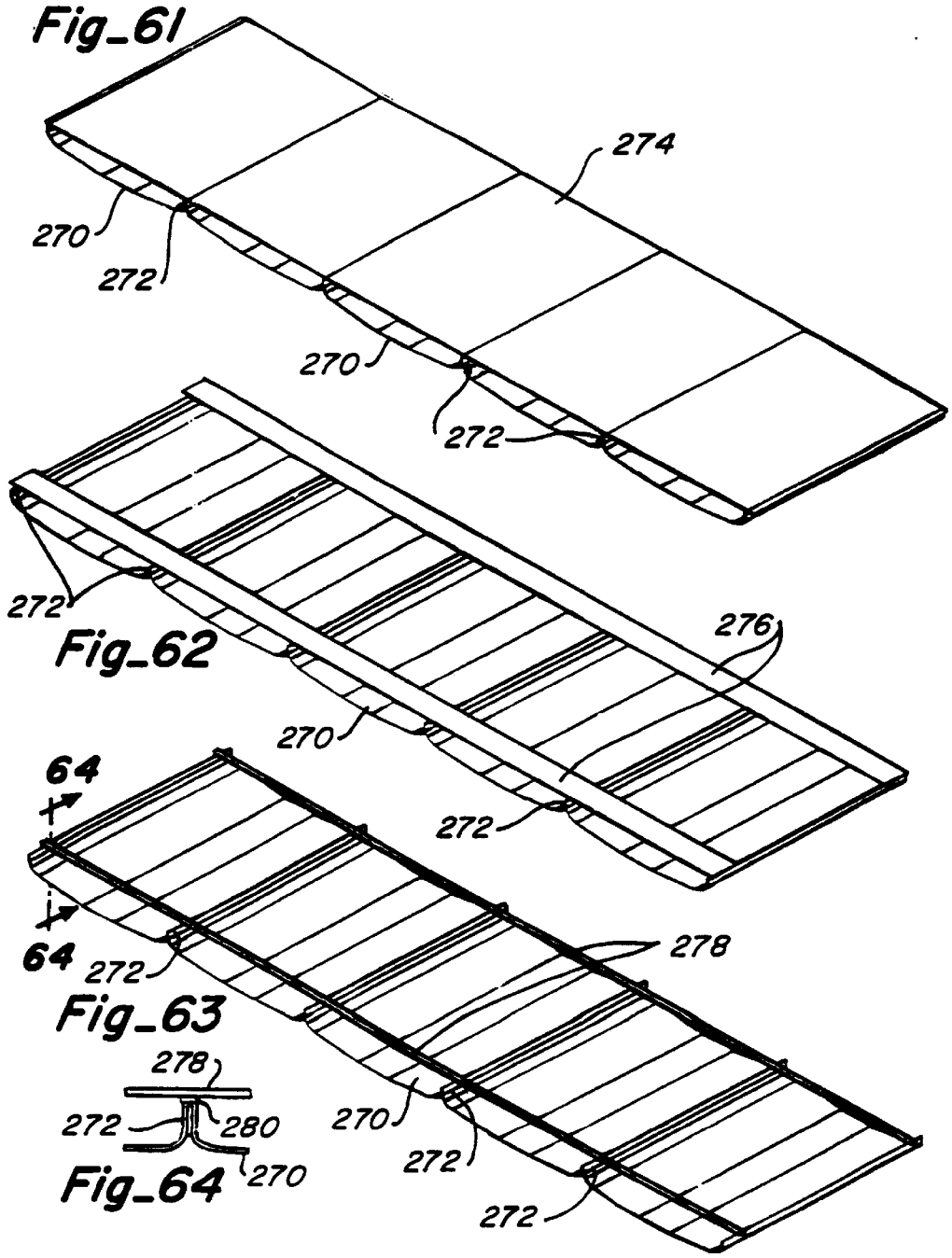
FIG. 61 is an isometric looking down on a double-walled soft celled panel arrangement wherein a flat backing sheet is bonded to upstanding pleats of a lower facing sheet.
FIG. 62 is an isometric view similar to FIG. 61 wherein the top backing sheet has been placed with elongated strips of backing material.
FIG. 63 is an isometric similar to FIG. 62 wherein the strips of backing material have been replaced with elongated cords.
FIG. 64 is a section taken along line 64—64 of FIG. 63.
Figure 65:
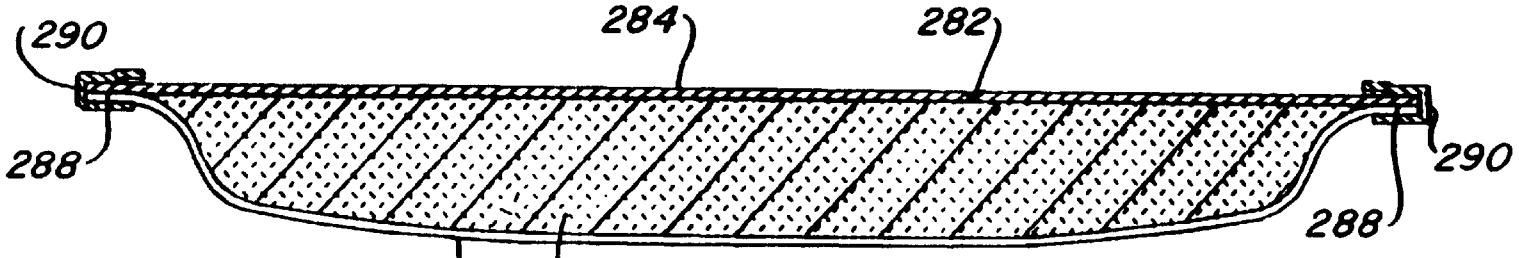
FIG. 65 is a section taken through a cell in a further embodiment of the present invention referred to as a strip soft cell embodiment.

Alternative arrangements of the soft cell ceiling panel are shown in FIGS. 61 through 64 wherein it will be seen that the facing sheet 270 is formed as illustrated in FIG. 30 so that upwardly extending adhesively bonded pleats 272 define adjacent cells and the pleats 272 are then bonded at spaced intervals to a continuous backing sheet 274 as shown in FIG. 61, a plurality of backing strips 276 of a flexible material as shown in FIG. 62 or simply two flexible cords 278 as shown in FIG. 63. FIG. 64 illustrates the connection of an adhesively-formed pleat to a cord 278 as by bonding with a suitable adhesive 280.

Strip Soft Cell

Figure 67:
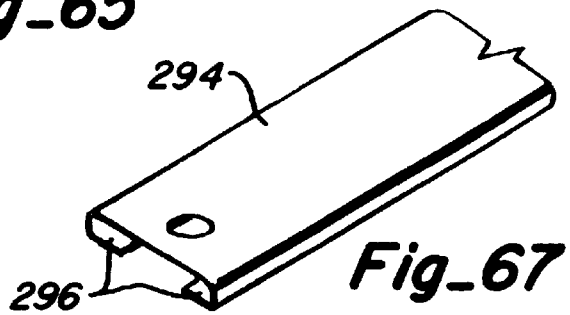
FIG. 67 is a fragmentary isometric of the strip shown in FIG. 66.
Figure 66:
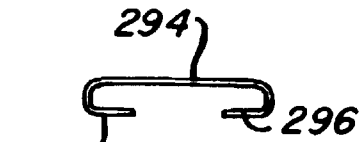
FIG. 66 is a cross-section taken through a rigid piece of material utilized to anchor adjacent side edges of cells of the type shown in FIG. 65 to an existing hard surface.
Figure 68:
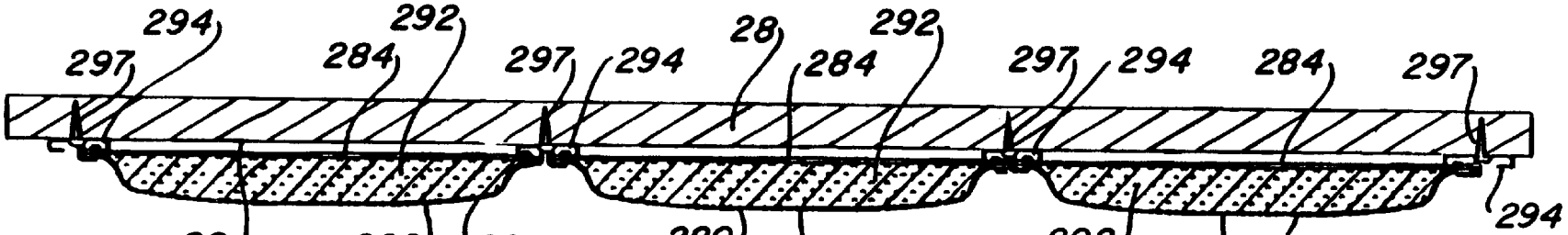
FIG. 68 is a longitudinal section taken through a panel made with the components illustrated in FIGS. 65–67 connected to a supporting structure, wherein the panel is made from a plurality of cells of the type shown in FIG. 65.
Figure 69:
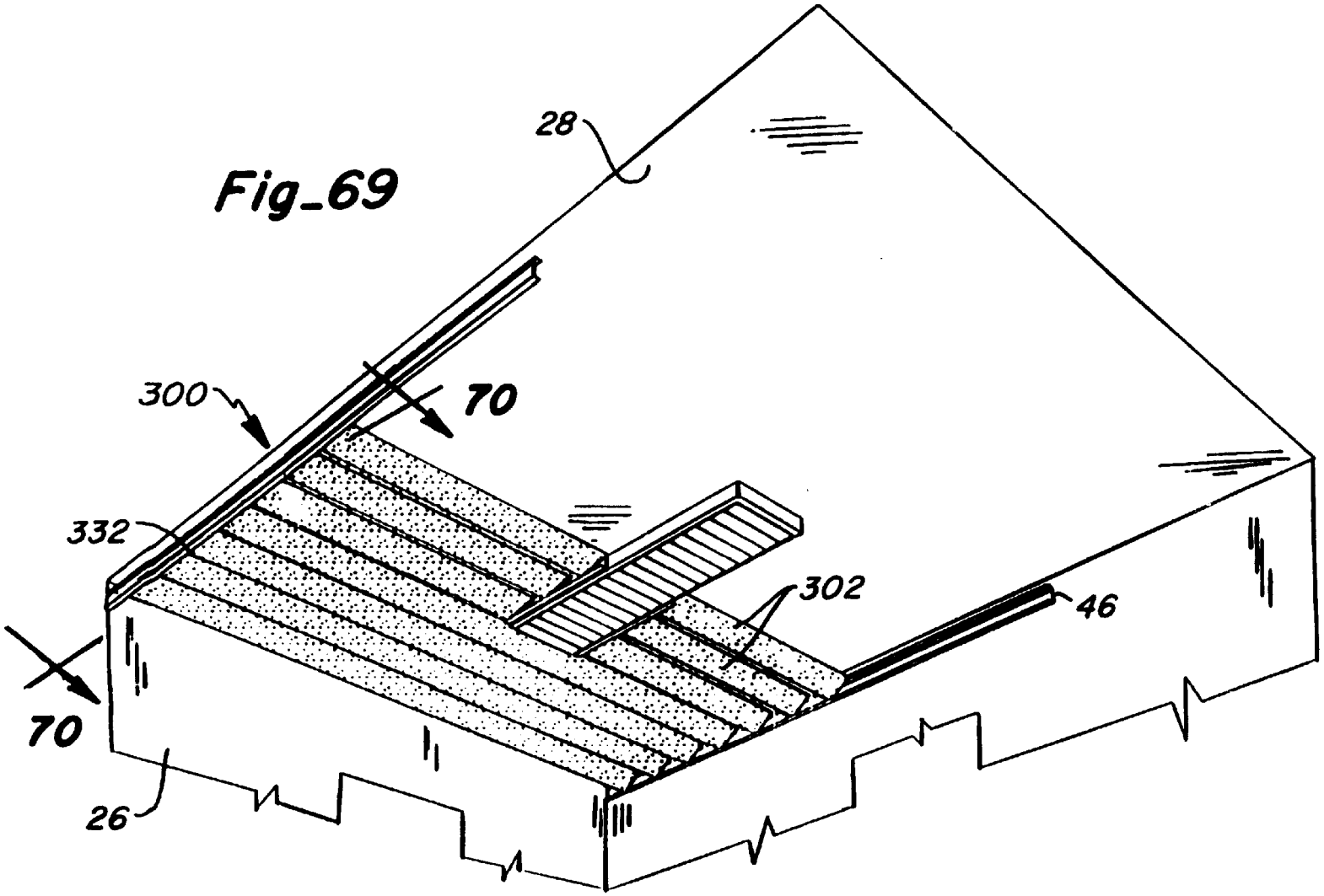
FIG. 69 is a perspective view of the ceiling of a room having a compressive triangle panel embodiment of the present invention.

A variation of a two-ply soft cell ceiling panel 282 is illustrated in FIGS. 65 through 68 wherein a backing sheet 284 and a facing sheet 286 are secured together along adjacent edges 288 with C-shaped clips 290 to form cells with the facing sheet 286 being of greater width between clamps so as to drape from the backing sheet 284. The space between the backing sheet and face sheet can be filled with an insulating or sound absorbing material 292 and, again, the facing sheet 286 can be perforated as desired to render sound deadening qualities of the panel 282 more effective. An elongated generally C-shaped anchor strip 294 with lock channels 296 along each side, as shown in FIGS. 66 and 67, is utilized to secure adjacent double-ply cells 282 to the ceiling 28 by inserting the C-shaped clips 290 along opposite edges of the cells into the lock channels 290 on either side of the anchor strip 294 as illustrated in FIG. 68 and securing the anchor strip 294 to the ceiling 28 with suitable fasteners 297.

As a variation (not shown), the facing sheet can be made shorter than the backing sheet so that again a cell is formed but the appearance from the interior of the room is quite different in that the facing sheet is seen as somewhat of a continuous substantially flat sheet interrupted at preselected intervals by the anchor strips but the same insulating or sound absorbing qualities can be obtained.

As a further variation, the backing sheet 284 and facing sheet 286 can be joined to adjacent backing and facing sheets substantially as shown in FIGS. 46 and 47 or 48 thereby rendering the resultant panel collapsible by providing suitable side rails such as of the type shown in FIG. 21.

Compressive Triangle

Figure 70:
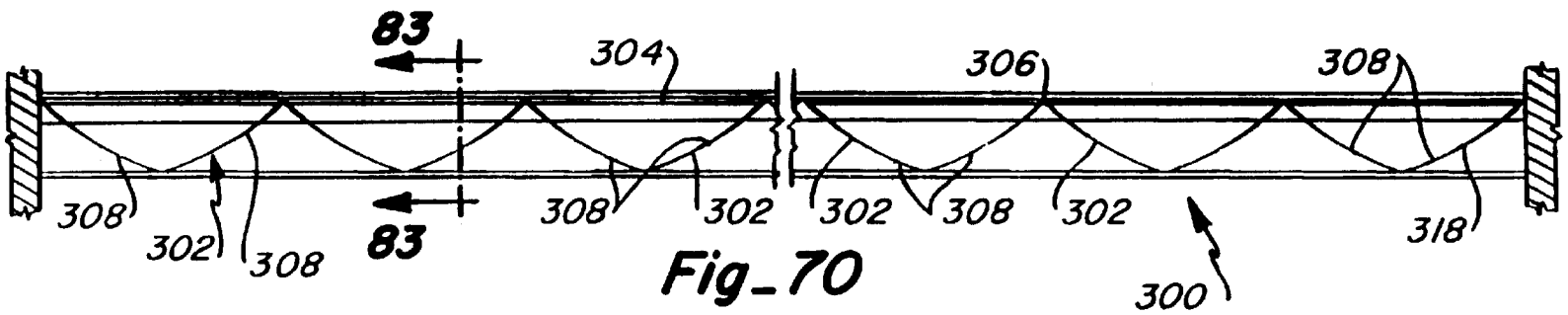
FIG. 70 is a fragmentary section taken along line 70—70 of FIG. 69.
Figure 76:
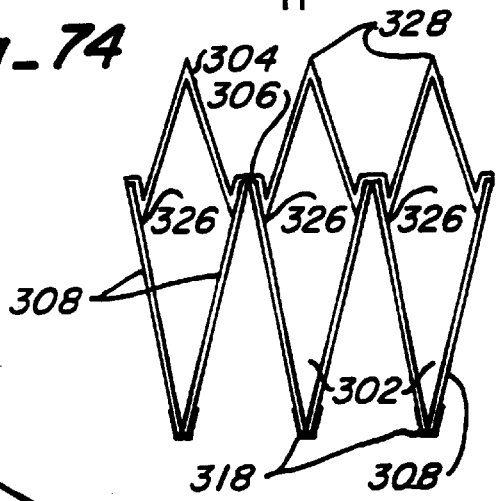
FIG. 76 is a view similar to FIG. 75 wherein the top backing sheet has been pleated so that upon folding as illustrated the top backing sheet folds upwardly away from the rigid strips.
Figure 78:
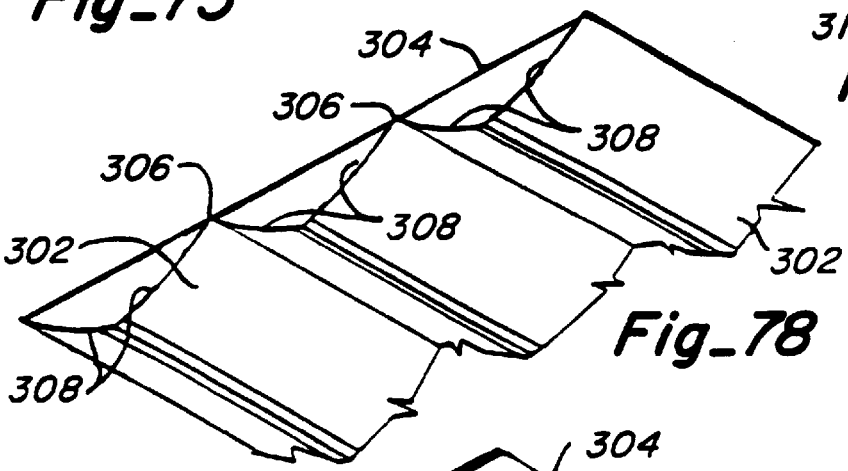
FIG. 78 is a view similar to FIG. 77 showing a portion of the panel from beneath the panel.
Figure 77:
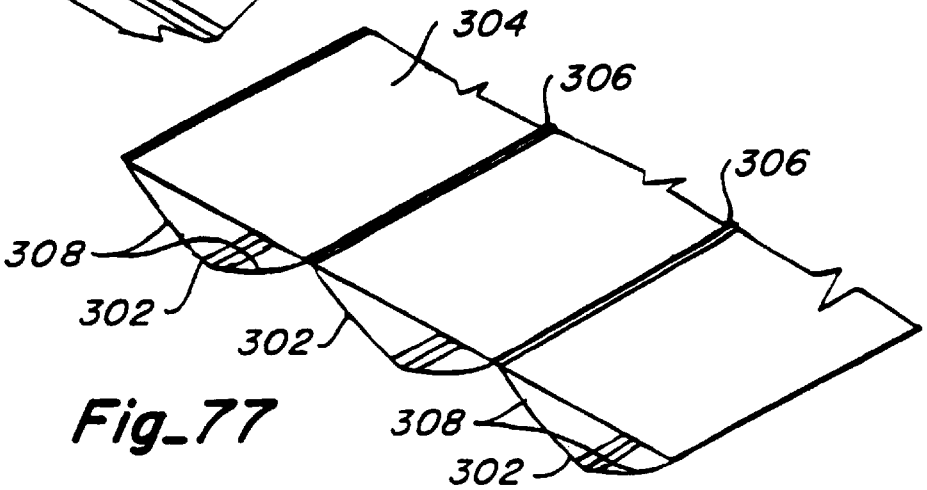
FIG. 77 is a fragmentary isometric showing a portion of the panel of FIG. 70 from above the panel.

In a third embodiment of the expandable and retractable ceiling panel of the present invention which might be referred to as the compressive triangle embodiment 302 illustrated in FIGS. 69–92, a panel 300, best seen in FIGS. 70, 77 and 78, is formed from a continuous backing sheet 304 that is interconnected along laterally extending longitudinally spaced lines 306 to a pair of depending rigid or semirigid slats 308. The backing sheet 304 is made of a flexible but substantially non-elastic material while the slats 308 may be formed of PVC, aluminum or other such material that will somewhat retain a preselected cross-sectional configuration when under lateral compression.

Figure 73:
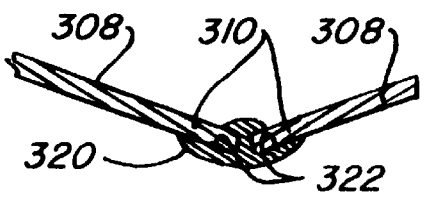
FIG. 73 is a view similar to FIG. 71 showing an alternative system for interconnecting the lower edges of the rigid strips.
Figure 71:
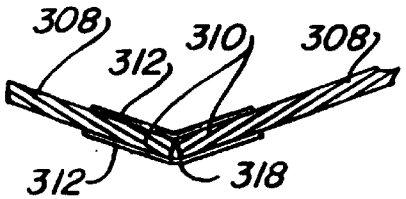
FIG. 71 is a fragmentary section showing the interconnection of the lower side edges of rigid strips used in the panel of FIG. 70.
Figure 72:
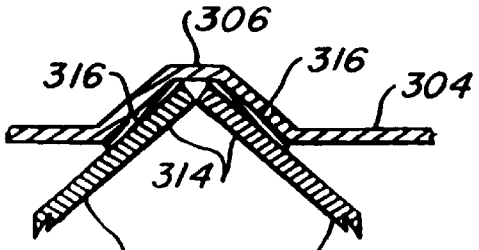
FIG. 72 is a fragmentary section showing the interconnection of the upper edges of the rigid strips used in the panel of FIG. 70.

As best seen in FIG. 71, the lower edges 310 of the rigid slats 308 are interconnected as with strips of adhesive tape 312 extended interiorally and exteriorally of the triangle 302 defined between two adjacent rigid strips 308 and the backing sheet 304. The opposite or uppermost edges 314 of the rigid slats are secured to the backing sheet 304, along with a similar edge 314 of an adjacent slat 308, with adhesive or double-faced adhesive tape 316 which, as possibly best seen in FIG. 72, secures the slats 308 to the backing sheet 304 along a slightly raised line 306 extending laterally of the backing sheet 304. The interconnection of the side edges 310 of the slats 309 to each other and to the backing sheet 304 form articulated or hinged joints 318 to facilitate folding or retraction of the ceiling panel 300. FIG. 73 in an alternate system of interconnection shows the lower edges 310 of the slats 308 being interconnected with an elongated rubber channel 320 which has notches 322 formed in opposite sides for receiving the edges 310 of the slats 308 and secures the edges together in an articulated relationship.

Figure 73B:
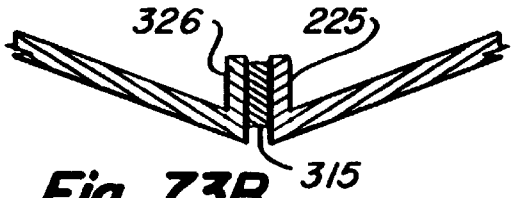
FIG. 73B is a view similar to FIG. 71 showing still another system of connecting the lower edges of the rigid strips.
Figure 73A:
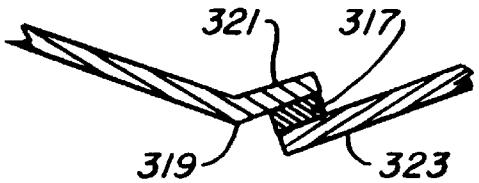
FIG. 73A is a view similar to FIG. 71 showing another alternative system for interconnecting the lower edges of the rigid strips.

In another alternative system for interconnecting slats 321 and 333 at the lower point of a triangular cell as shown in FIG. 73A, one slat 321 is folded or bent along an articulated line 319 and then bonded with adhesive 317 or the like to the other slat. Similarly, as shown in FIG. 73B in still another embodiment, the lower edges of each slat 325 and 326 are folded or bent and then subsequently bonded together with adhesive 315 to form the articulated lower point of a triangular cell.

Figure 74:
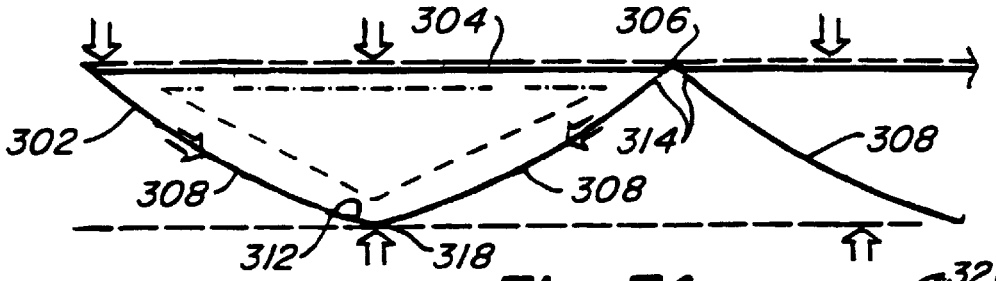
FIG. 74 is a fragmentary longitudinal section through the panel of FIG. 70 showing compression and tension arrows in the various components of a cell of the panel.
Figure 75:
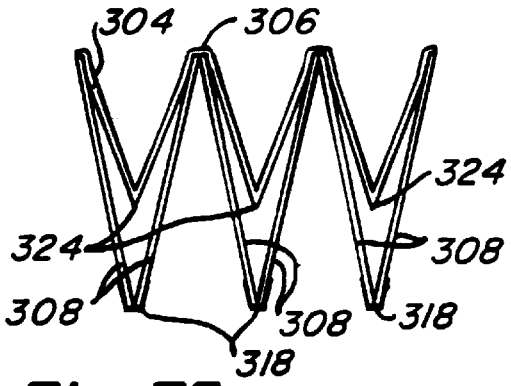
FIG. 75 is a fragmentary side view of a portion of the panel of FIG. 70 in a collapsed condition with the top backing sheet having been collapsed into the space between two rigid strips.

As will be appreciated, as the backing sheet 304 is expanded and placed in tension, as best illustrated in FIG. 74, the rigid slats 308 are placed in compression along their joint at the lowermost point 318 of the triangularly-shaped cells 302. However, when relieving the tension in the backing sheet 304 and due to the articulated interconnections 318 and 306 (FIG. 74) of the rigid slats 308, the backing sheet 304 can be folded between its connection with the rigid slats 304 thereby allowing the slats 308 to fold toward each other. The backing sheet 304 can be urged to fold between slats 308, if desired, by providing an inwardly directed pleat 324 in the backing sheet 304 in association with each cell as shown in FIG. 75, or urged to fold upwardly from the cell 302 by providing inwardly directed pleats 326 in the backing sheet 304 adjacent each edge of a cell and an outwardly directed pleat 328 in the center of each cell 302 as shown in FIG. 76. The folding, of course, would take place when retracting the panel 300 adjacent to the side of a ceiling structure. When expanding the panel 300, however, the backing sheet 304 is tensioned to form the compressive relationship between adjacent rigid slats 308 and the desired aesthetic appearance for the ceiling panel which is probably best illustrated in FIGS. 70, 77 and 78.

Figure 79:
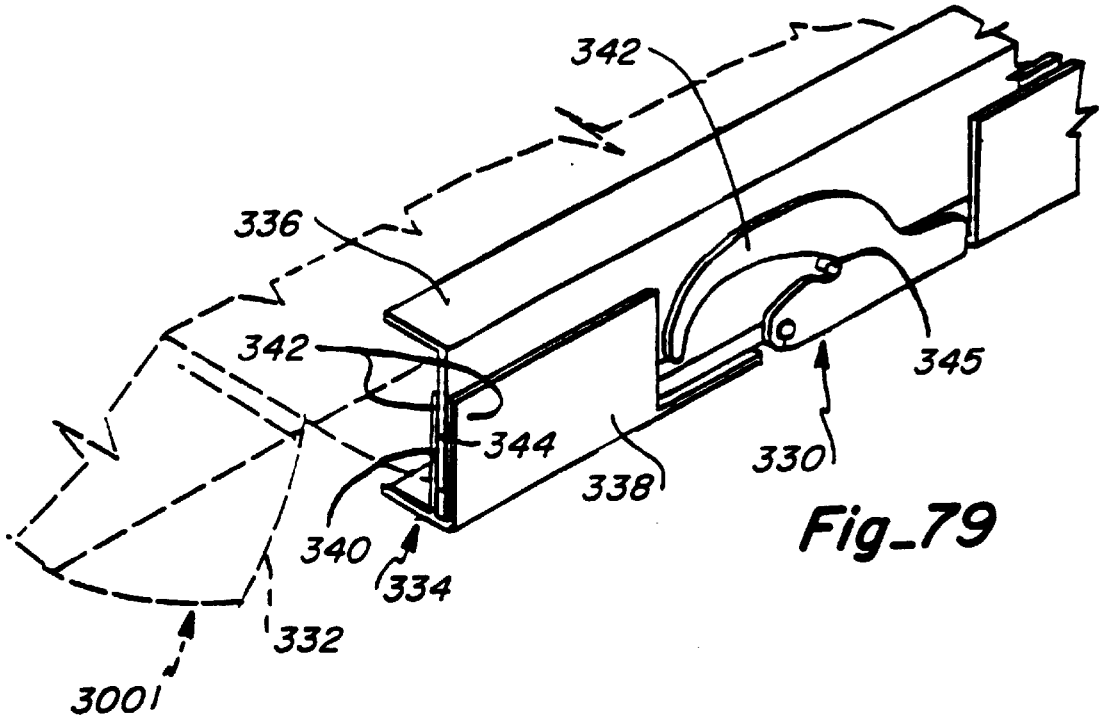
FIG. 79 is a fragmentary isometric showing a side rail for supporting the panel of FIG. 70 with portions of the panel being shown in dashed lines.

While the compressive triangle panel could be supported as described in connection with the honeycomb panel of FIGS. 1-28, the ceiling panel 300 would desirably be supported along opposite side edges 332 by a split rail clamp 330 probably best seen in FIG. 79. The split rail clamp 330 defines a vertically adjustable somewhat C-shaped channel 334 to support a longitudinal side edge 332 of the ceiling panel 300. The clamp 330 itself has an upper inverted L-shaped component 336 and a lower generally L-shaped component 338. The lower component 338 has an upwardly opening channel 340 between two side leg segments 342. The upwardly opening channel 340 slidably receives a vertical leg 344 of the inverted L-shaped component 338 so that the inverted L-shaped component 336 is vertically moveable within the channel 340.

Figure 80:
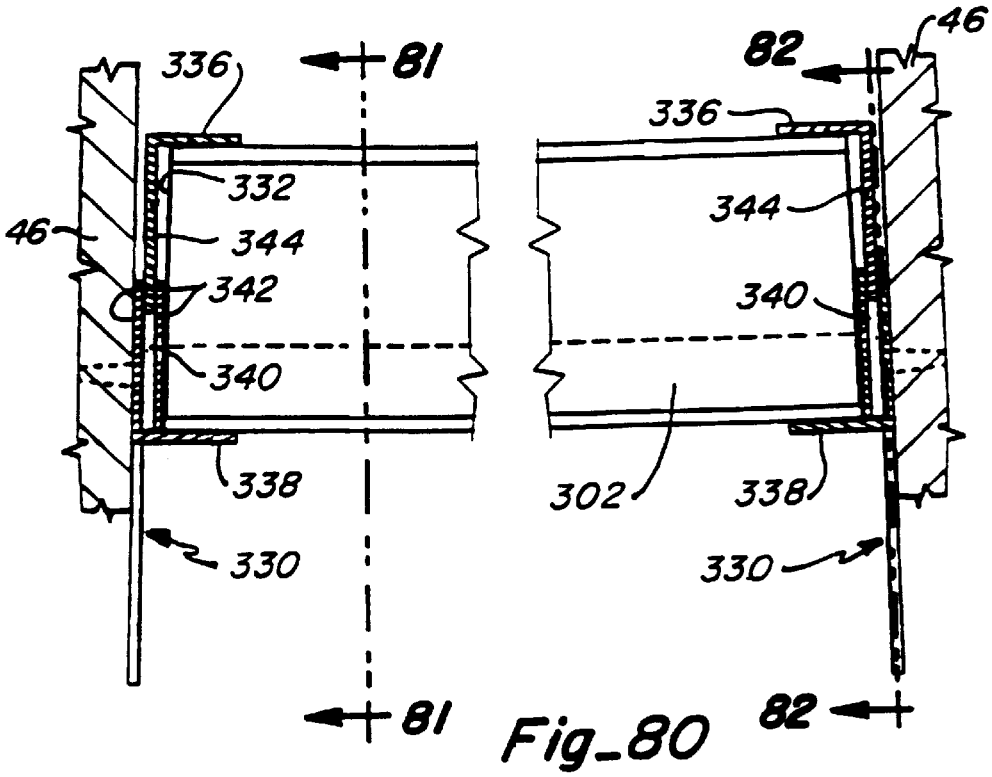
FIG. 80 is a fragmentary transverse section showing the side support rails at opposite sides of a panel of the type illustrated in FIG. 70.
Figure 81:
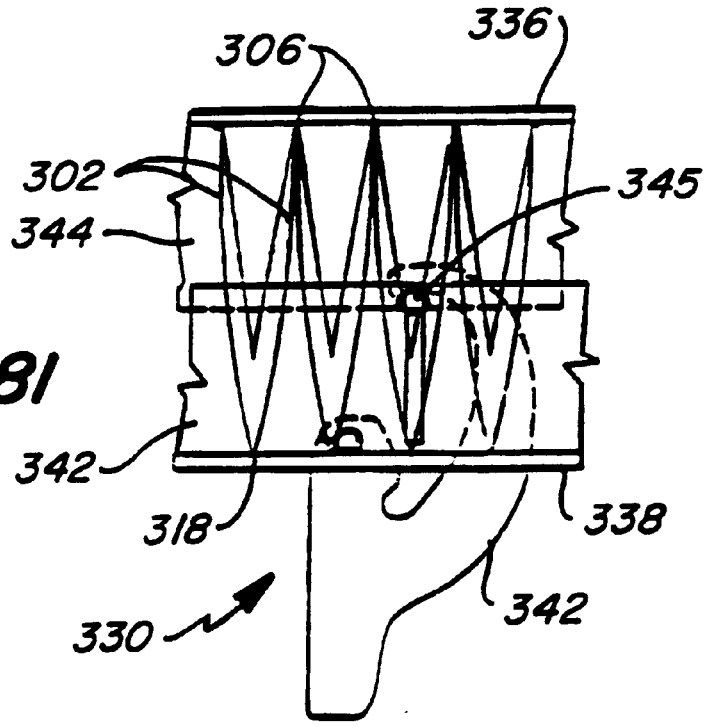
FIG. 81 is a side elevation showing the side rail of FIG. 79 in an vertically expanded condition.
Figure 82:
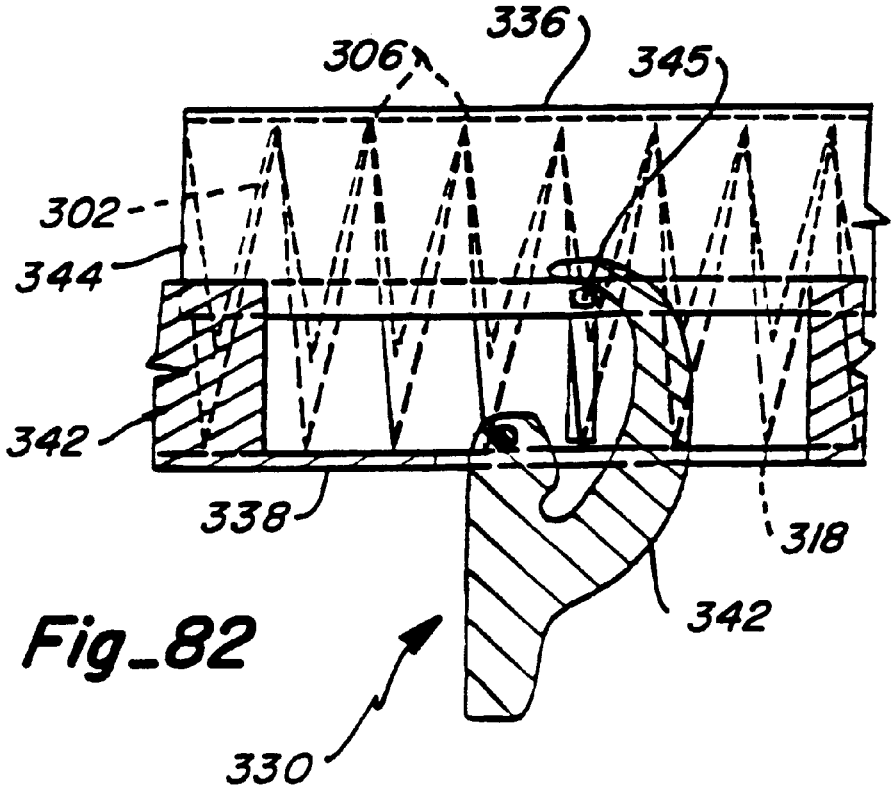
FIG. 82 is a sectional view similar to FIG. 81 again showing a side rail in a vertically expanded condition.
Figure 83:
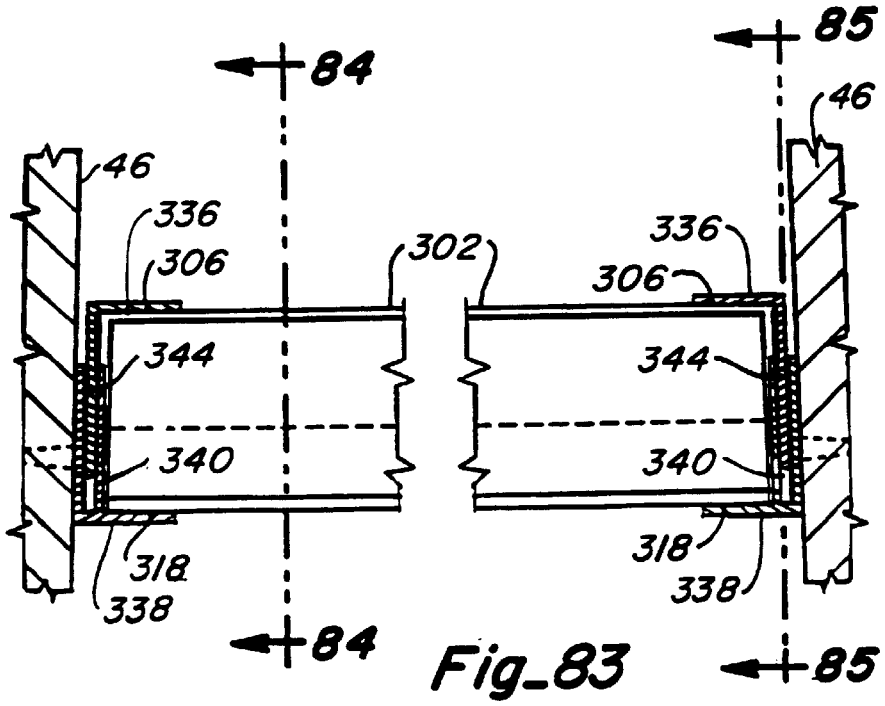
FIG. 83 is a sectional view similar to FIG. 80 with the side rail in a retracted condition.
Figure 84:
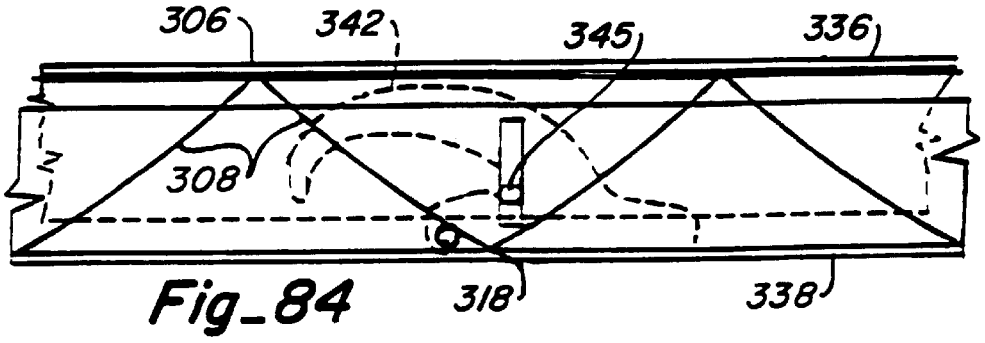
FIG. 84 is a view similar to FIG. 81 wherein the side rail is in a retracted condition.
Figure 85:
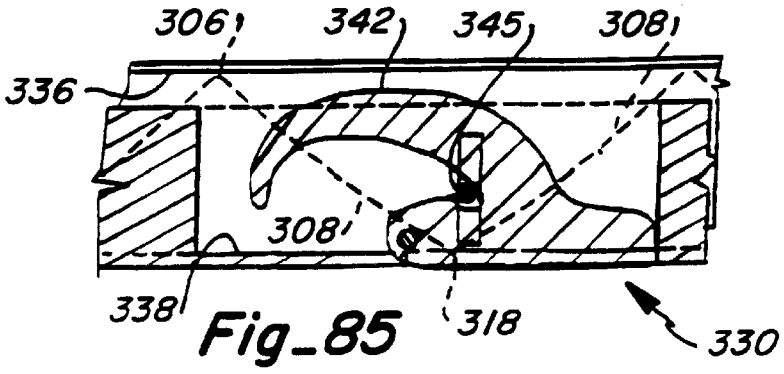
FIG. 85 is a view similar to FIG. 82 wherein the side rail is in a retracted position.

At selected intervals along the length of the side supports 334, the upwardly opening channel 340 is interrupted and a pivotally supported claw hook 342 is connected to the base of the L-shaped component 338. A peg 345 is similarly provided on the inverted L-shaped segment 338 and cooperates with the hook 342 such that pivotal movement of the hook 342 in a counterclockwise direction as viewed in FIG. 79 will draw the inverted L-shaped component 336 downwardly thereby compressing the rigid slats 308 and tensioning the backing sheet 304. Reverse pivotal movement of the claw-shaped hook 342 will allow the inverted L-shaped 336 component to move upwardly to release the compression and allow the ceiling panel 300 to be folded or collapsed as illustrated in FIGS. 80 through 82. The compressed position of the claw-shaped hook is shown in FIGS. 79 and 83 through 85.

As will be appreciated, the compressive triangle embodiment 302 of the present invention allows the panel 300 to be moved from the expanded position wherein the rigid slats 308 are compressed against each other along their lower edges 310 and the backing sheet 304 is held in tension to a collapsed or folded position wherein the rigid slats 308 move toward each other and the backing sheet 44 is non-tensioned and actually collapses into or above the space between adjacent rigid slats 308.

FIGS. 86 through 92 illustrate various slat configurations for use in the compressive triangle embodiment 302 and as will be appreciated each functions in substantially the same way by providing tension in the backing sheet 304 and compression in the rigid slats 308 to obtain the desired structural characteristics while enabling various aesthetics.

Figure 86:
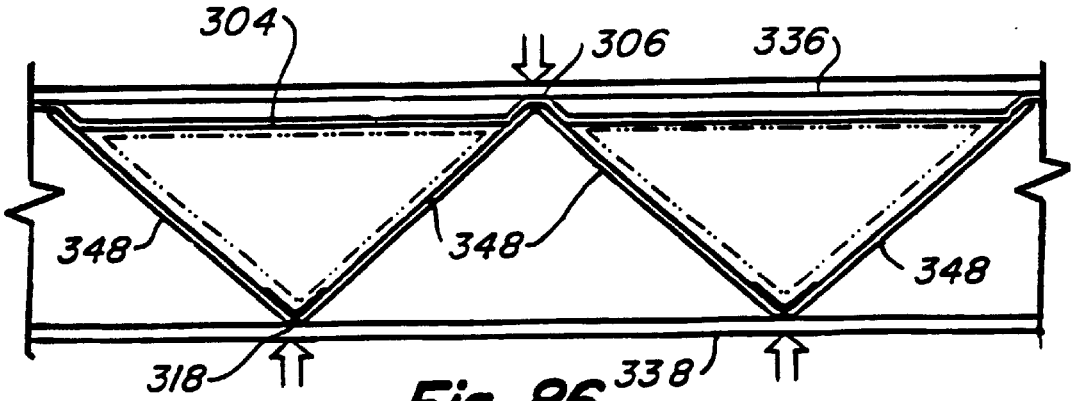
FIG. 86 is a view similar to FIG. 74 showing an alternative arrangement of the compressive triangle embodiment wherein the rigid strips are flat and planar in configuration.
Figure 87:
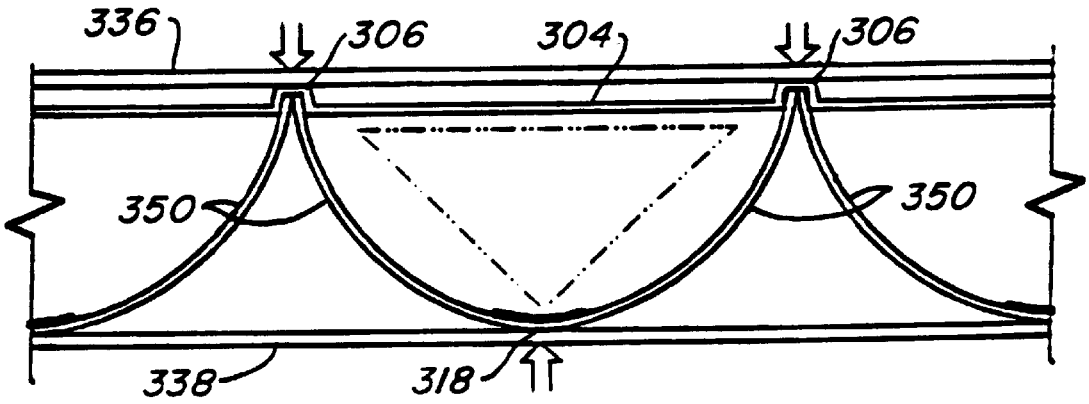
FIG. 87 is a view similar to FIG. 86 wherein the rigid strips are arcuate in transverse cross-section and downwardly convex.
Figure 88:
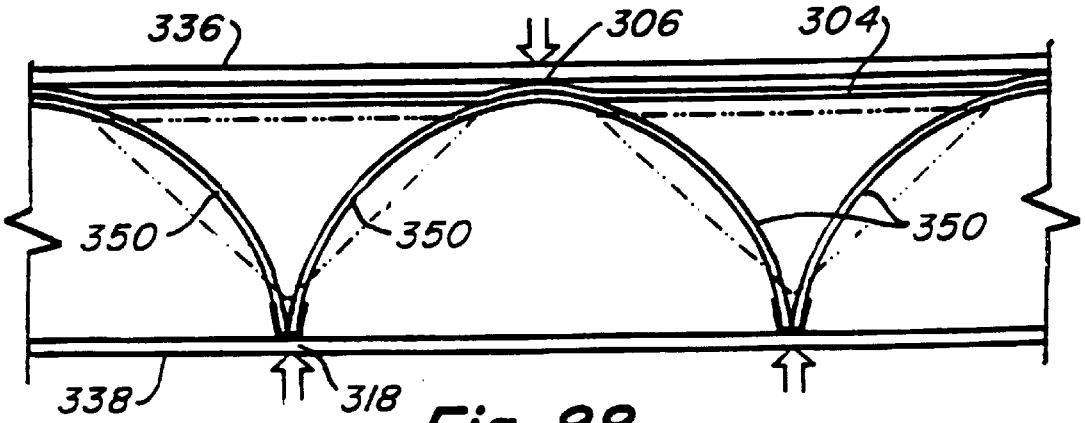
FIG. 88 is a view similar to FIG. 87 wherein the strips are arcuate in cross-section and downwardly concave.
Figure 89:
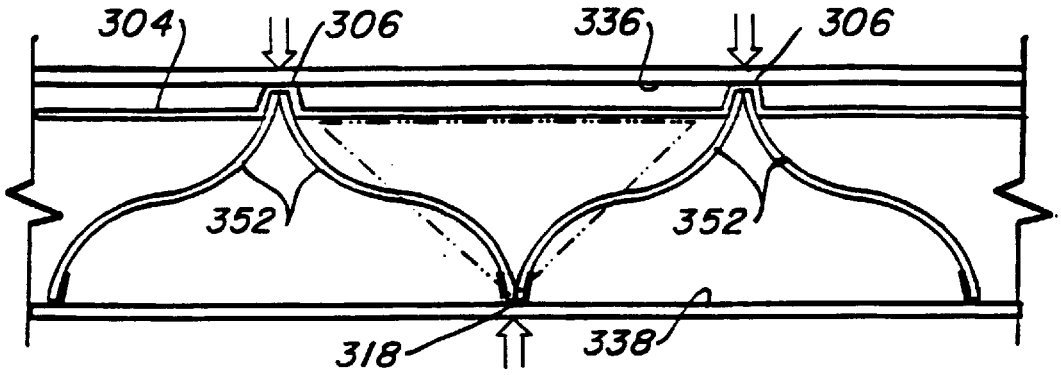
FIG. 89 is a view similar to FIG. 86 wherein the rigid strips are substantially S-shaped configuration and downwardly concave.
Figure 90:
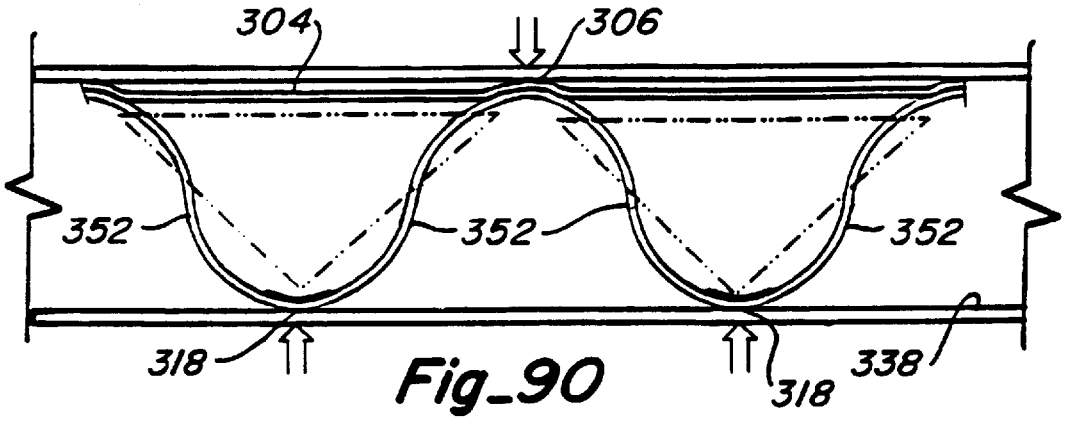
FIG. 90 is a view similar to FIG. 89 wherein the rigid strips are generally S-shaped configuration and downwardly convex.
Figure 91:
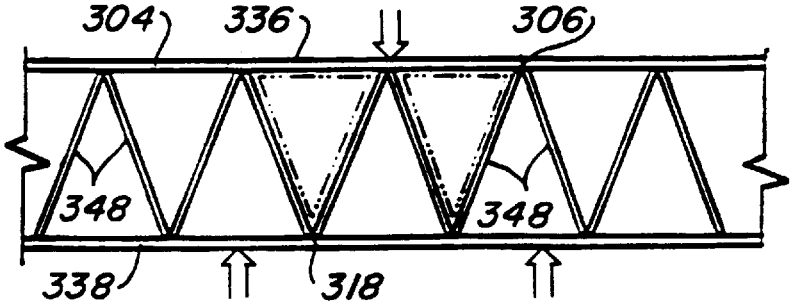
FIG. 91 is a view similar to FIG. 89 wherein the flat planar rigid strips have been positioned at a different angular orientation relative to each other than as shown in FIG. 86.
Figure 92:
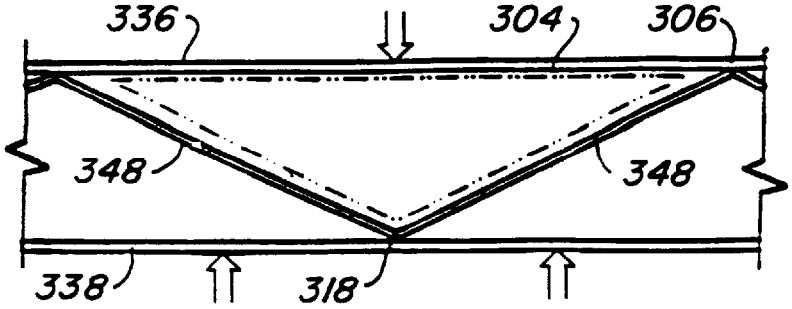
FIG. 92 is a view similar to FIG. 86 wherein the rigid flat planar strips are positioned at a still different angular position.

FIG. 86 illustrates slats 348 which are flat and planar in cross-section with FIGS. 87 and 88 showing arcuate slats 350 that are downwardly convex and downwardly concave respectively. FIGS. 89 and 90 show S-shaped panels 352 that are downwardly convex and downwardly concave, respectively. FIGS. 91 and 92 illustrate the use of flat planar slats 348 that are spaced closer than and greater than respectively, for example, the flat planar slat 348 of FIG. 86 which as can be appreciated still gives desired structural rigidity but with different aesthetics.

Figure 93:
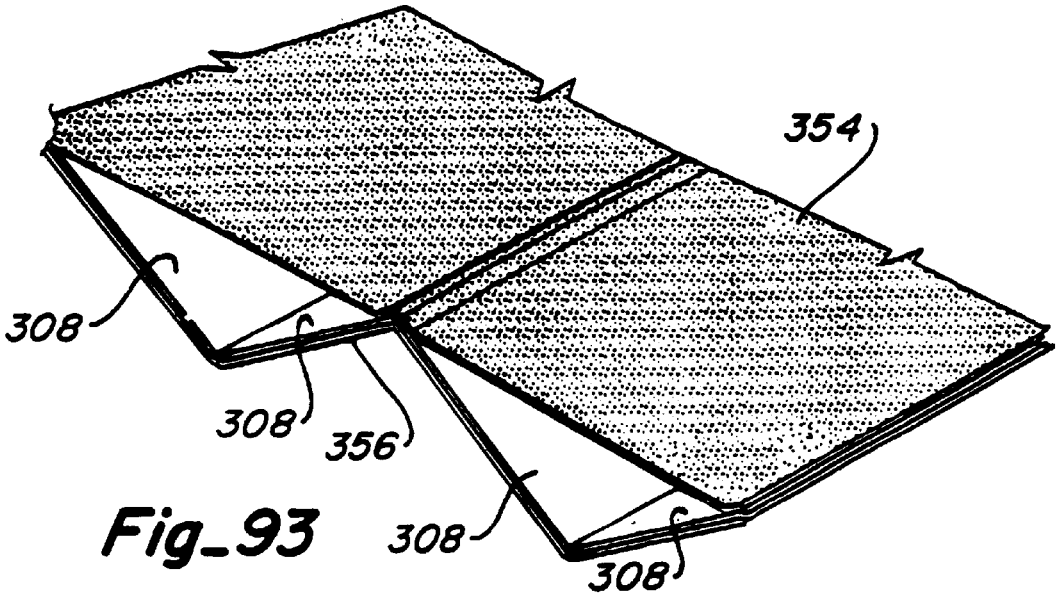
FIG. 93 is a fragmentary isometric looking down on a compressive triangle embodiment of the panel wherein the rigid strips are laminated.
Figure 94:
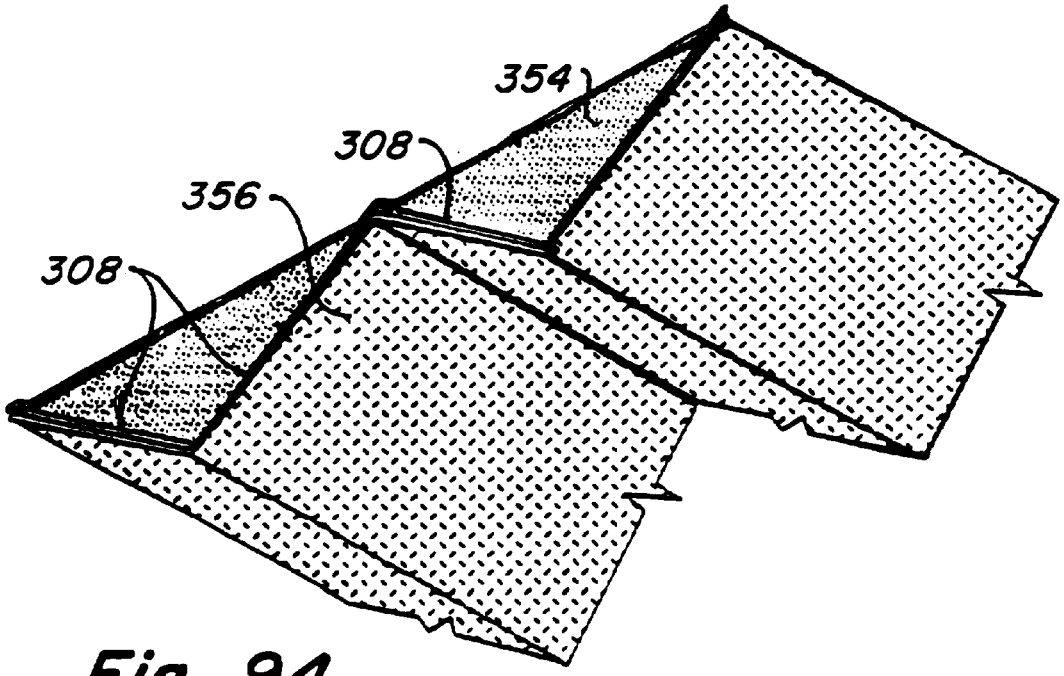
FIG. 94 is a fragmentary isometric similar to FIG. 93 looking at the panel from the underside.

FIGS. 93 and 94 show an additional arrangement of the compression triangle embodiment wherein the backing sheet 354 is similar to the backing sheet used in prior embodiments but wherein the rigid slats 308 have a cloth or fabric laminate 356 on their exposed face to provide a different aesthetic than the rigid panel itself. Obviously, the laminated cloth could provide a soft appearance or other materials such as aluminum foil or the like could provide a more stark or even reflective appearance.

The compressive triangle embodiment 302, while having been described as a ceiling panel 300, might also work as a collapsible wall, such as of the type used to divide conference rooms, inasmuch as the panel 300 has a great deal of structural rigidity and yet can be expanded and collapsed in a simple manner. Rails or tracks for retracting the panel when used as a collapsible wall would be apparent to those skilled in the art.

Tension Triangle

Figure 96:
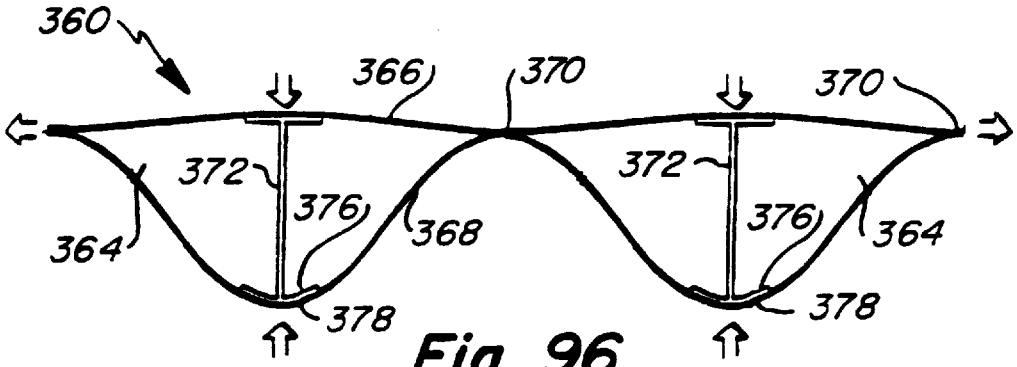
FIG. 96 is a longitudinal section taken through the panel of FIG. 95 illustrating the two sheet-like layers of material and the struts in each cell separating the layers.
Figure 97:
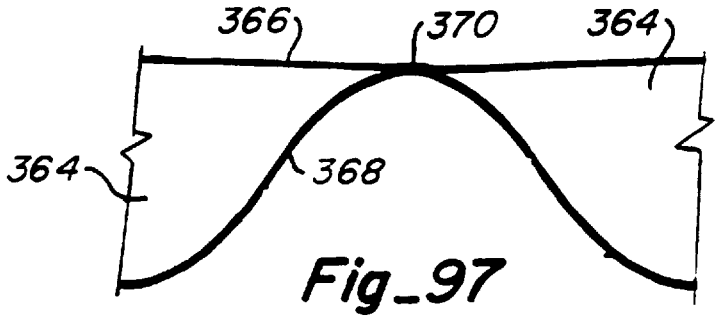
FIG. 97 is a fragmentary section showing the interconnection of the sheets of material shown in FIG. 96.

A fourth embodiment 360 of the ceiling panel of the present invention which might be referred to as the tension triangle embodiment 360 is shown in FIGS. 95 through 108. One arrangement shown in FIGS. 95 through 97 shows that generally triangularly-shaped cells 364 are defined by a backing sheet 366 of flexible material and a facing sheet 368 of flexible material interconnected with the backing sheet at longitudinally-spaced laterally extending locations 370, and a rigid support or truss 372 separating the backing sheet 366 from the facing sheet 368 at locations intermediate and parallel to the interconnection 370 between the two sheets 366 and 368.

Figure 95:
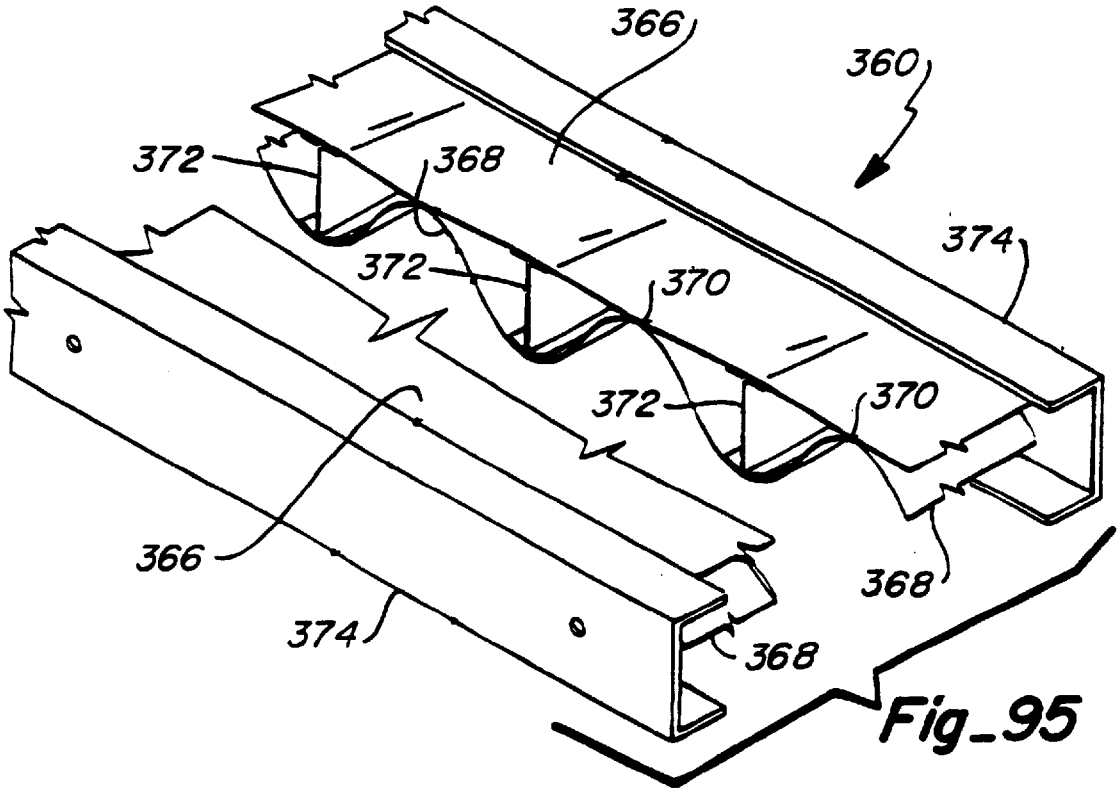
FIG. 95 is a fragmentary isometric showing a tension triangle embodiment of the present invention.

Looking first at FIG. 95, a panel 362 formed in accordance with this embodiment can be seen supported along opposite side edges by U-shaped channels 374 laid on their side. As mentioned previously, both the backing sheet 366 and the facing sheet 368 are made of flexible material even though the weight and stiffness of that material might vary for different aesthetics. The interconnection 370 of the facing sheet to the backing sheet is preferably accomplished with a suitable adhesive so as to define substantially triangularly shaped cells between lines of attachment. The facing sheet 368 has a greater length of material between lines of attachment so that it droops downwardly from the backing sheet 366. A predetermined spacing between the facing sheet and the backing sheet is maintained with the rigid support or truss 372. The truss 372 in the embodiment shown in FIGS. 95 and 96 can be seen to be of I-shaped configuration with the lower horizontal leg 376 of the truss 372 either being preformed in an arcuate configuration to encourage a smooth contour 378 in the underlying facing sheet 368 or can be flexible enough to naturally flex with the facing sheet 368 material which extends therearound. The truss 372 can be made of a rigid or a somewhat semirigid material with it only being important that it retain the desired spacing between the backing sheet 366 and the facing sheet 368 within each cell. A PVC material or even a somewhat rigid paper or cardboard would be suitable for use as the truss material.

It will be appreciated that depending upon the flexibility of the material used for the backing sheet 366 and the facing sheet 368, the ceiling panel 362 can be collapsed or folded by sliding along the side support rails 374 but if one or the other of the backing sheet 366 or facing sheet 368 were made of a material that was not easily flexed, the degree of folding or collapsing of the panel would be diminished.

Figure 98:
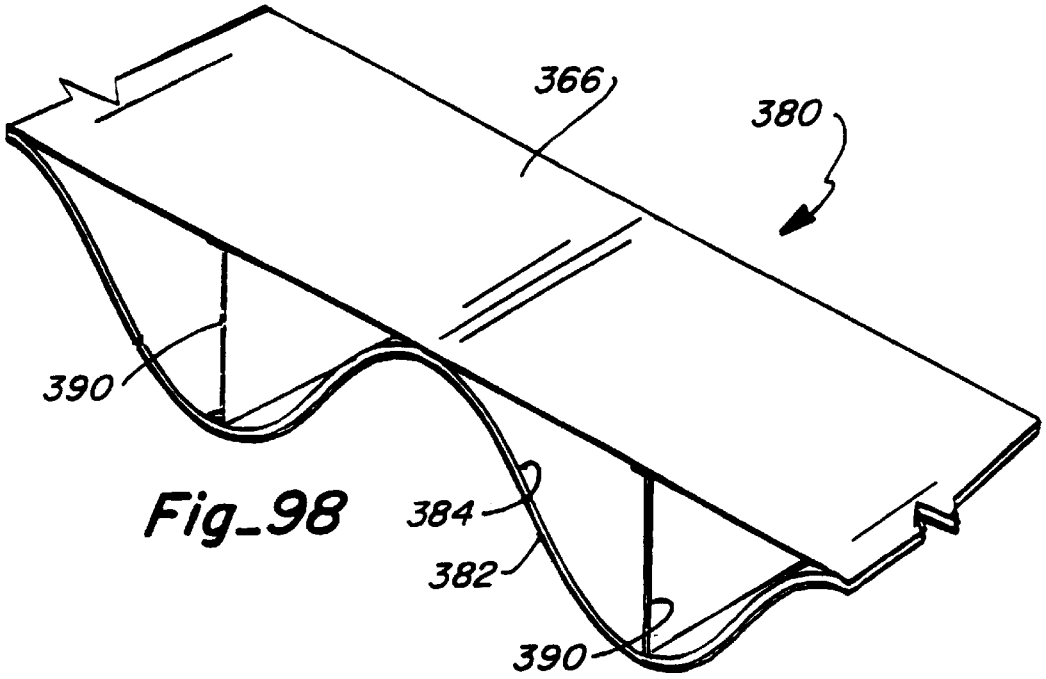
FIG. 98 is a fragmentary isometric showing a different arrangement of the tension triangle panel of the present invention.
Figure 99:
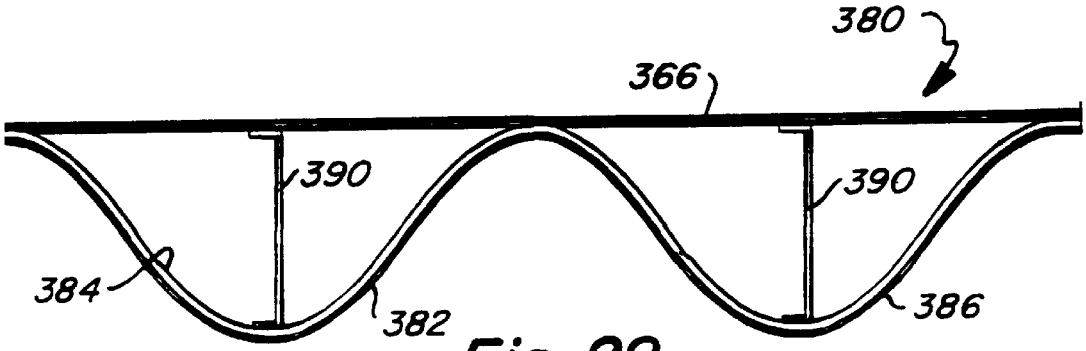
FIG. 99 is a side elevation of the panel shown in FIG. 98.
Figure 100:
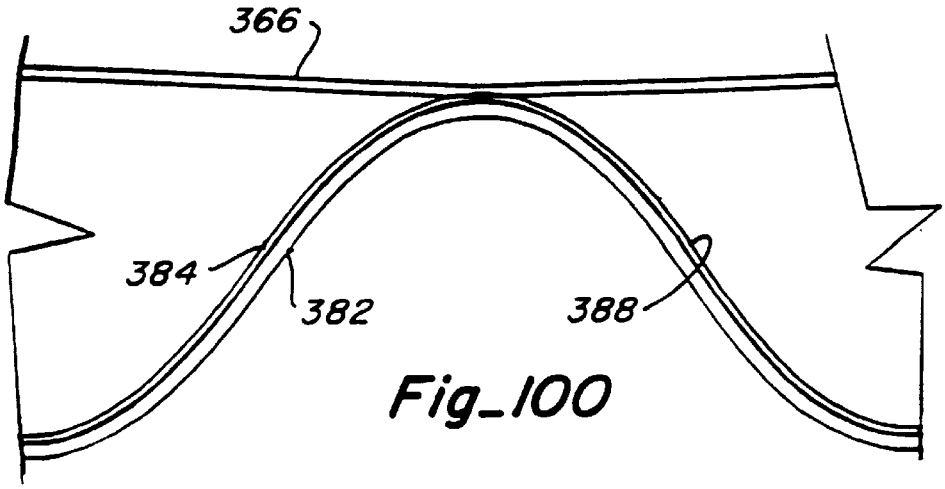
FIG. 100 is an enlarged fragmentary side elevation showing the interconnection of the sheets used to form the panel of FIG. 98.

FIGS. 98 through 100 illustrate a second arrangement 380 of the tension triangle embodiment wherein the facing sheet 382 is shown as a laminate which might be used either for structural or aesthetic purposes. For example, the inner layer 384 of the laminate may be a relatively heavy material that is not as easily flexed but which possibly does not give a soft aesthetic appearance to the interior of the room in which the ceiling panel 380 is mounted as might be desired. Accordingly, a softer material 386 would be laminated to the outer face of the facing sheet to obtain the desired aesthetics. The opposite could also be true, if a softer and more readily foldable panel was desired, the inner layer 388 of the facing sheet might be a softer or more readily flexed material while the outer sheet 386 might be an aluminum foil or the like which gave a colder or harsher appearance to the interior of the room. Obviously many variations of laminates are available to obtain desired structural and aesthetic goals. The truss 390 or rigid support utilized in the arrangement shown in FIGS. 98 through 100 is also slightly different in that it is substantially C-shaped in cross section rather than I-shaped as in the first described arrangement of FIGS. 95 through 97.

Figure 101:
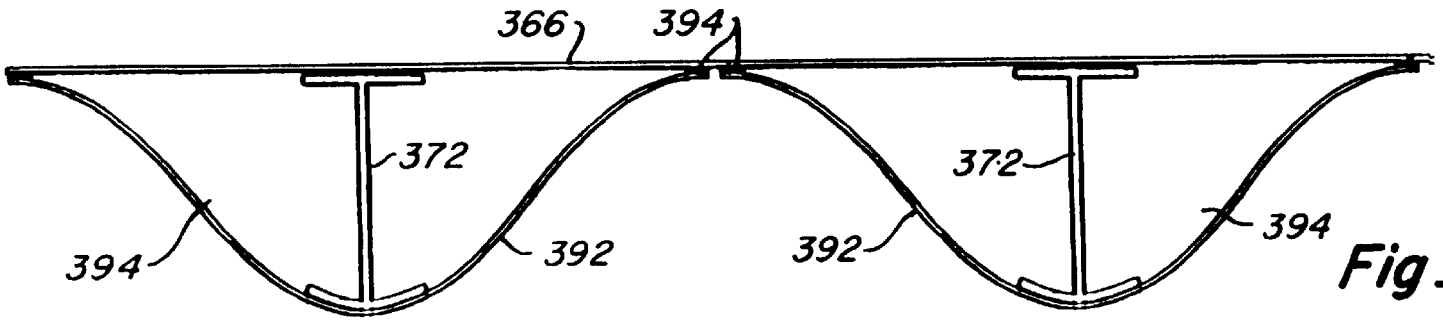
FIG. 101 is a side elevation of a still further arrangement of the tension triangle embodiment of the present invention.

FIG. 101 illustrates an arrangement of the tension triangle embodiment wherein the backing sheet 366 is a continuous sheet but the facing sheet 392 consists of a plurality of individual strips bonded to the backing sheet at predetermined intervals 394 so that the facing sheet 392 is interrupted between adjacent cells 394. The trusses 372 are illustrated as being identical to those shown in the first arrangement 360 of FIGS. 95 through 97 but other variations of the truss 372 could also be utilized.

Figure 102:
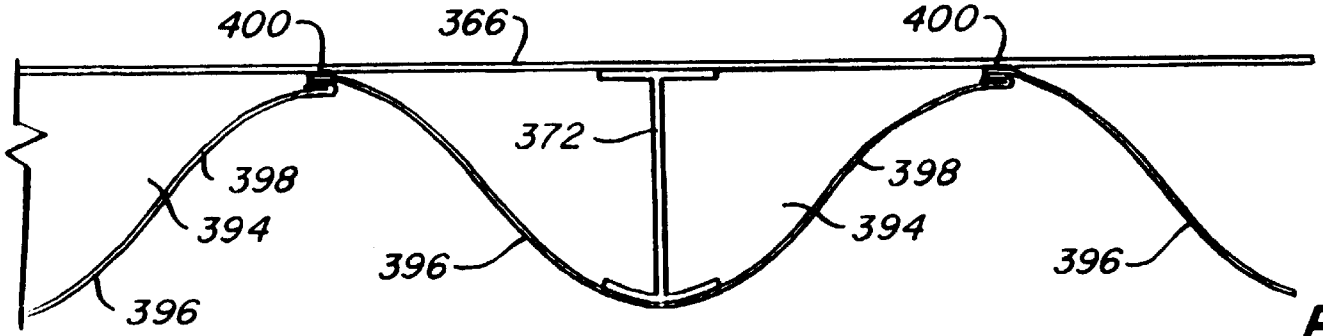
FIG. 102 is a side elevation of a still further arrangement of the tension triangle embodiment of the present invention.

FIG. 102 shows still another arrangement of the tension triangle embodiment 362 wherein individual strips 396 of facing sheet material are utilized to form the facing sheet but they are bonded to the backing sheet 366 in overlapped relationship as at 400 so that there are no gaps between cells 394 as in the arrangement of FIG. 101. Again, the truss 372 or rigid support might be substantially I-shaped in cross section as with the arrangement shown in FIG. 101.

Figure 103:
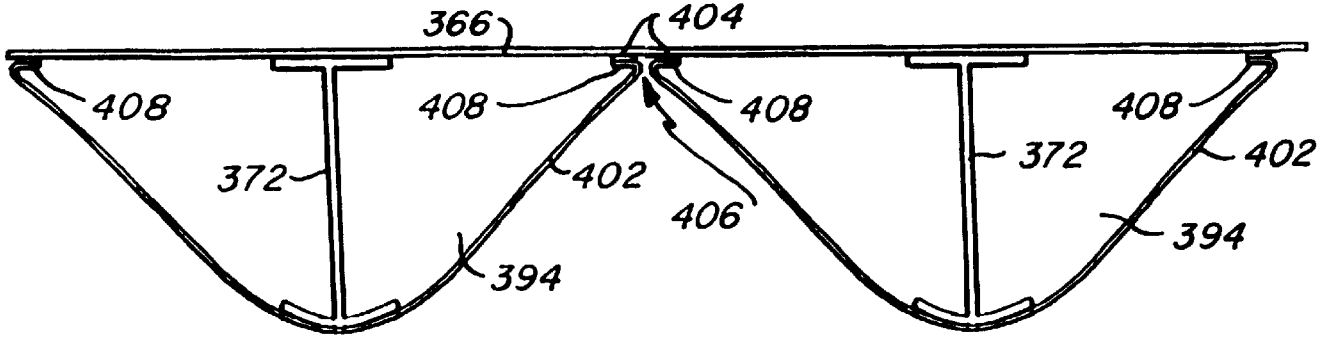
FIG. 103 is a side elevation of another arrangement of the tension triangle embodiment of the present invention.
Figure 104:
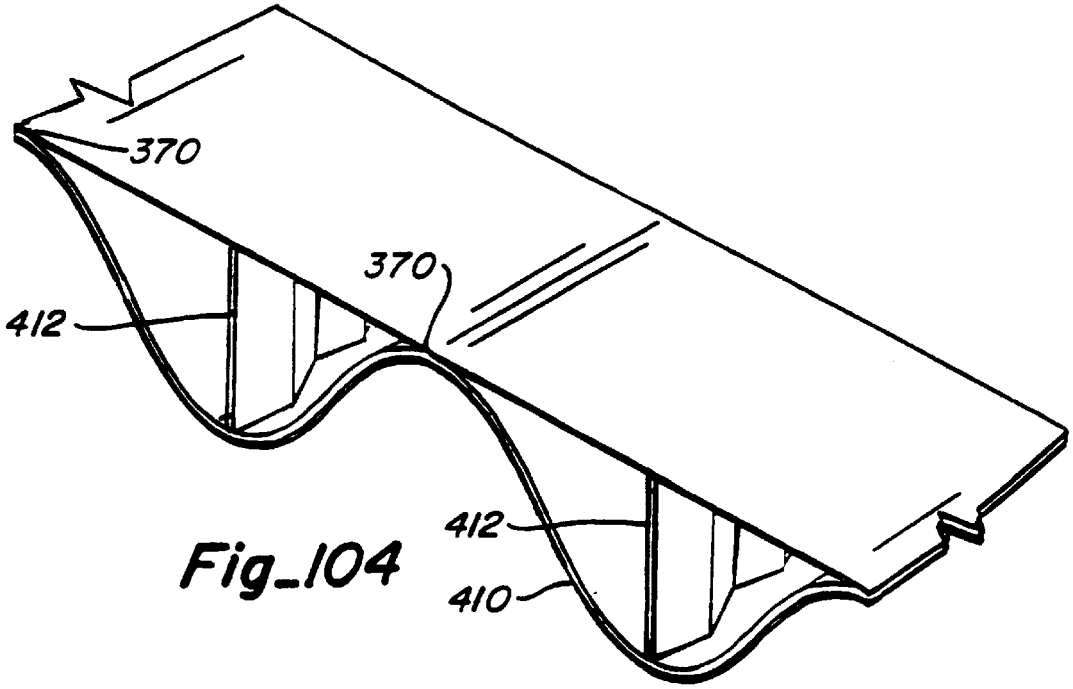
FIG. 104 is a fragmentary isometric of another arrangement of the tension triangle embodiment the present invention.
Figure 105:
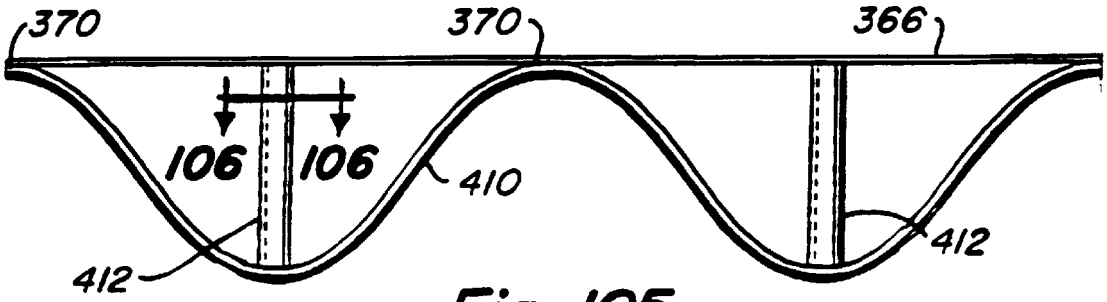
FIG. 105 is a side elevation of the arrangement shown in FIG. 104.
Figure 106:
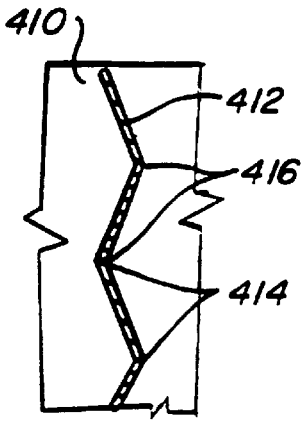
FIG. 106 is a section taken along line 106—106 of FIG. 105.
Figure 107:
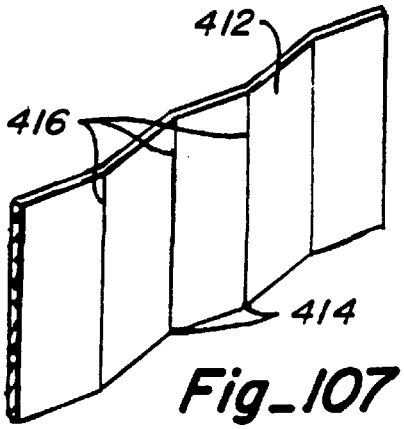
FIG. 107 is an isometric of the strut used in the arrangement shown in FIG. 104.

Still another arrangement of the tension triangle embodiment 362 is shown in FIG. 103 wherein individual strips 402 of facing sheet material are bonded to the backing sheet at spaced intervals 404 to define gaps 406 between cells 394 but the strips 402 are bonded on in-turned or folded edges 408 so as to give a different appearance than would be obtained with the arrangement of FIG. 101. Again, the rigid support or truss 372 is illustrated in an I-shaped cross section but alternative arrangements of the truss would again be available.

FIGS. 104 through 107 illustrate a further arrangement of the tension triangle embodiment wherein the facing sheet 410 is again illustrated as a continuous laminate that is connected at spaced intervals 370 to the backing sheet 366 similarly to the arrangement shown in FIGS. 98 through 100. The facing sheet 410 would not have to be a laminate, however, nor would it have to be a continuous sheet, but rather the distinguishing feature between the arrangement shown in FIGS. 104 through 107 and the prior disclosed arrangements resides in the fact that the truss 412 is a corrugated plate that is formed by reverse bends 414 at predetermined spacings so as to form vertical fold lines 416 in a corrugated truss. Such a structural arrangement of the truss 412 gives more rigidity than a straight plate-like truss as disclosed in the aforedescribed arrangements of the tension triangle embodiment.

It should be appreciated that with each of the aforenoted arrangements of the tension triangle embodiment, the truss 372 is desirably adhesively or otherwise bonded to the backing sheet and the face sheet so as to retain its position within an associated cell 364 of the ceiling panel.

Figure 108:
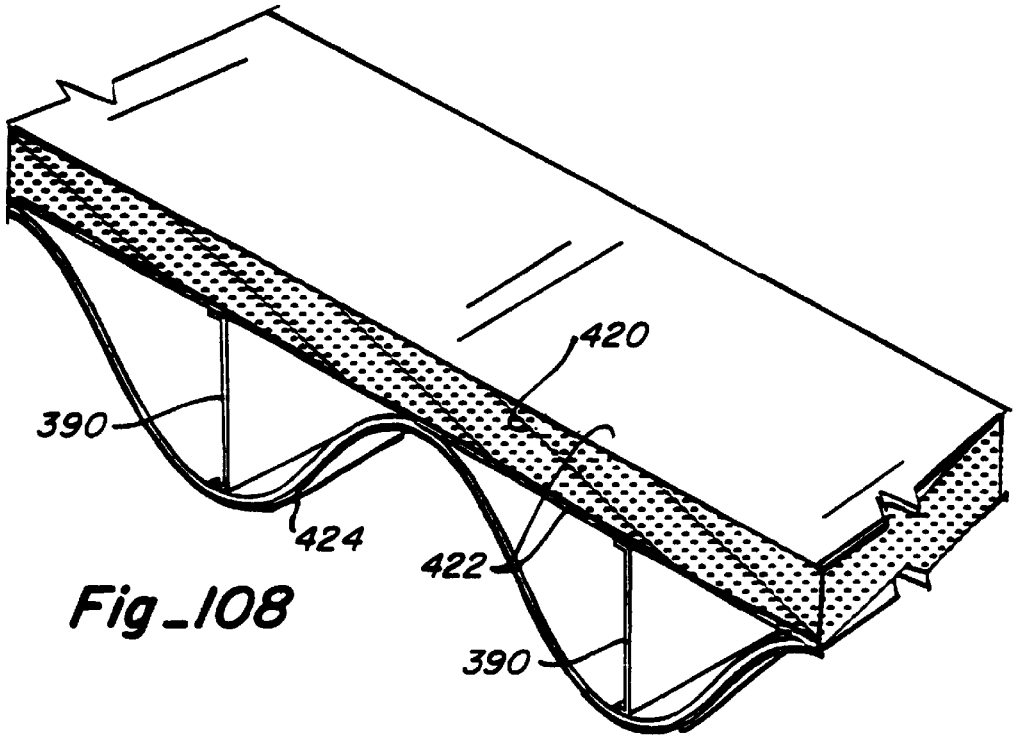
FIG. 108 is a fragmentary isometric of another arrangement of the tension triangle embodiment having an insulative or sound absorbing layer.
Figure 109:
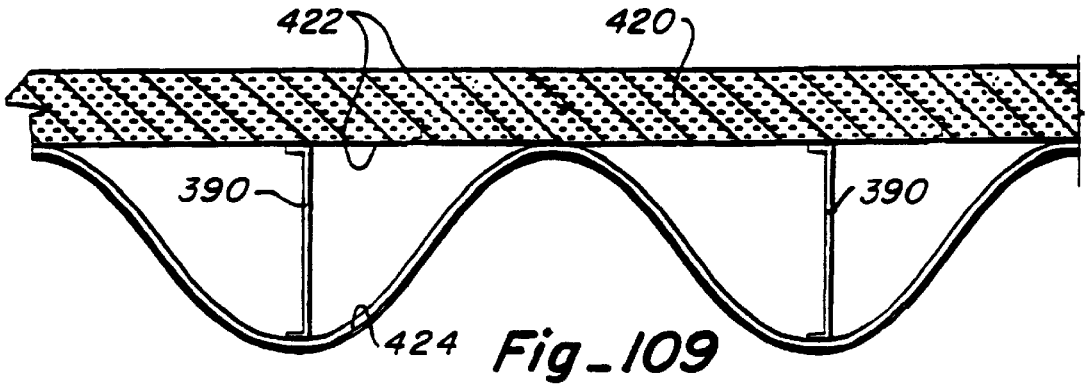
FIG. 109 is a side elevation of the arrangement shown in FIG. 108.

A final arrangement of the tension triangle embodiment is shown in FIGS. 108 and 109 wherein the facing sheet 420 is again shown as a laminated sheet but could be a single layer and the trusses 390 are generally of C-shaped cross-section but the backing sheet 420 is in fact a layer of sound deadening or insulating material such as foam rubber, cotton batting or the like. The insulating material 420 would desirably have outer layers 422 of a material which would be more suitable than the insulation or sound deadening material itself for bonding of the facing sheet 424 and the trusses 390 thereto.

Rigid Panel

Figure 110:
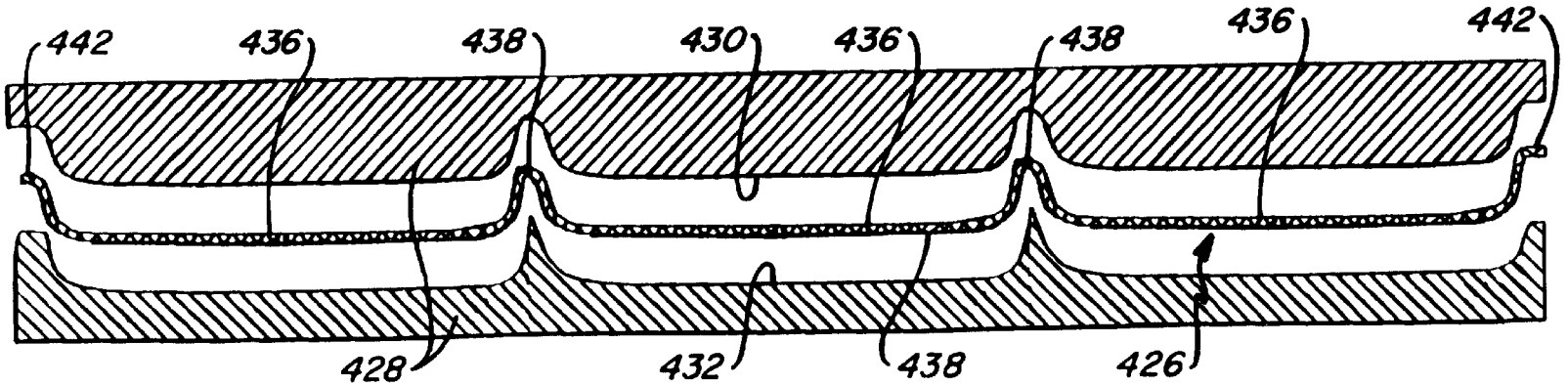
FIG. 110 is a transverse section taken through a compressive mold and a rigid panel formed thereby in a rigid panel embodiment of the present invention.
Figure 111:
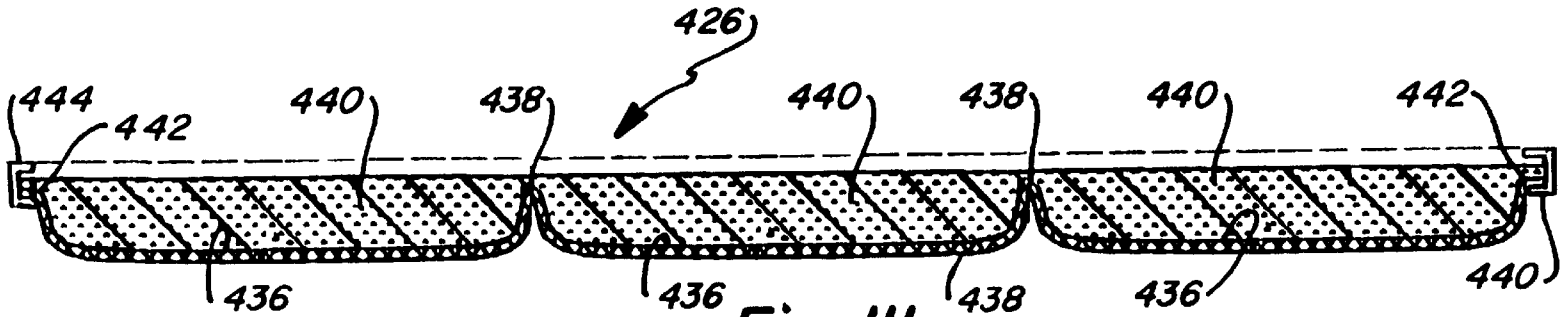
FIG. 111 is a transverse section showing the rigid panel of FIG. 110 having been joined with insulating or sound-absorbing material in cells defined thereby.
Figure 112:
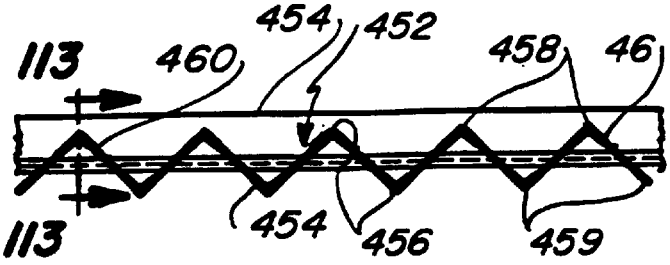
FIG. 112 is a fragmentary longitudinal section taken through a pleated panel embodiment of present invention.
Figure 113:
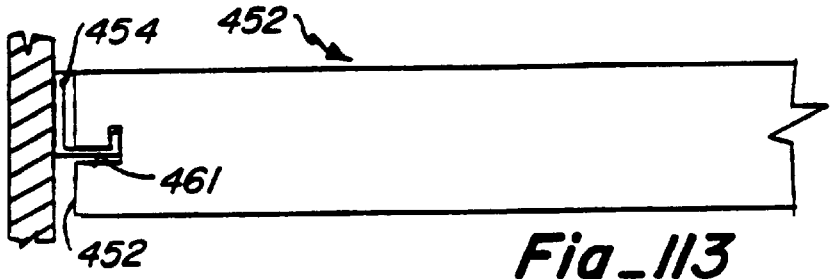

A ceiling panel that is somewhat structurally different from the prior described embodiments but has a similar appearance might be referred to as a rigid panel embodiment 426 and is shown in FIGS. 110 and 111. FIG. 110 illustrates a pressure mold 428 having male 430 and female 432 components having formed therebetween a plastic panel 434 defining a plurality of elongated cells 436. The panel 434 could be formed of any suitable material and while it might be metallic, it might also be a polyethylene plastic or the like. The advantage in such a panel resides in the fact that the pleats 438 are preformed and do not need to be adhesively formed or clipped. Further, the cells 434 so defined can be filled with a sound absorbing or insulating material 440 as shown in FIG. 111 and the sheet 434 of preformed material can be perforated as desired to improve the sound absorptive characteristics of the ceiling panel 426. The panel 426 would have preformed therein laterally extending lips 442 which could be supported in side rails 444 for easy installation of the panel 426.

Pleated Panel

A pleated panel embodiment of the present invention is illustrated in FIGS. 112–123 with a first arrangement of the panel 452 of the pleated embodiment being seen in FIGS. 112–115. It will be appreciated that the panel 452 is fabricated from a continuous sheet of material having pleats or sharp folds 456 formed across its width which are parallel with each other and alternating in direction. In other words, one pleat 458 will be directed upwardly while the next adjacent pleat 459 will be directed downwardly so as to define a plurality of planar sections 460 of the panel which are articulated along the pleats. The panel is, therefore, accordion-like in appearance so as to be expandable and collapsible by articulating adjacent segments along the pleats.

Figure 114:
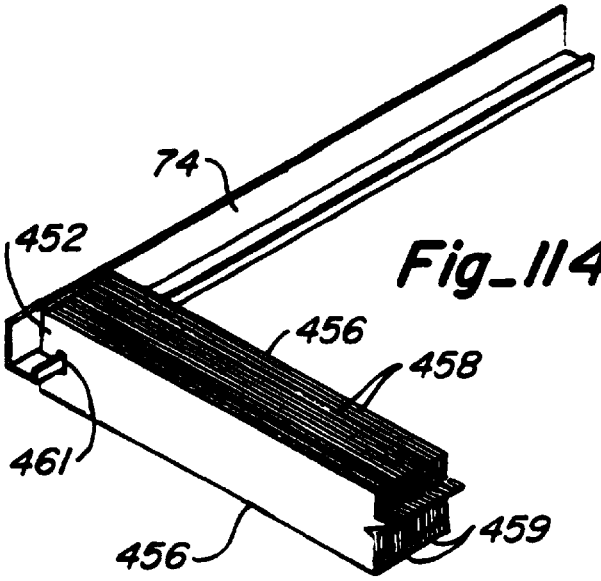
Figure 115:
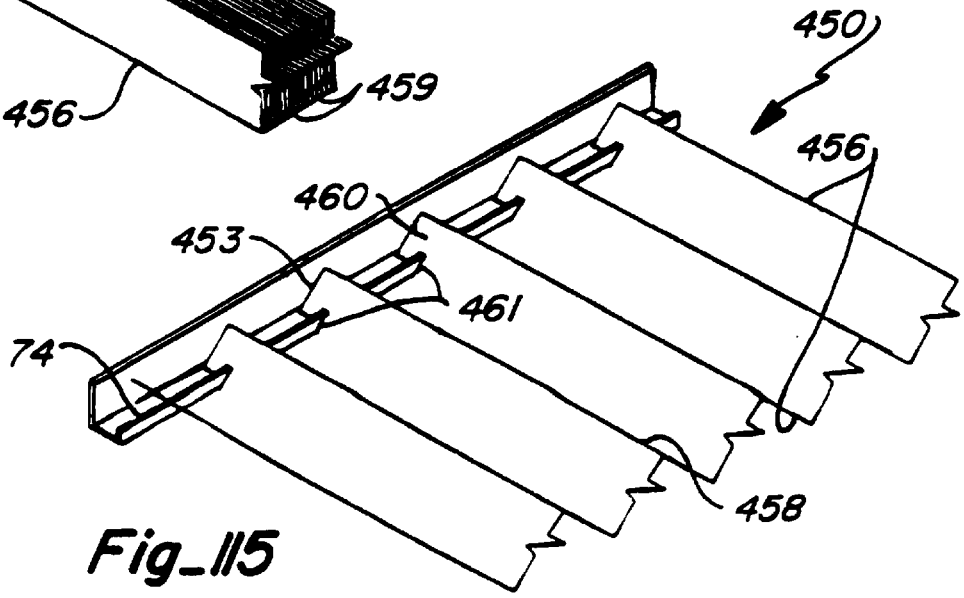

The panel 452 could be supported along its side edges in numerous ways but as illustrated in FIG. 114, a side rail 74 of the type shown in FIG. 17 could be used and the lateral side edges of the panel would in accordance therewith be provided with an L-shaped slot 461. The panel in a collapsed or folded condition is shown in FIG. 114 and in an expanded condition in FIG. 115.

Figure 116:
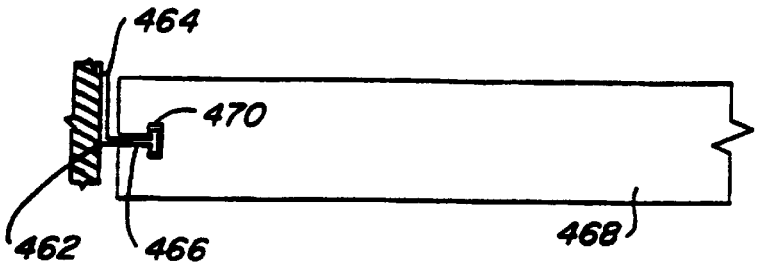
Figure 117:
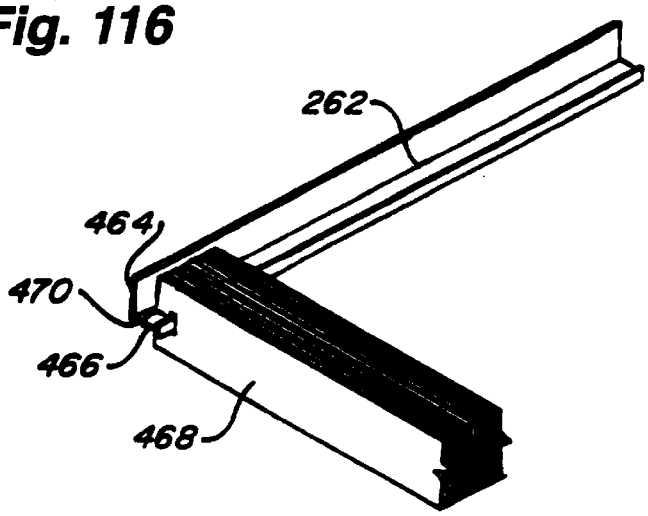
Figure 118:
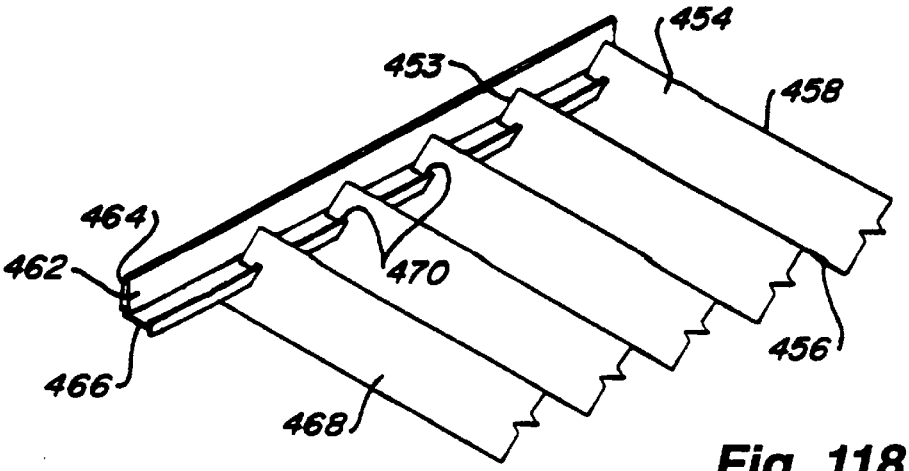

An alternative side rail 462 could be utilized as illustrated in FIGS. 116 and 118 wherein the side rail has a vertical leg 464 and a horizontal leg 466 with the horizontal leg being T-shaped in cross-section so as to cooperate with a T-shaped slot 470 cut in the associated side edge of the panel 468.

Figure 119A:
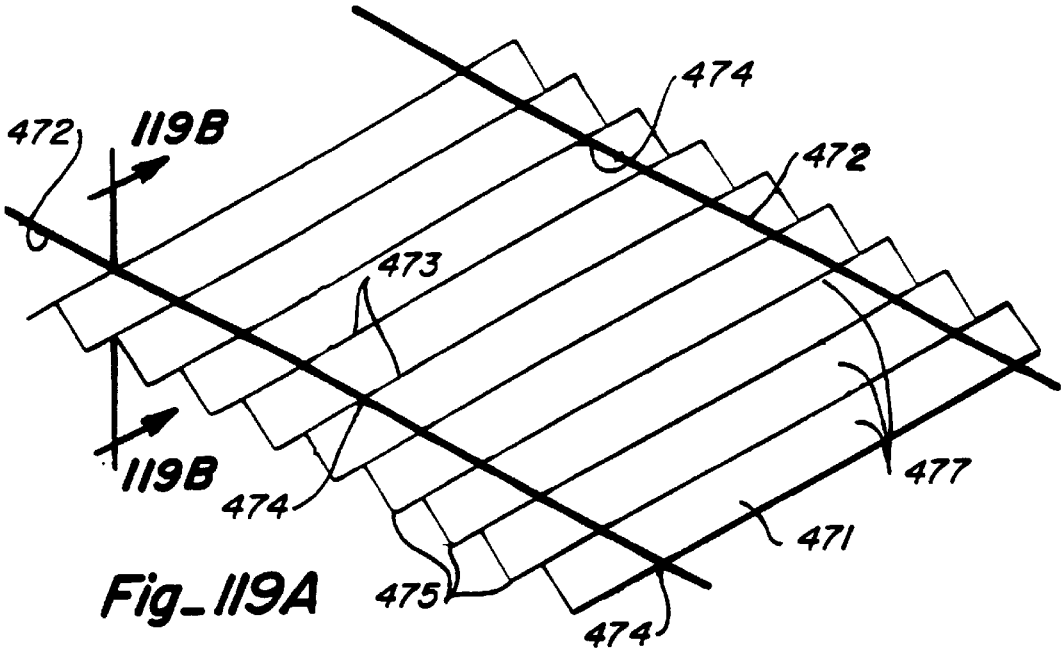
Figure 119B:
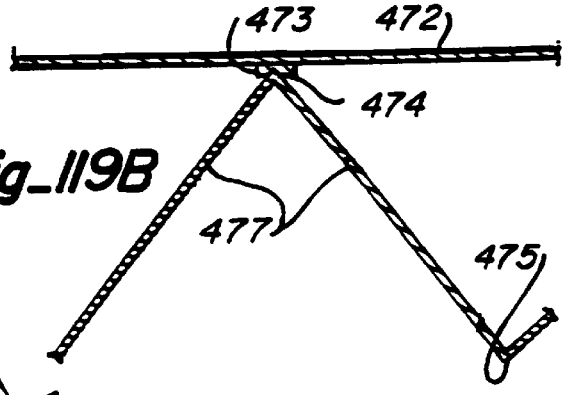

In a different arrangement of the pleated panel embodiment of the present invention as illustrated in FIGS. 119A and 119B, a pleated panel 471 substantially as described previously in connection with FIGS. 112–115, has a plurality of upwardly and downwardly directed pleats 473 and 475, respectively, defining planar sections 477 therebetween which are articulated along the pleats but wherein the upwardly directed pleats 473 are interconnected at equally spaced intervals to a pair or plurality of longitudinally extending flexible cords 472. The cords are bonded to the upwardly directed pleats with adhesive 474 as best seen in FIG. 119B. The cords serve a dual function in maintaining the spacing of the pleats so that the sections 477 of the ceiling panel are uniformly presented and also provide a primary or secondary system for supporting the panel. The cords can be drawn taut and anchored at opposite ends for a sole means of support, or side rails (not shown) as described previously could be utilized with the cords 472 merely serving as intermediate support between the side rails.

In an alternative arrangement of the pleated panel, illustrated in FIGS. 121A, 121B and 122, it can be seen that a panel 473 consists of a lower pleated sheet 474 and an upper sheet 476. At each peak 478 of the lower pleated sheet, the sheet material is gathered in transverse regions and folded upon itself. It is thereafter bonded to itself with adhesive 484 (FIG. 122) in each region to form an upstanding tab 486 (FIG. 121A) at each upwardly directed pleat 478. The upper sheet 476 is also pleated at 488 but utilizes less material between adjacent upwardly directed pleats so that the downwardly directed pleat 490 is shallower than the downwardly directed pleats 492 in the lower sheet 474. The upper sheet 476 is also gathered in transverse regions which are draped over and bonded to the tabs 486 formed on the lower sheet as best seen in FIG. 122.

In this manner, along each upwardly directed pleat for both the upper and lower sheets of the panel 472, an upstanding tab 486 is provided which can be utilized to suspend the panel, such as with an intermediate support 498 of inverted T-shaped configuration as shown in FIG. 123, which would cooperate with aligned inverted T-shaped slots 500 provided in the tabs. The lateral sides of the panel could be supported in any one of numerous ways such as on an L-shaped side rail of the type shown in FIG. 12.

Figure 120:
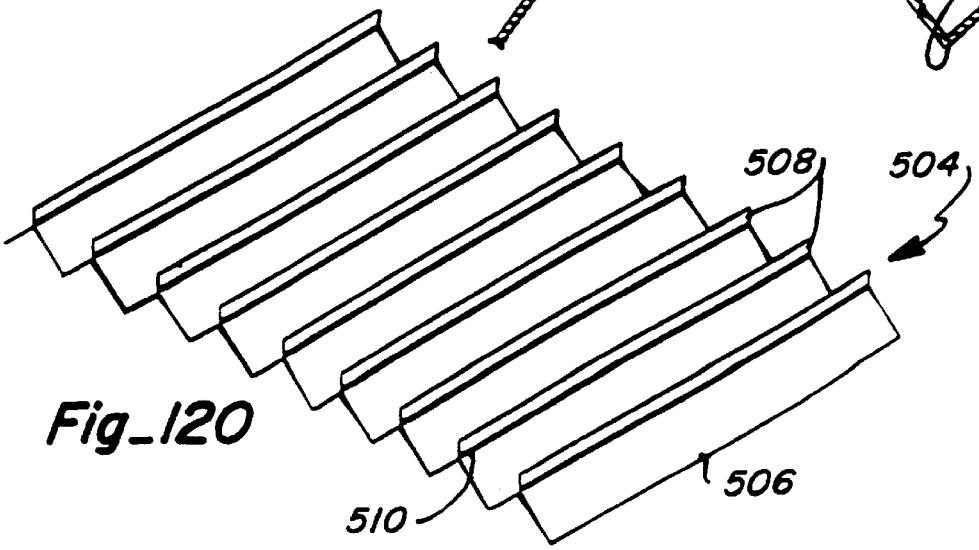

In an alternative arrangement of the pleated panel embodiment shown in FIG. 120, a panel 504 has a single sheet of pleated material 506. The panel 504 has upstanding tabs 508 formed along pleat lines 510 by gathering the sheet of material and folding it upon itself and bonding. The tabs 508 could be provided with aligned inverted T-shaped slots (not shown) to again receive an inverted T-shaped support rail (not shown) along an intermediate location of the panel and could be supported along side edges with any one of numerous systems but by way of example, an L-shaped side rail as seen in FIG. 12.

Curved, Pleated Panel

A pleated panel 512 formed from a single sheet of material is shown in FIGS. 124 and 125 wherein the walls 514 of the panel are arched or curved so that the panel, from the interior of a room where it is mounted, resembles a cellular panel rather than a conventional flat walled pleated panel.

The material from which the panel is formed, is alternately folded in opposite directions so as to form upwardly directed pleats 516 and downwardly directed pleats 518. Where the pleats are formed and the material is folded upon itself, adhesive beads 520 are provided to secure the material to itself to add integrity to the pleats and particularly the downwardly directed pleats that are visible from the interior of the room in which the panel is installed. The upwardly directed pleats 516 are slightly larger than the downwardly directed pleats 518 and may be provided with transverse openings 522 to receive a support cord 524 to suspend the panel or to maintain a desired alignment of the pleats. The placement of the adhesive beads causes the walls of the panel to be arched so as to distinguish it from conventional flat walled pleated panels.

In addition to possibly being supported by the cord 524, the upwardly directed pleats 516 could also be provided with horizontal notches (not shown) in opposite ends so that the panel could be supported with side rails as shown in FIG. 12.

Lap Joint—Flat Cell Panel

FIGS. 127 through 129 illustrate an embodiment of the invention wherein a front or lower pleated sheet 526 and a back or upper pleated sheet 526 are joined to form a cellular panel 530 and wherein the front and back sheets can be made from a plurality of strips 532 and 534 respectively that are interconnected in a manner such that the lines of connection between strips are not visible from the interior of the room in which the panel is mounted. The front sheet 526 can be a single sheet of material that has alternate upwardly and downwardly directed folds that have been creased to form pleats 536 and 538 respectively defining straight walls 540 therebetween. The upper sheet 528 is similarly configured in having upwardly directed pleats 542 but between upwardly directed pleats, the sheet has generally W-shaped lower pleats 544 formed from two downwardly projecting folds 546 and an upwardly directed fold 548 so as to define a downwardly opening channel 530 adapted to receive an upwardly directed pleat 536 of the lower sheet 526. The upper sheet and lower sheet are affixed together at the location where the upper sheet receives the lower sheet as with adhesive 552 or ultrasonic bonding so as to form diamond-shaped cells 554 between the sheets.

The upper sheet 528 can be formed from a plurality of the strips 534 with adjacent edges of the strips overlapped as at 556 and secured together at the overlap. The location of the overlap or joinder between adjacent strips is not important aesthetically as the upper sheet is hidden from view from the interior of the room in which the panel is mounted.

The lower sheet 526 can also be made from a plurality of the strips 532, however, the location of the joinder of the strips and the manner in which the strips are joined is important so as not to detrimentally affect the aesthetics of the panel. As is best seen in FIG. 129, if adjacent strips 532 are used to form the lower sheet, a side edge 558 of one strip can be inserted into the downwardly opening channel 550 of the upper sheet and folded back upon itself to define a truncated or frustoconical fold edge 560 when viewed in cross section. The adjacent side edge 562 of an adjacent strip 532 can be received in the downwardly opening truncated channel so that the joinder of the two strips is not visible from the interior of the room in which the panel is mounted. In other words, by folding an edge of one adjacent strip upon itself and inserting the fold into the downwardly opening channel of the upper sheet and thereafter securing a free edge of the next adjacent strip within the downwardly opening fold, the joinder of the two strips is virtually invisible to the naked eye.

Flat back-Curved Wall Cellular Panel

FIGS. 130 and 131 illustrate a cellular panel 564 wherein the back or upper sheet 566 is substantially flat even though preferably flexible, and it supports from its lower side a pleated sheet 568 having alternating upwardly and downwardly directed pleats 570 and 572 respectively. The lower sheet, where it is folded upon itself to form a pleat, is secured together with adhesive 574 or the like so as to form curved or arcuate side walls 576 of cells 578 defined between the sheets. The upwardly directed pleat 570 on the lower sheet is flattened and bonded or otherwise secured to the underside of the upper sheet along spaced parallel lines to form a soft cellular appearance from the interior of the room in which the panel is mounted.

FIGS. 132 and 133 illustrate a variation of the embodiment shown in FIGS. 130 and 131 where again a panel 580 has an upper or back sheet 582 that is flat yet preferably made of a flexible material and a lower sheet 584 having downwardly directed pointed pleats 586 and upwardly directed flat pleats 588. The flat pleats are secured with adhesive 590, ultrasonically or the like to the upper flat sheet along spaced parallel lines of attachment. The resulting panel has the advantages of a cellular panel but with rather sharp lines as along the downwardly directed pointed pleats 586 and the edges of the upwardly directed flat pleats 588.

In still a further embodiment illustrated in FIGS. 134 and 135, a panel 592 has a flat but preferably flexible top or back sheet 594 secured to a bottom sheet 596 which is desirably folded to define flat lower walls 598 and alternating flat and parallel upper walls 600 with the upper walls being relatively narrow in comparison to the lower walls. The flat lower walls are thereby spaced by the width of an upper wall to define downwardly opening channels 602 therebetween. The flat upper walls are secured to the top sheet 594 as with adhesive, thermal bonding, or the like so that in combination the top sheet and the bottom sheet define quadrilateral cells 604 which are separated by the downwardly opening channels 602 of inverted U-shaped configuration. Of course, the cells and downwardly opening channels can be made of any desired size to vary the aesthetics of the resulting panel.

FIGS. 136 and 137 show still another variation or embodiment of the flat back-cellular panel wherein a panel 606 has a flat top or back sheet 608, which is preferably flexible, supporting a scalloped lower sheet 610 which passes through reverse curves so as to define downwardly directed arches 612 and alternating upwardly directed arches 614. The upwardly directed arches are secured to the top sheet 608 along spaced parallel lines of attachment with adhesive 615, thermal bonding or the like.

Single Sheet Supported Panel

FIGS. 138 through 140 show a pleated panel 616 formed from a continuous sheet of material wherein the panel has sharp downwardly directed pleats 617 alternating with upwardly directed folds 618 wherein the upwardly directed folds are again folded upon themselves to define a channel 619 in which a support rod 620, cord or the like can be received. The material that is folded upon itself is then secured to itself with adhesive 622 or the like to form closure to the channel so that the support rod, cord or the like is retained within the channel. The downwardly directed pleats 617 could be provided with adhesive 624 to further define the pleat and establish integrity so that all pleats in the panel retain a uniform and desired configuration and the walls 626 of the panel are curved or arched.

In another embodiment of the single sheet supported panel as seen in FIGS. 141 through 143, the panel 628 has a sheet 630 that is pleated along spaced parallel line with the pleats 632 directed downwardly and between the pleats, the material is folded upon itself and secured to itself with adhesive 634 or with another suitable bonding process to define closed channels 636 in which support rods 638, cords or the like can be inserted. The support rods can in turn be suspended from a ceiling structure or the like with systems of the type disclosed in FIGS. 38 through 40. Again, the downwardly directed pleats 640 for integrity purposes could include an internal adhesive bead 640 to set the pleat for uniformity of appearance from within the room in which the panel is mounted and to establish curved or arched walls 642.

Double Sheet-Double Pleat Panel

A panel 644 formed from two pleated and confronting sheets is shown in FIGS. 144 and 145 where the upper sheet 646 and the lower sheet 648 are identical in construction in having alternating upwardly and downwardly directed sharp pleats 650 and 652 respectively. The downwardly directed pleats 652 of the upper sheet are overlapped and offset slightly from the upwardly directed pleats 650 of the lower sheet and the sheets are bonded with a suitable adhesive 654, thermal bonding process or the like along the overlap between the two sheets. The resulting panel is, of course, cellular so as to provide desired insulating properties. The panel also has the flexibility of utilizing different materials for the top and bottom sheets (a) with the materials having different sound absorbent qualities, (b) fire retardant qualities or (c) the lower sheet can be a see-through material with the upper sheet in a desired color, etc. There are many variations available with a panel of this type.

Varying Cell Size Panel

A panel 656 illustrated in FIGS. 146 and 147 is comprised of an upper flat, but preferably flexible, sheet 658 of material to which is bonded on its underside a continuous sheet 660 of folded and pleated material so as to define cells 662 of different sizes. The lower sheet has downwardly directed sharp pleats 664 and upwardly directed folds 666 wherein the material is folded upon itself along a substantial area and bonded together along the overlap so as to define vertical walls 668 of double thickness. The top edge of each fold is bonded with adhesive 670 or through another suitable bonding process to the underside of the top sheet so that the two sheets cooperate in defining a plurality of cells 662 having sharp pleats 664 facing into the room in which the panel is mounted. The spacing between downwardly directed pleats 664 and upwardly directed folds 666, in combination with the spacing of the attachment of the folds to the top sheet, defines cells of any desired size.

Tabbed Cellular Back Panel

A panel 672 illustrated in FIGS. 148 and 149 consists of a plurality of individual cells 674 formed from individual strips of material with the cells having been bonded along adjacent sides to form a continuous cellular panel having tabs 676 projecting off a back or top surface thereof. In the disclosed embodiment, the cells 674 are hexagonal in configuration having a downwardly directed pleat 678 defining two flat sides 680 on either side thereof, a pair of vertical sidewalls 682 continuous with the flat sided, and a pair of upwardly convergent top walls 684 that are continuous with the side walls 682. The upwardly convergent top walls have vertically extending flaps 686 which are secured together with adhesive 688 or the like to form the vertical tabs 676. The outer surface of the side walls 682 are bonded with adhesive 690 or in any suitable manner to the adjacent side wall of an adjacent cell so as to form a continuous row of cells which in combination define the panel 672. The tabs could be provided with slots (not shown) along opposite ends to cooperate with supporting rails as shown in FIG. 12 for supporting the panel in the ceiling of a room.

Double Sheet Curved Cellular Panel

FIGS. 150 and 151 illustrate a cellular panel 692 formed from a lower sheet 694 having spaced upwardly directed parallel pleats 696 therein which is adapted to be extended substantially flat and an upper sheet 698 that is made from a sheet of material that is longer than the lower sheet (e.g. three times as long), again having upwardly directed pleats 700 that are vertically aligned with the pleats 696 in the lower sheet. At equally spaced intervals between the upwardly directed pleats in the upper sheet, the upper sheet is folded downwardly at 702 upon itself and secured together by a bead of adhesive 704 or the like with the folds being further secured to the bottom sheet along their lower edge with adhesive 706 or the like along spaced lines of attachment 708 which are equally spaced from the upwardly directed pleats 696 in the lower sheet. Due to the fact that the upper sheet has more material between lines of attachment, it is spaced from the lower sheet so as to define a plurality of adjacent cells 710. As will be appreciated, the cellular panel is collapsible by moving the lines of attachment 708 toward each other and each sheet of the panel will thereupon fold upwardly due to the aligned creases formed therein. This panel as with some previously described panels has an advantage of being able to utilize a relatively expensive fabric as the lower sheet 694 which is visible to the room in which the panel is mounted and a less expensive fabric or sheet material as the upper sheet 698 as it is not exposed to the interior of the room. In other words, the advantages of a cellular panel are obtained through the use of two materials of different values with the more expensive material occupying a minimum portion of the panel for cost saving purposes.

Curable Fabric Panels

Certain fabrics will automatically cure or become more rigid upon expansion with examples of such fabrics being polyester preimpregnated fiberglass cloth. Other fabrics will cure or become more rigid upon exposure to UV radiation or the like with examples being epoxy preimpregnated fiberglass cloth. FIGS. 152 and 153 illustrate a pleated panel 712 having alternating upwardly and downwardly directed sharp pleats 714 with the panel being laminated so as to have, for example, on the upper and lower surface, a material which can be cured by exposure to UV radiation or the like. In forming this panel, the laminated structure is first formed and pleated in a folded condition, then expanded for installation purposes and thereafter the upper and lower sheet, as the case may be, is to the curing environment so as to set the pleats in the expanded condition shown in FIG. 153. The panel thus formed is not retractable but rather retains the desired configuration within the room in which it is mounted.

FIGS. 154 and 155 illustrate a similar but alternate system wherein a panel 716 is first formed in a folded condition as shown in FIG. 154 from a material that becomes more rigid on expansion. This panel is subsequently expanded so as to automatically cure or become relatively rigid due to expansion. The panel can be made from a material that does not cure on expansion and possibly coated after expansion with a rigidifying material such as resin that holds the panel in the expanded position.

Any of the panels disclosed in FIGS. 152 through 155 can be supported, for example, by providing a slot (not shown) in opposite ends thereof and inserting into the slot a support rail such as shown in FIG. 12.

As might be appreciated, while the various panels described have been described as being useful as a ceiling panel and in the case of the compressive triangle embodiment also as a retractable wall, the panels could also be used as wall coverings. The conversion from their use in ceilings as described herein to a wall installation is felt to be within the skill of those in the art.

We claim:

1. A cladding system covering a ceiling in a building structure comprising in combination:

a support structure coupled to said building structure including a plurality of horizontally disposed elongated support members positioned immediately beneath said ceiling, and at least one first horizontally disposed sheet of material extending between and supported by said support members, and at least one horizontally disposed second sheet extending between and supported by said support members, said at least one second sheet being positioned above said at least once first sheet defining hollow spaces between said sheets, and said at least one first sheet having a plurality of openings therethrough.

2. The system of claim 1 wherein said at least one first sheet droops between said support members.

3. The system of claim 2 wherein said at least one first sheet is flexible.

4. The system of claim 3 wherein said at least one first sheet is a fabric material.

5. The system of claim 4 wherein said at least one first sheet is a woven fabric material.

6. The system of claim 1 wherein said at least one first sheet of material is draped over more than two of said support members.

7. The system of claim 1 wherein said at least one first sheet of material is clipped to said support members.

8. The system of claim 1 wherein said at least one first and second sheets of material droop between adjacent support members.

9. The system of claim 1 wherein said at least one first and second sheets have side edges supported by said support members and end edges perpendicular to said side edges, said support structure further including rails for supporting said end edges.

10. The system of claim 9 wherein said rails are generally C-shaped in transverse cross-section and slidably receive said end edges of said sheet materials.

11. The system of claim 6 wherein said at least one first sheet of material has lines of delineation defined by pleats in the material which extend along said support members.

12. The system of claim 11 wherein cells are defined between said at least one first and second sheets of material and adjacent support members.

13. A cladding system covering a ceiling in a building structure comprising in combination:

a support structure coupled to said building structure including a plurality of horizontally disposed elongated support members, and at least one first horizontally disposed flexible sheet of material extending between and supported by said support members so as to be configured by gravity, and at least one horizontally disposed second sheet extending between and supported by said support members, said at least one second sheet being positioned above said at least one first sheet, and said at least one first sheet drooping between adjacent support members to define cells between said at least one first and second sheets and adjacent support members.

14. The system of claim 13 wherein said at least one first sheet is a fabric material.

15. The system of claim 14 wherein said at least one sheet is a woven fabric material.

16. The system of claim 13 wherein said at least one first sheet of material is draped over more than two of said support members.

17. The system of claim 13 wherein said at least one first sheet of material is clipped to said support members.

18. The system of claim 13 wherein said at least one first and second sheets of material droop between adjacent support members.

19. The system of claim 13 wherein said at least one first and second sheets have side edges supported by said support members and end edges perpendicular to said side edges, said support structure further including rails for supporting said end edges.

20. The system of claim 19 wherein said rails are generally C-shaped in transverse cross-section and slidably receive said end edges of said sheet materials.

* * * * *